US011617916B2

(12) United States Patent
Brasch et al.

(10) Patent No.: US 11,617,916 B2
(45) Date of Patent: Apr. 4, 2023

(54) RETRACTABLE WALL MOUNTABLE INCLINABLE BENCH SYSTEM

(71) Applicant: PRx Performance, LLC, Fargo, ND (US)

(72) Inventors: Brian B. Brasch, Fargo, ND (US); Brandon V. Anderson, Fargo, ND (US); Kevin D. Barth, Thief River Falls, MN (US); Alexander M. Johnson, Fargo, ND (US); Michael W. Nesemeier, Fargo, ND (US)

(73) Assignee: PRx Performance, LLC, Fargo, ND (US)

( * ) Notice: Subject to any disclaimer, the term of this patent is extended or adjusted under 35 U.S.C. 154(b) by 0 days.

(21) Appl. No.: 17/944,406

(22) Filed: Sep. 14, 2022

(65) Prior Publication Data

US 2023/0020896 A1 Jan. 19, 2023

Related U.S. Application Data

(63) Continuation of application No. 17/234,305, filed on Apr. 19, 2021, now Pat. No. 11,446,539.

(51) Int. Cl.
*A63B 21/00* (2006.01)

(52) U.S. Cl.
CPC ..... *A63B 21/4029* (2015.10); *A63B 2210/50* (2013.01)

(58) Field of Classification Search
CPC ..... A63B 21/4029; A63B 2210/50; A63B 2210/56; A63B 2225/093; A63B 21/078; F16B 7/105; F16B 7/10
See application file for complete search history.

(56) References Cited

U.S. PATENT DOCUMENTS 618,990 A 2/1899 Lubben
1,104,505 A 7/1914 Holworthy
(Continued)

FOREIGN PATENT DOCUMENTS

CN 103598759 A 2/2014
DE 4307632 A1 9/1993
(Continued)

OTHER PUBLICATIONS https://www.roguefitness.com/rogue-r-3w-fold-back-wall-mount-rack; Rogue Fitness R-3W Fold Back Wall Mount Rack Website Page; Jan. 1, 2014.
(Continued)

*Primary Examiner* — Andrew S Lo
*Assistant Examiner* — Andrew M Kobylarz
(74) *Attorney, Agent, or Firm* — Neustel Law Offices

(57) ABSTRACT

An inclinable bench system for exercise that is attachable to a wall with a mounting bracket, is extendable outwardly from the wall when in use, and is retractable towards the wall when not in use. The inclinable bench generally includes a torso portion and a seat portion on a support segment, latches for selectively latching the bench to the support segment in a first position with the torso and seat portions parallel for extension and retraction, latches for latching the bench in a plurality of selected second positions with the torso and seat portions inclined, and latch operators for operating the latches for the bench to move between the first and second positions. The seat portion is movably supported on a two-level rail and as the bench is moved between the first and second positions the seat portion is automatically inclined.

20 Claims, 52 Drawing Sheets

(56) References Cited

U.S. PATENT DOCUMENTS 1,696,145 A 12/1928 Wagoner
2,855,200 A 10/1958 Blickman
3,414,262 A 12/1968 Lounsbury
3,614,097 A 10/1971 Blickman
3,874,657 A 4/1975 Niebojewski
3,918,710 A 11/1975 Niebojewski
4,249,726 A 2/1981 Faust
4,257,590 A 3/1981 Sullivan
4,262,901 A 4/1981 Faust
4,275,882 A 6/1981 Grosser
4,286,782 A 9/1981 Fuhrhop
4,306,715 A 12/1981 Sutherland
4,358,109 A 11/1982 Schrems
4,368,884 A 1/1983 Colvin
4,369,966 A 1/1983 Silberman
4,396,191 A 8/1983 Metler
4,527,797 A 7/1985 Slade, Jr.
4,603,855 A * 8/1986 Sebelle ..... A63B 21/06 482/133
4,615,524 A 10/1986 Sutherland
4,621,809 A 11/1986 Pearl
4,632,390 A * 12/1986 Richey ..... A63B 21/154 482/133
4,635,934 A 1/1987 Roethke
4,637,608 A 1/1987 Owens
4,645,196 A 2/1987 Christie
4,650,186 A 3/1987 McCreery
4,729,561 A 3/1988 Desjardins
4,749,190 A * 6/1988 Jennings ..... A63B 21/4031 482/104
4,757,998 A 7/1988 Landin
4,759,539 A 7/1988 Nieppola
4,765,616 A 8/1988 Wolff
4,773,642 A 9/1988 Cruz
4,781,374 A 11/1988 Lederman
4,795,149 A 1/1989 Pearson
4,804,179 A 2/1989 Murphy
4,826,153 A 5/1989 Schalip
4,842,270 A 6/1989 Lange
4,844,448 A 7/1989 Niznik
4,861,024 A 8/1989 Lee
4,861,025 A 8/1989 Rockwell
4,898,381 A 2/1990 Gordon
4,907,798 A 3/1990 Burchatz
4,915,377 A 4/1990 Malnke
4,919,419 A 4/1990 Houston
4,927,135 A 5/1990 Nieppola
4,928,961 A 5/1990 Madden
4,934,693 A 6/1990 Santoro
4,936,572 A 6/1990 Desiderio
4,955,604 A 9/1990 Pogue
4,958,833 A 9/1990 Stater
4,960,277 A 10/1990 LaRossa
4,974,837 A 12/1990 Someya
4,976,428 A 12/1990 Ghazi
5,011,141 A 4/1991 Towley, III
5,046,722 A 9/1991 Antoon
5,082,259 A 1/1992 Gonzalez
5,082,260 A 1/1992 Dinelli
5,098,093 A 3/1992 Dupre
5,098,361 A 3/1992 Danylieko
5,141,480 A 8/1992 Lennox
5,151,072 A 9/1992 Cone
5,184,992 A 2/1993 Banks
5,242,345 A 9/1993 Mitchell
5,249,858 A 10/1993 Nusser
5,281,193 A 1/1994 Colbo, Jr.
5,306,220 A 4/1994 Kearney
5,328,428 A 7/1994 Huang
5,346,448 A 9/1994 Sollo
5,350,346 A 9/1994 Martinez
D358,623 S 5/1995 Macasieb
5,456,644 A 10/1995 Hecox
5,466,204 A 11/1995 Nearing
5,509,876 A 4/1996 Reyes
5,551,936 A 9/1996 Parisi
5,669,859 A 9/1997 Liggett
5,688,216 A 11/1997 Mauriello
D390,287 S 2/1998 Hsieh
5,755,823 A 5/1998 Cleary
5,779,601 A 7/1998 Ish, III
5,813,951 A 9/1998 Einsig
5,882,283 A 3/1999 Stevens
5,921,897 A 7/1999 Stevens
5,964,684 A 10/1999 Sokol
5,971,897 A 10/1999 Olson
6,027,433 A 2/2000 Flynn
6,073,624 A 6/2000 Laurent
6,248,048 B1 6/2001 Zuckerman
6,299,568 B1 10/2001 Prok
6,328,679 B1 12/2001 Croft
6,443,877 B1 9/2002 Hoecht
6,579,213 B1 6/2003 Webber
6,645,130 B2 11/2003 Webber
6,685,601 B1 2/2004 Knapp
7,070,546 B1 7/2006 Grasso
7,291,102 B2 11/2007 Mackert
7,338,416 B2 3/2008 Smith
7,374,516 B2 5/2008 Lundquist
7,393,309 B2 7/2008 Webber
7,455,621 B1 11/2008 Anthony
7,465,260 B2 * 12/2008 Hockemeyer ..... A63B 21/4029 482/142
7,488,277 B1 2/2009 Knapp
7,549,950 B1 6/2009 Lundquist
7,575,538 B1 8/2009 Clark
7,635,322 B2 12/2009 Parrilla
7,666,118 B1 2/2010 Anthony
7,699,756 B2 4/2010 Piane, Jr.
8,047,972 B1 11/2011 Dean
8,231,509 B2 7/2012 Lundquist
8,491,449 B2 7/2013 Rogers
8,506,459 B2 8/2013 Cassidy
8,547,900 B2 10/2013 Yi
8,651,293 B2 2/2014 Boyer
8,727,953 B2 5/2014 Drechsler
9,192,799 B2 11/2015 Alenaddaf
9,333,387 B2 5/2016 Hopperstad
9,409,048 B1 8/2016 Hopperstad
9,498,670 B1 11/2016 Hopperstad
9,675,510 B2 6/2017 Moerth-Cross
9,713,745 B2 7/2017 Rogers
10,195,479 B2 * 2/2019 Brasch ..... A63B 21/078
10,835,774 B1 11/2020 Brasch
10,953,301 B2 3/2021 Brasch
11,007,399 B1 5/2021 Brasch
2004/0092369 A1 5/2004 Slawinski
2005/0032614 A1 * 2/2005 Keiser ..... A63B 21/4029 482/142
2006/0040810 A1 * 2/2006 Chu ..... A63B 21/4035 482/121
2007/0270293 A1 * 11/2007 Zhuang ..... A63B 21/4029 482/121
2008/0276551 A1 11/2008 Thomas
2009/0017997 A1 1/2009 Piggins
2009/0143203 A1 6/2009 Knapp
2009/0203505 A1 * 8/2009 Kroll ..... A63B 21/078 482/104
2009/0289535 A1 11/2009 Weber
2010/0048368 A1 2/2010 Donofrio
2011/0195822 A1 8/2011 Donofrio
2012/0289384 A1 11/2012 Staten
2013/0257242 A1 10/2013 Bunch
2014/0018215 A1 1/2014 Donofrio
2014/0031182 A1 1/2014 Donofrio
2014/0243174 A1 * 8/2014 Alenaddaf ..... A63B 21/15 482/142
2014/0339184 A1 11/2014 Couch
2015/0148197 A1 5/2015 Lentz
2015/0264823 A1 9/2015 Shirley
2015/0290488 A1 10/2015 Hopperstad
2015/0352395 A1 12/2015 Gregory
2016/0016033 A1 1/2016 Schrag
2017/0065844 A1 3/2017 Hopperstad

(56) References Cited

U.S. PATENT DOCUMENTS

| | | | | |
|---|---|---|---|---|
| 2017/0146282 | A1 | 5/2017 | Dodge | |
| 2017/0197109 | A1 | 7/2017 | Cole | |
| 2017/0239512 | A1* | 8/2017 | Brasch | A63B 21/4029 |
| 2018/0178051 | A1 | 6/2018 | Shaw, Jr. | |
| 2018/0326250 | A1 | 11/2018 | Henniger | |
| 2019/0240525 | A1 | 8/2019 | Leipheimer | |
| 2020/0131825 | A1 | 4/2020 | Hirtsiefer | |
| 2020/0197737 | A1 | 6/2020 | Kistner | |
| 2020/0384337 | A1 | 12/2020 | Brasch | |

FOREIGN PATENT DOCUMENTS

| | | | |
|---|---|---|---|
| GB | 2076299 | A | 12/1981 |
| KR | 102012192 | B1 | 10/2019 |
| WO | 2009003280 | A1 | 1/2009 |

OTHER PUBLICATIONS

2717 Equipment Facebook Posts—W-1 Pull Up and Rack; Nov. 8, 2012.

2717 Equipment Facebook Posts—Wall Mounted Pull Up and Squat Rack; Mar. 27, 2012.

https://www.youtube.com/watch?v=koAzH91o474; YouTube Video Matt Chan Talks the Dirty South Bar; Dec. 20, 2012.

https://www.youtube.com/watch?v=f6bPYbS _2Fw; YouTube Video Equipment Demo Rogue Dirty South Bar; Apr. 25, 2012.

Pictures of PRX Performance Pull-Up Bar on Central Rig Display at Granite Games; Oct. 5, 2013.

http://board.crossfit.com/showthread.php?t=86058; Pictures from Website for Crossfit Message Board; Feb. 8, 2014.

http://board.crossfit.com/showthread.php ?t=86058; Website for Crossfit Message Board; Feb. 8, 2014.

http://www.roguefitness.com/rogue-4-monster-lite-wall-mount, Monster Lite Wall Mount Rig Webpage from Rogue Fitness; Jan. 1, 2014.

http://www.roguefitness.com:80/x-43m-multi-grip-crossmember.php; Rogue Fitness X-43 Multi-Grip Crossmember Website Page; Jan. 23, 2013.

http://www.roguefitness.com:80/w4-garage-gym.php; Rogue Fitness W-4 Garage Gym Website Page; Jan. 23, 2013.

http://www.roguefitness.com:80/rogue-sm-2-monster-squat-stand.php; Rogue Fitness SM-2 Monster Squat Stand Website Page; Jan. 27, 2013.

http://www.roguefitness.com: 80/rogue-r-3-power-rack.php; Rogue Fitness R3 Power Rack Website Page; Jan. 11, 2013.

http://www.roguefitness.com:80/bodyweight-gymnastics/rpg-pullup-system.php; Rogue Fitness Pull Up & RPG Systems Website Page; Jan. 23, 2013.

http://www.roguefitness.com:80/dirty-south-bar.php; Rogue Fitness Dirty South Bar Website Page; Jan. 23, 2013.

https://popcomgadget.com/explore/flipbench/; Flipbench Webpage (Screen Capture Thereof); Feb. 7, 2021.

PCT International Search Report and Written Opinion for PCT/US22/15620; dated May 6, 2022.

* cited by examiner

RETRACTABLE WALL MOUNTABLE INCLINABLE BENCH SYSTEM

CROSS REFERENCE TO RELATED APPLICATIONS

The present application is a continuation of U.S. application Ser. No. 17/234,305 filed on Apr. 19, 2021 which issues as U.S. Pat. No. 11,446,539 on Sep. 20, 2022. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Example embodiments of the present disclosure in general relate to a retractable wall mountable inclinable bench system for weightlifting or exercising that can be extended outwardly from the wall when in use and retracted towards the wall when not in use.

Any discussion of the related art throughout the specification should in no way be considered as an admission that such related art is widely known or forms part of common general knowledge in the field. Conventional weightlifting benches are typically comprised of a horizontally orientated (or inclined) bench, a front pair of legs extending downwardly from a front portion of the bench and a rear pair of legs extending downwardly from a rear portion of the bench. Some conventional weightlifting benches have an adjustable incline to move between a horizontal state to an inclined state for performing various types of weightlifting exercises.

One problem with conventional weightlifting benches is they are relatively large and require a significant amount of storage space when not in use. This is a particularly troublesome problem for smaller gyms where space is a premium such as, but not limited to, home gyms. In addition, most weightlifting benches are constructed of heavy metal materials making them difficult and cumbersome to move around a gym.

SUMMARY

Some of the various example embodiments of the present disclosure relate to an inclinable exercise bench. Some of the various embodiments of the present disclosure include a mounting bracket adapted to be attached to a wall, a first (or wall-connecting) segment, and a second (or support) segment. Each of the segments has a front end portion further from the wall and a rear end portion closer to the wall. The first segment is pivotally connected to the mounting bracket at or near its rear end portion. The second segment is pivotally connected at or near its rear end portion to the first segment at or near the front end portion of the first segment. The bench has a retracted state with the first and second segments arranged in a folded overlapping manner near the wall, and an extended state with the first and second segments arranged in an unfolded substantially end-to-end manner extending in a direction away from the wall.

In some other embodiments in the present disclosure, the bench includes a torso portion with a first surface and a seat portion with a second surface. The torso portion and the seat portion are movably supported on the second segment and are pivotally connected for movement together on the second segment and to be upwardly inclined on the second segment with respect to the second segment and to each other. With the bench in the retracted state, the first and second surfaces are substantially vertical and co-planar or parallel. In the extended state, the bench has a first position in which it is substantially horizontal and parallel with the second segment and a plurality of selectable second positions in which it is inclined upwardly at various angles from the second segment. In the first position, the first and second surfaces of the torso and seat portions respectively are substantially horizontal and co-planar or parallel. In the second positions, the first surface of the torso portion is inclined upwardly at various angles facing the front end portion of the second segment, and the second surface of the seat portion is inclined upwardly at an angle facing the rear end portion of the second segment.

In some other embodiments of the present disclosure, the second segment includes a surface with an elongated track having a first level and a second level. The second level is elevated in relation to the first level. A ramp connects the first level and the second level. The seat portion of the bench has a front end portion and a rear end portion and is movably supported on the track. As the torso portion and the seat portion of the bench are moved together on the second segment from the first position to a selected second position, the rear end portion of the seat portion moves along the first level of the track, and the front end portion of the seat portion moves along the ramp and the second level of the track to automatically incline the second surface upwardly from the second segment facing the rear end portion of the second segment.

In some other embodiments of the present disclosure, the bench may include a latching system. The latching system includes a first latch adapted to selectively latch the bench to the second segment in the first position for moving the bench between the retracted and extended states, and a second latch adapted to selectively latch the bench to the second segment in a selected second position for performing an exercise. The first latch and the second latch are adapted to be selectively operated to unlatch the bench from the second segment to move between the first position and the second positions. In an embodiment, the first latch is attached to the torso portion and is adapted to latch the torso portion to the second segment in the first position, and the second latch is attached to the seat portion and is adapted to latch the seat portion to the second segment in the selected second position. In an embodiment, a latch operator is operatively connected to both the first latch and the second latch, and is adapted to be selectively operated by a user to unlatch the first latch and the second latch in the unlatched position together to allow the bench to be moved between the first position and the second positions. In another embodiment, the first latch and the second latch each have a separate corresponding latch operator operatively connected thereto and the latch operators are separately and independently operable by a user to selectively and separately place the first latch and the second latch in the unlatched position to allow the bench to be moved between the first position and the second positions.

In some other embodiments of the present disclosure, the bench includes an elongated rigid support member and may optionally include an elongated actuator that is pivotally connected between the torso portion and the second segment. The actuator if used is adapted to provide a bias force to the torso portion to urge the torso portion in the second position and the rigid support member is adapted to support the torso portion in the second position.

There has thus been outlined, rather broadly, some of the embodiments of the retractable wall mountable inclinable bench system in order that the detailed description thereof may be better understood, and in order that the present contribution to the art may be better appreciated. There are additional embodiments of the retractable wall mountable inclinable bench system that will be described hereinafter and that will form the subject matter of the claims appended hereto. In this respect, before explaining at least one embodiment of the retractable wall mountable inclinable bench system in detail, it is to be understood that the retractable wall mountable inclinable bench system is not limited in its application to the details of construction or to the arrangements of the components set forth in the following description or illustrated in the drawings. The retractable wall mountable inclinable bench system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1A:
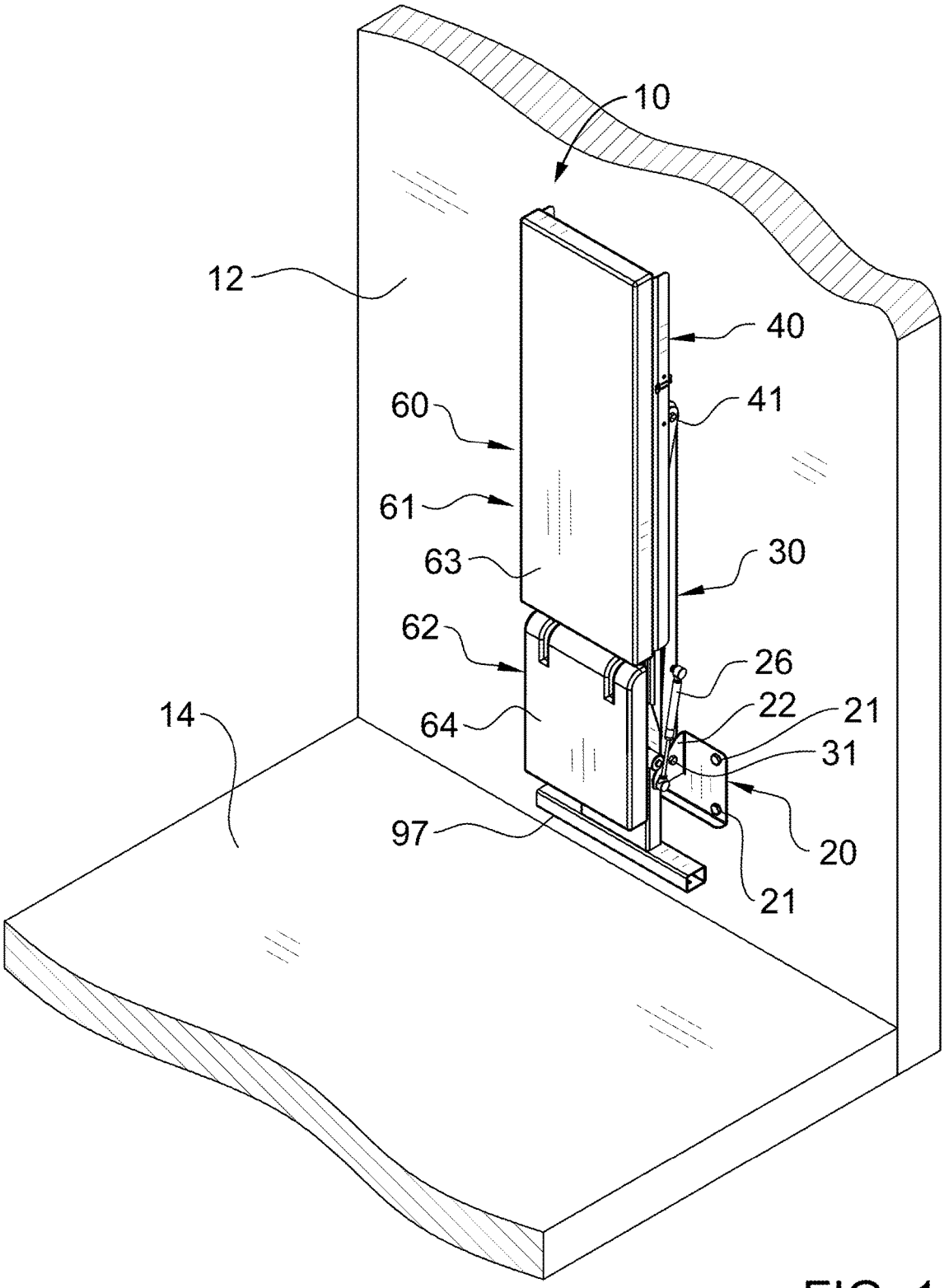
FIG. 1A is a perspective view of a retractable wall mountable inclinable bench attached to a wall in a retracted state in accordance with an example embodiment.
Figure 29:
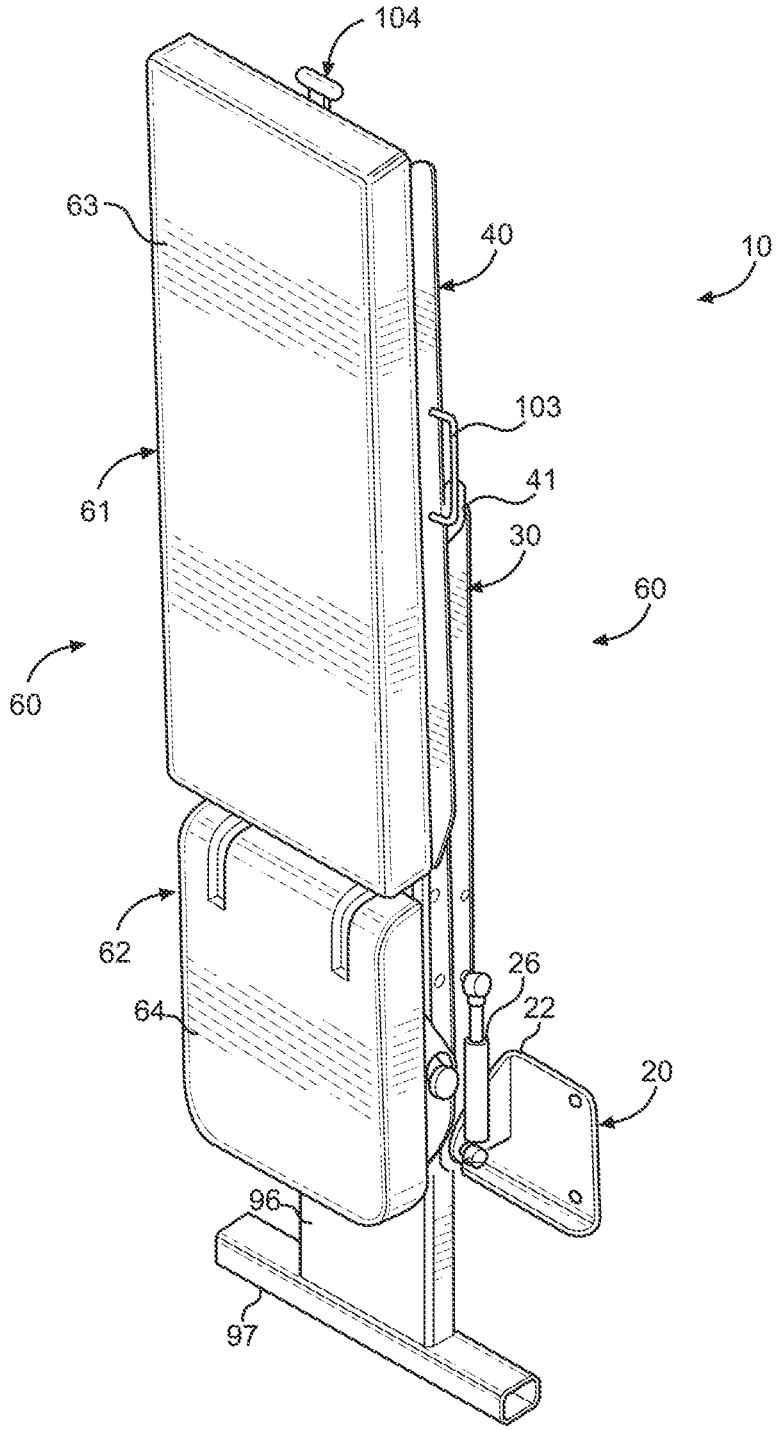
FIG. 29 is a perspective view of a retractable wall mountable inclinable bench in a retracted state for storage in accordance with an alternative example embodiment.

Some of the various embodiments of the present disclosure relate to an inclinable bench for performing various types of exercises on by an exerciser 19. Some of the various embodiments of the present disclosure include a mounting bracket 20 adapted to be attached to a wall 12 and a bench 60 pivotally connected to the mounting bracket 20. The bench 60 comprises a first segment 30 that is pivotally connected to the mounting bracket 20 and a second segment 40 that is pivotally connected to the first segment 30. The bench 60 has a retracted state and an extended state. In the retracted state, the first segment 30 and the second segment 40 pivot into a folded overlapping manner that provides compact storage of the bench system 10 near the wall 12 as illustrated in FIGS. 1A and 29. In the extended state, the first segment 30 and the second segment 40 pivot into an unfolded substantially end-to-end arrangement extending in a direction away from the wall 12 for the bench system 10 to be used for exercise.

The bench 60 comprises a first support member 95 pivotally attached to the bench 60 and a second support member 96 pivotally attached to the bench 60. In the extended state, the first support member 95 and the second support member 96 pivot and extend downwardly from the bench 60 and support the bench 60 on a floor 14. In the retracted state, the first support member 95 and the second support member 96 pivot to a substantially vertical position alongside the bench 60 for compact storage near the wall 12.

In the extended state, the bench 60 has a first position and a plurality of selectable second positions. In the first position, the bench 60 is substantially flat and horizontal for performing a variety of weight-lifting or other exercises. In the plurality of second positions, the bench 60 is upwardly inclined at a plurality of different angles for performing a variety of weight-lifting or other exercises.

The bench 60 comprises a torso portion 61 with a substantially flat first surface and a seat portion 62 with a substantially flat second surface. The torso portion 61 and the seat portion 62 are movably supported on the second segment 40.

In the extended state, when the bench 60 is in the first position the torso portion 61 and the seat portion 62 are substantially horizontal and parallel with the second segment 40 and the first and second surfaces are substantially horizontal and co-planar thus providing a substantially flat horizontal bench. When the bench 60 is in a selected second position, the torso portion 61 is upwardly inclined at an angle in relation to the second segment 40 with the first surface facing a front end portion of the bench 60, and the seat portion 62 is upwardly inclined at a different angle in relation to the second segment 40 with the second surface facing in a rear end portion of the bench 60. With a plurality of selectable second positions available, a plurality of different inclined bench configurations are provided for exercise. The bench 42 can thus be used to perform a wide variety of different weightlifting and other exercises.

In the retracted state, the first and second surfaces are substantially vertical and co-planar. The bench 60 is thus configured for compact storage near the wall 12.

The second segment 40 of the bench 60 includes an elongated track 42 having a first level 43, an elevated second level 44, and a ramp 45 between the first level 42 and the second level 43. The seat portion 62 of the bench 60 is movably supported on the track 42 and moves along the track 42 as the bench 60 is moved between the first substantially horizontal position and the plurality of selectable second inclined positions. The seat portion 62 has a front end portion and a rear end portion. As the seat portion 62 moves along the track 42, the rear end portion is supported on and moves along the first level 43 of the track 42 and the front end portion of travels up the ramp 45 and is supported and moves along the second level 44. Accordingly, as the bench 60 is moved from the first substantially horizontal position to a selected second inclined position, the seat portion 62 automatically moves from a substantially flat horizontal orientation to an upwardly inclined orientation with the second surface facing toward the rear end portion of the second segment 40 and the first surface of the torso portion 61.

The bench 60 also includes a latching system. In one embodiment, the latching system includes a first latch 65 attached to the torso portion 61, a second latch 66 attached to the seat portion 62, and one or more latch operators 67 that are operatively connected to the first and second latches 65, 66. The first latch 65 is operable to latch the bench 60 to the second segment 40 with the torso and seat portions 61, 62 in a substantially horizontal and co-planar arrangement for moving the bench 60 between the extended and retracted positions and vice versa. The second latch 66 is operable when the bench 60 is in the extended state to latch the bench 60 in a selected inclined position with the torso portion 61 and the seat portion 62 inclined upwardly in relation to the second segment 40.

The latch operators 67 can be manipulated by an exerciser when the bench 60 is in the extended state to operate the first and second latches 65, 66 together to unlatch the bench 60 from the second segment 40 in order to move the bench 60 between the first substantially horizontal position and the plurality of selectable second inclined positions. The latch operators 67 can also be manipulated when the bench 60 is latched to the second segment 40 in a selected second inclined position to unlatch the bench 60 from the second segment 40 and move it to another selected inclined position or to return it to the first substantially flat horizontal position.

In an alternative embodiment, the latching system includes separate and independently operable first and second latches 102, 106. The first latch 102 comprises a first latch operator 104 attached to the torso portion 61 and a corresponding first latch receiver 105 attached to the second segment 40. The second latch 106 comprises a second latch operator 112 attached to the seat portion 62 and a plurality of selectable second latch receivers 107 formed in the second segment 40. The first latch operator 104 is manipulated to selectively operate the first latch 102 to latch and unlatch the torso portion 61 of the bench 60 from the second segment 40. The second latch operator 112 is manipulated to selectively operate the second latch 106 to selectively latch and unlatch the seat portion 62 of the bench from the second segment 40. With the torso portion 61 latched to the second segment 40, the bench 60 is readily movable between a retracted position for storage and an extended substantially horizontal position suitable for exercise. With the bench 60 in the extended substantially horizontal position and the torso and seat portions 61, 62 unlatched from the second segment 40, the bench 60 is readily movable between the extended substantially horizontal position and a plurality of selectable inclined positions suitable for exercises. The plurality of second inclined positions correspond with a plurality of longitudinally spaced positions of the plurality of second latch receivers 107 on the second segment 40.

B. Mounting Bracket

Figure 4A:
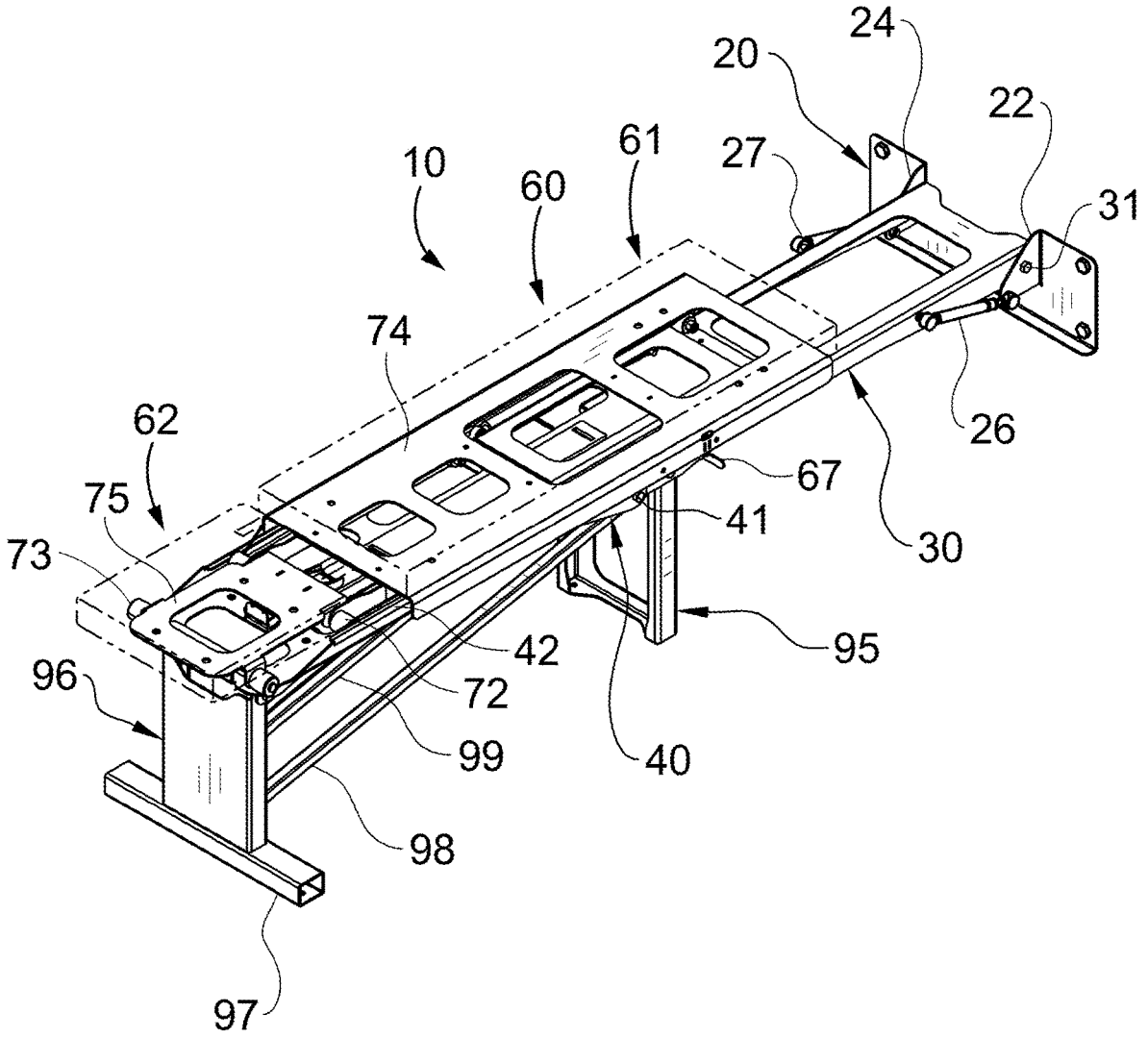
FIG. 4A is a front perspective view of a retractable wall mountable inclinable bench in an extended state in a substantially horizontal position illustrated partially transparent to reveal various components in accordance with an example embodiment.
Figure 4B:
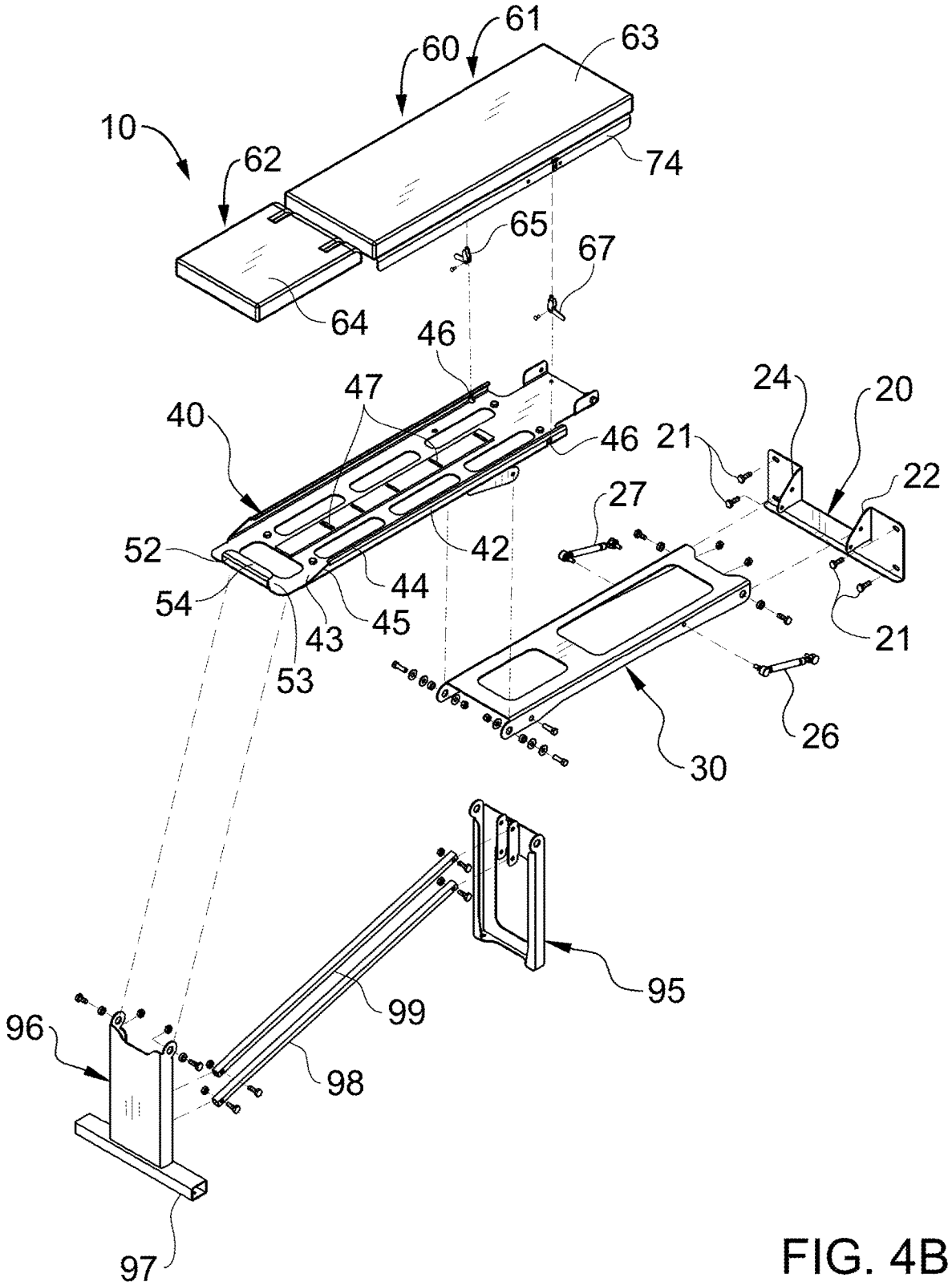
FIG. 4B is an exploded front perspective view of a retractable mountable inclinable bench in an extended state in accordance with an example embodiment.
Figure 5:
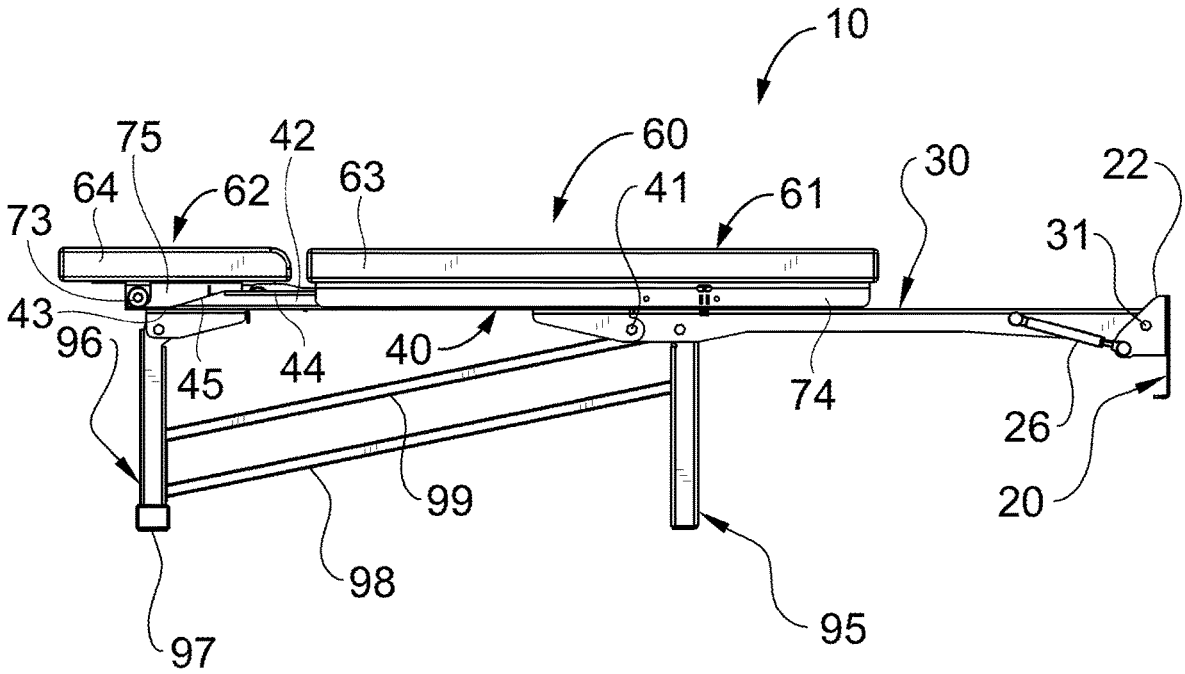
FIG. 5 is a left side view of a retractable wall mountable inclinable bench in an extended state in a substantially horizontal position in accordance with an example embodiment.

As illustrated in FIGS. 1-19, an example mounting bracket 20 is adapted to be attached to a wall 12 with fasteners 21 (e.g., bolts, screws). Apertures within the mounting bracket 20 receive the fasteners 21 as shown in FIG. 4B. The mounting bracket 20 has a flat portion that is positioned against the wall 12 wherein the apertures extend through the flat portion of the mounting bracket 20 for receiving the fasteners 21 as shown in FIG. 4B. The apertures are preferably aligned with studs in the wall 12, but various other configurations may be used for the apertures. The mounting bracket 20 is preferably constructed of a rigid material such as, but not limited to, metal.

The mounting bracket 20 further preferably includes a first side bracket 22 and a second side bracket 24 that extend outwardly from the mounting bracket 20 to pivotally connect to the bench 60 and more specifically to the first segment 30 of the bench 60. The first side bracket 22 is positioned on a first side, e.g., the left side, of the bench 60 and the second side bracket 24 is positioned on a second side opposite the first side, e.g., the right side, of the bench 60. It is understood that various other configurations may be used for the mounting bracket 20 and that the mounting bracket 20 may be comprised of any structure capable of pivotally connecting the bench 60 to a wall 12. Moreover, although a wall 12 is specified herein for explanatory purposes, it will be appreciated that the mounting bracket 20 may be attached to any other preferably substantially vertical support structure capable of supporting the bench 60.

C. Bench

The bench 60 comprises a first segment 30, a second segment 40, a torso portion 61 with a first surface, a seat portion 62 with a second surface, a front end portion, and a rear end portion opposite of the front end portion. For purposes of describing the example embodiments herein only, "front end portion" has been arbitrarily selected to refer to a portion that is further from the wall 12 in relation to the "rear end portion," and "rear end portion" has been arbitrarily selected to refer to a portion that is nearer to the wall 12 than the "front end portion."

The bench 60 comprises an elongated structure that has a length, a width, a longitudinal axis, a first side and a second side opposite of the first side. The length of the bench 60 is greater than the width of the bench 60 as best illustrated in FIGS. 1-7 and others.

The bench 60 is pivotally connected to the mounting bracket 20 at or near the rear end portion of the bench 60 as illustrated in FIGS. 1 through 4A of the drawings. The bench 60 is preferably pivotally connected to the mounting bracket 20 about a horizontal axis to move in an up-to-down manner and vice-versa as illustrated in FIGS. 1-2 among others. However, the bench 60 may be pivotally connected to the mounting bracket 20 in other manners including, but not limited to, about a vertical axis wherein the bench 60 would move in a side-to-side manner instead of an up-to-down manner.

Figure 1B:
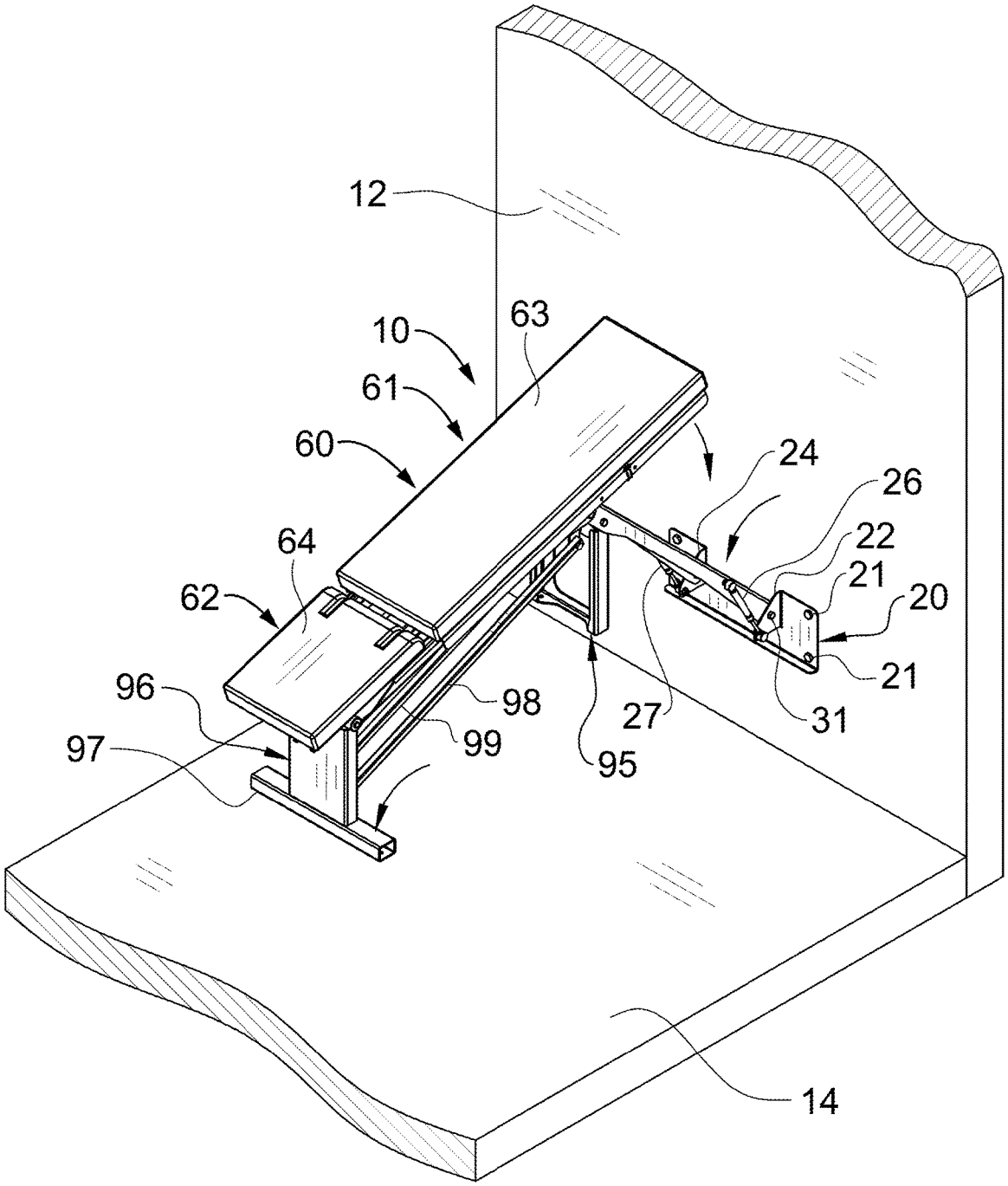
FIG. 1B is a perspective view of a retractable wall mountable inclinable bench in an intermediate state in accordance with an example embodiment.
Figure 1C:
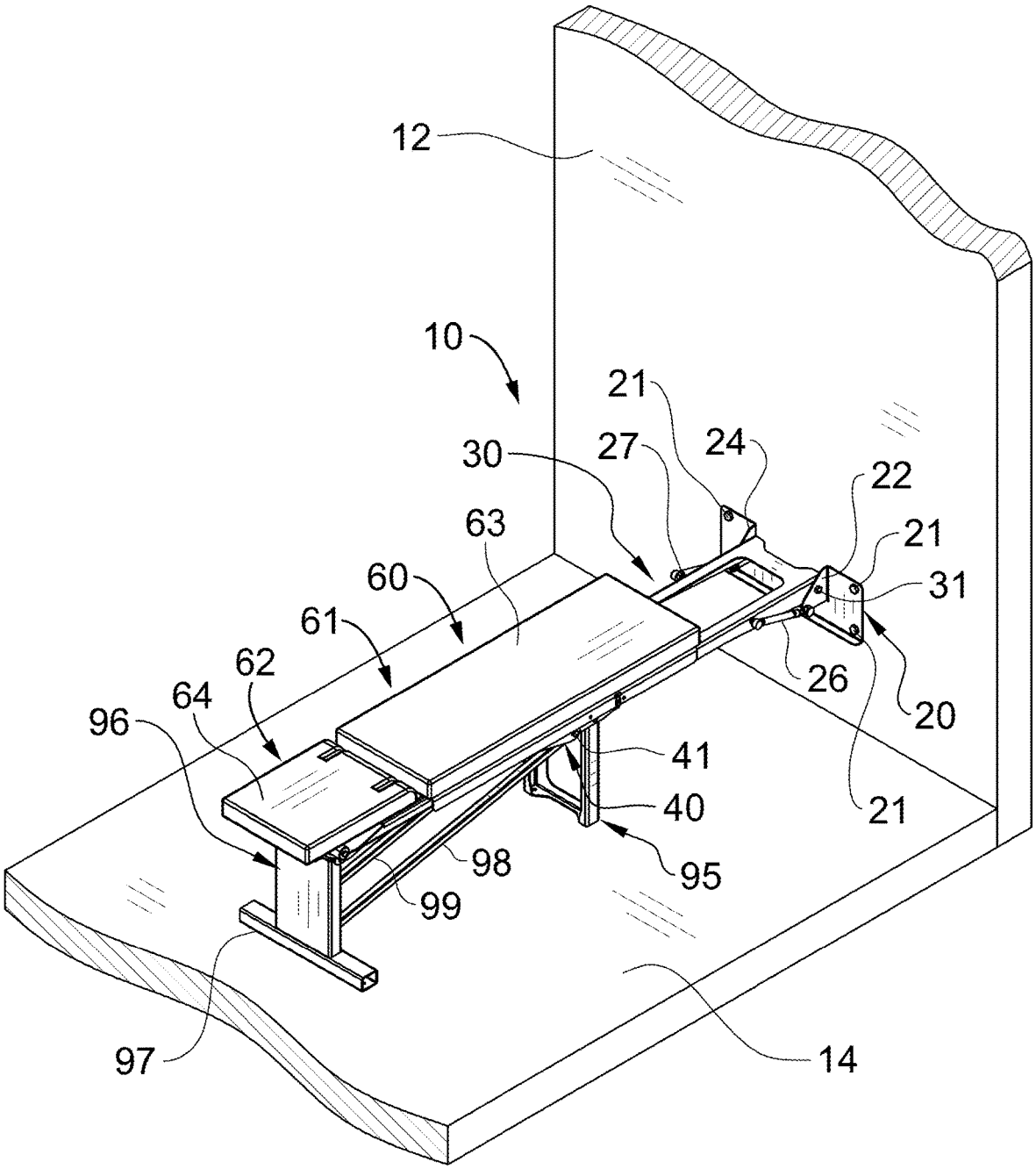
FIG. 1C is a perspective view of a retractable wall mountable inclinable bench in an extended state in a horizontal position in accordance with an example embodiment.
Figure 2A:
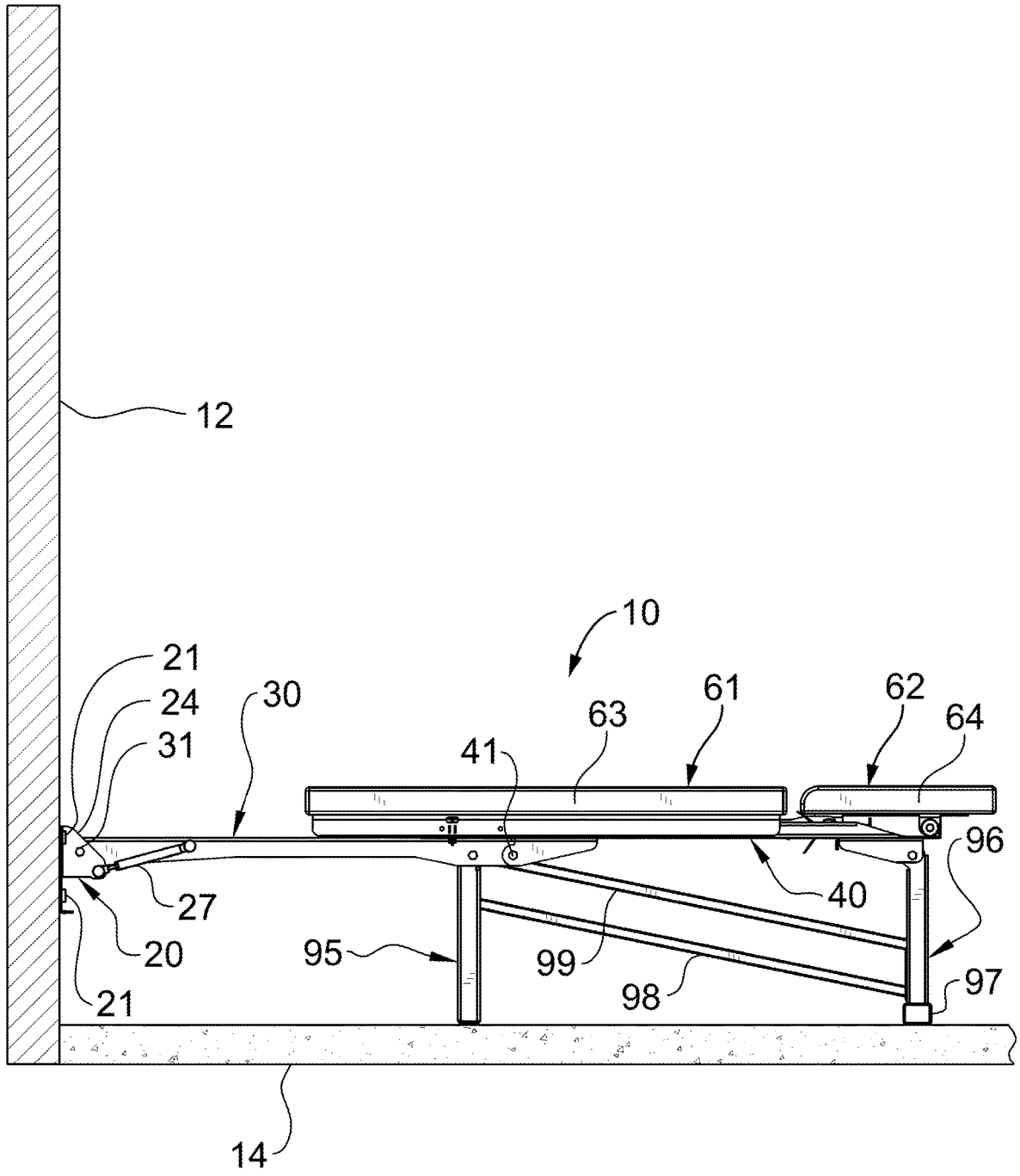
FIG. 2A is a side view of a retractable wall mountable inclinable bench attached to a wall in an extended state in a horizontal position in accordance with an example embodiment.
Figure 2B:
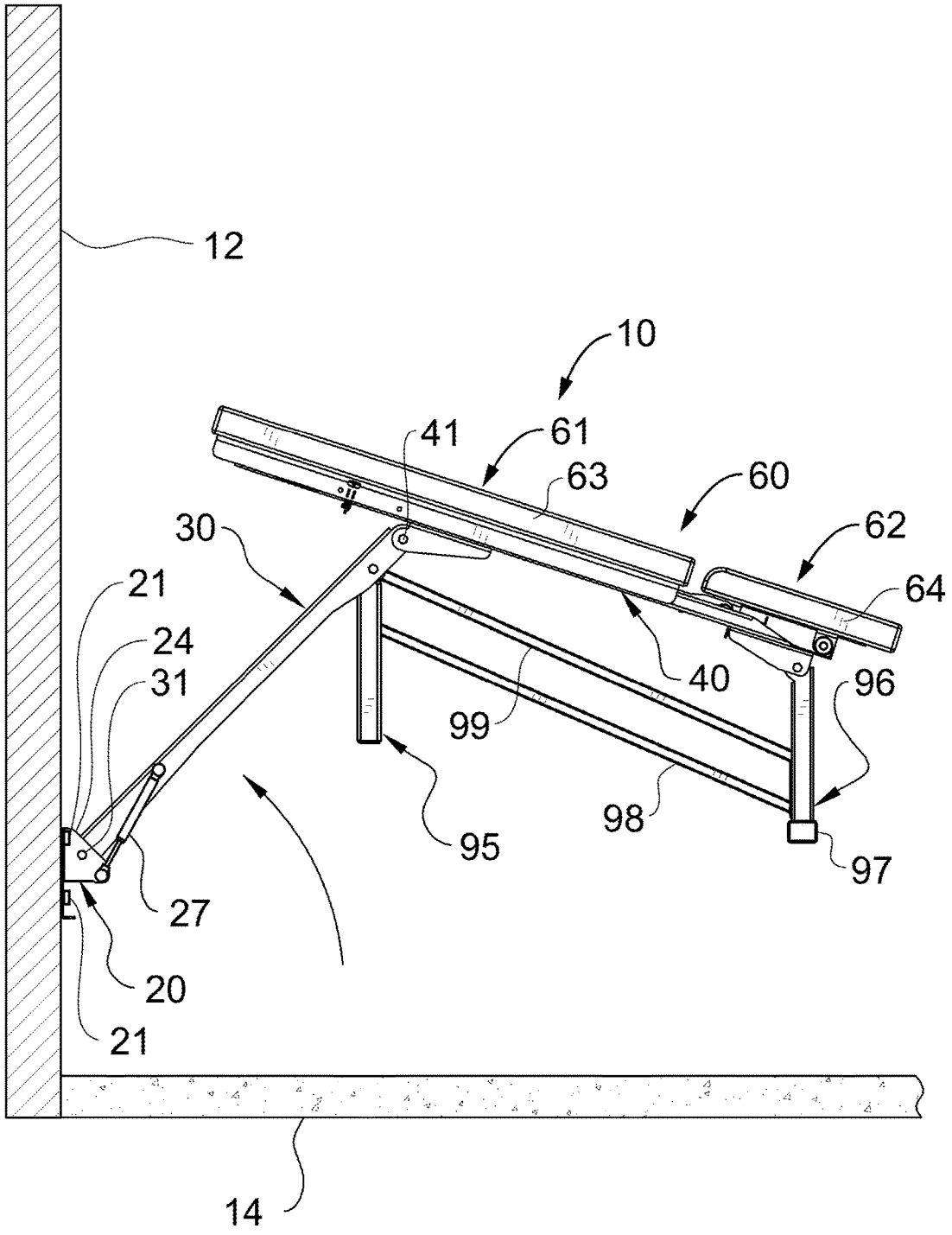
FIG. 2B is a side view of a retractable wall mountable inclinable bench in an intermediate state in accordance with an example embodiment.
Figure 2C:
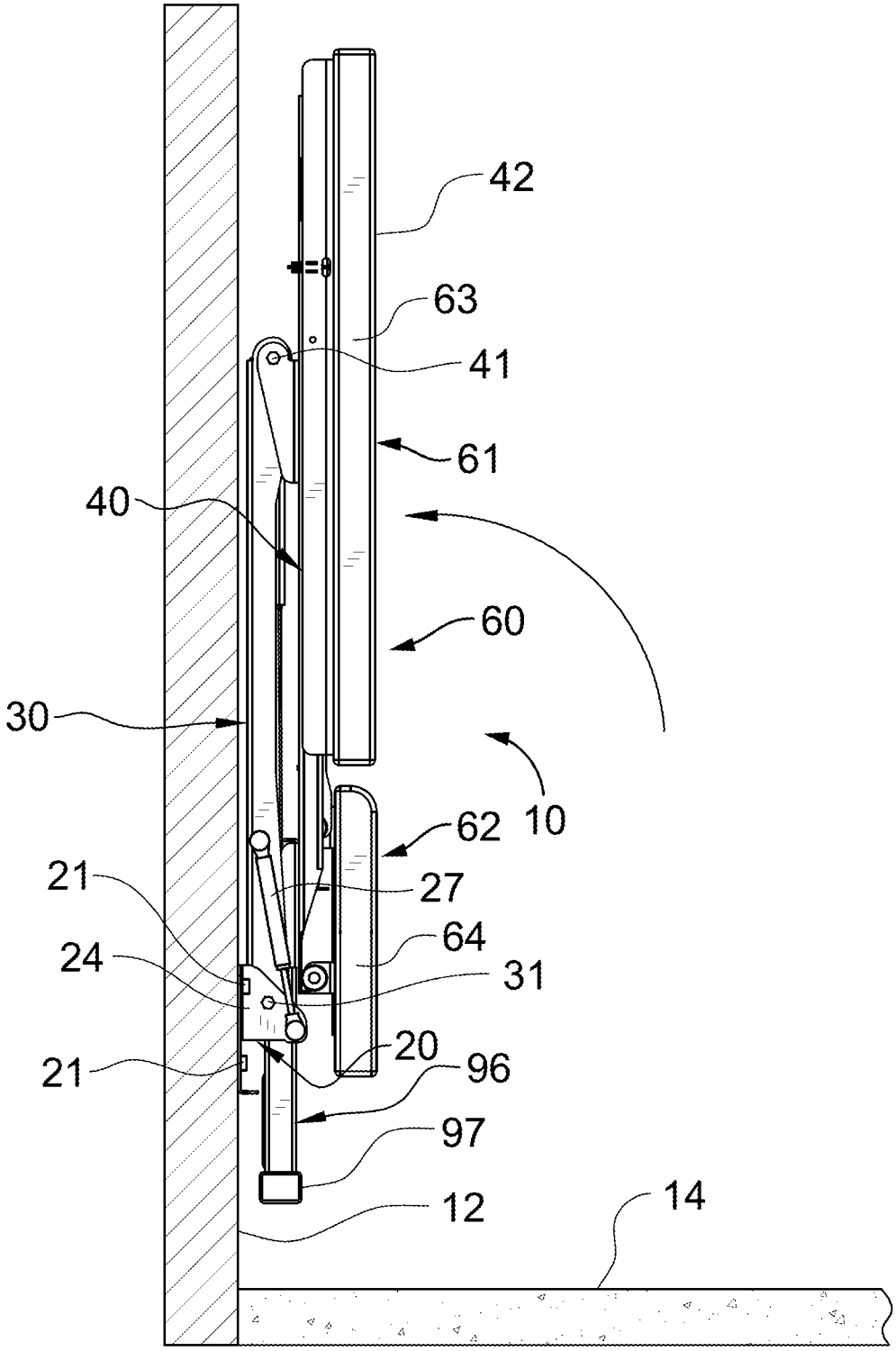
FIG. 2C is a side view of a retractable wall mountable inclinable bench in a retracted state in accordance with an example embodiment.
Figure 3:
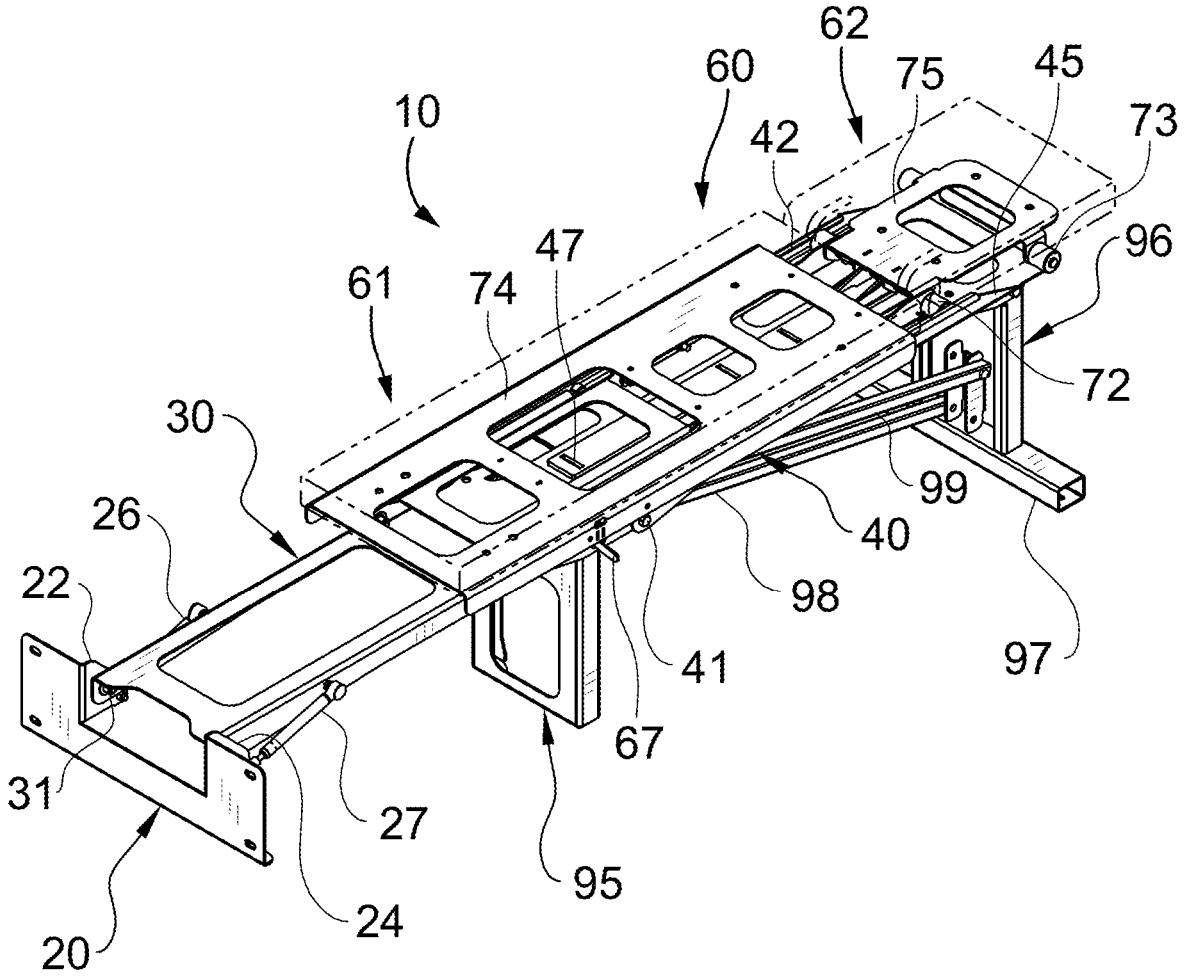
FIG. 3 is a rear perspective view of a retractable wall mountable inclinable bench in an extended state in a substantially horizontal position illustrated partially transparent to reveal various components in accordance with an example embodiment.
Figure 30A:
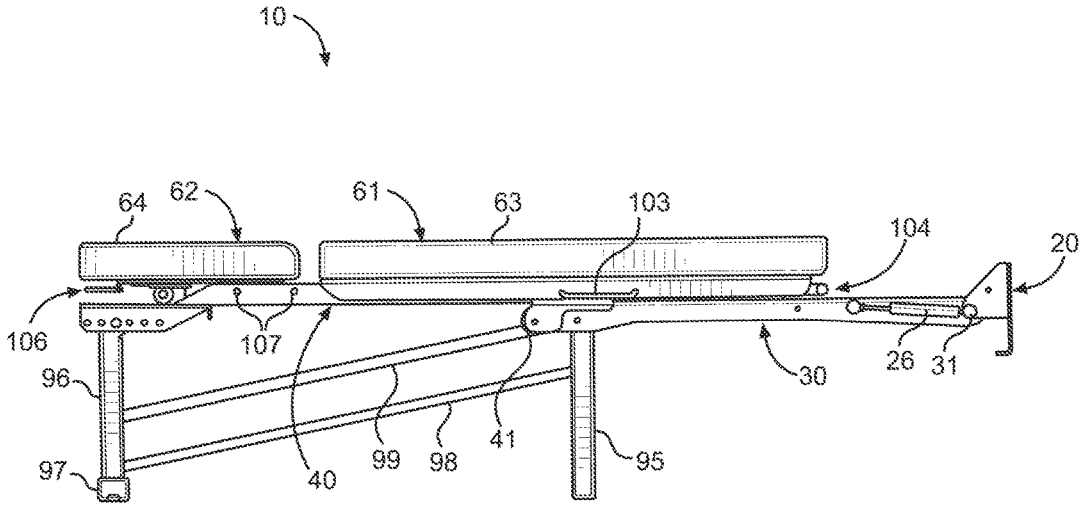
FIG. 30A is a side view of a retractable wall mountable inclinable bench in an extended state in a substantially horizontal position in accordance with an alternative example embodiment.

The bench 60 has an extended state as shown in FIGS. 1C, 2A, and 30A and a retracted state as shown in FIGS. 1A, 2C, and 29. The bench 60 is selectively movable between the extended state and the retracted state through an intermediate state as shown in FIGS. 1B and 2B.

When the bench 60 is in the extended state, the longitudinal axis of the bench 60 preferably extends in a direction that is away from or tangential to the wall 12 as shown in FIG. 1C for example. However, the bench 60 may extend in a direction that is otherwise angled and not tangential with respect to the wall 12 when in the extended state. The front end portion of the bench 60 is distally positioned away from the wall 12 when the bench 60 is in the extended state. The rear end portion of the bench 60 is also preferably distally positioned away from the wall 12 when the bench 60 is in the extended state, but the rear end portion of the bench 60 is closer to the wall 12 than the front end portion of the bench 60 when the bench 60 is in the extended state as shown in FIG. 2A for example. The distance from the wall 12 to the front end portion of the bench 60 is significantly less when the bench 60 is in the retracted state than when the bench 60 is in the extended state as shown in FIGS. 2A and 2C for example.

When the bench 60 is in the extended state, the first and second surfaces of the torso portion 61 and the seat portion 62 respectively comprise an upper surface of the bench 60 on which an exerciser can position the exerciser's torso, seat, and/or other body parts to perform various exercises. In the extended state, the bench 60 has a first position as shown in FIGS. 1C, 2A, and 30A and a plurality of selectable second positions as shown in FIGS. 10-11, 15-16, 27, and 30B-30C among others to accommodate a wide variety of different exercises.

In the first position, the bench 60 is substantially horizontal and the first and second surfaces of the torso portion 61 and the seat portion 62 respectively are preferably arranged to be substantially horizontal and co-planar or parallel as illustrated in FIGS. 1C and 30A. In the plurality of selectable second positions, the bench 60 is inclined upwardly from horizontal at a plurality of different angles with the first surface of the torso portion 61 inclined upwardly and facing the forward end portion and the second surface of the seat portion 62 inclined upwardly and facing the rear end portion.

In the retracted state, the bench 60 is in a compact arrangement with limited space usage for storage. In the retracted state, the bench 60 is positioned near, adjacent or touching the wall 12 and the longitudinal axis of the bench 60 preferably extends in a direction that is parallel to the wall 12, e.g., substantially vertical, as best illustrated in FIGS. 1A and 2C. In the retracted state, the first and second surfaces of the torso portion 61 and the seat portion 62 are preferably substantially parallel with the wall 12, co-planar or parallel with each other, and either face outwardly from the wall 12 as shown in FIG. 1A or inwardly toward the wall 12 (not shown) depending upon the configuration of the pivoting system for the bench 60. Though not required, the bench 60 is preferably positioned higher above the floor 14 when in the retracted state than when the bench 60 is in the extended state as shown in FIGS. 2A and 2C. Alternatively, the bench 60 may be substantially flat near or against the wall 12 in a horizontal alignment.

The bench 60 may be comprised of a single structure configuration that is pivotally attached to the mounting bracket 20 (not shown). Preferably, however, the bench 60 comprises a multi-structure configuration that is pivotally attached to the mounting bracket 20 and that includes the first (or wall-connecting) segment 30 and the second (or support) segment 40, which are described further below. FIGS. 1-2 and others illustrate a multi-structure configuration for the bench 60 that is foldable upon itself to provide a compact structure that is proximal to the wall 12 when in the retracted state and that unfolds to an extended structure that extends away from the wall 12 when in the extended state.

The bench 60 also preferably comprises an elongated multi-level track 42 which is described in further detail below. Generally, the track 42 supports and guides the bench 60 and more specifically the seat portion 62 of the bench 60 for movement longitudinally on the second segment 40 between the first substantially horizontal position of the bench 60 and the plurality of selected second inclined positions. The track 42 is configured to cause the seat portion 62 to automatically incline upwardly from horizontal and face toward the rear end portion of the bench 60 as the bench 60 moves from the first position to a selected second position.

The bench 60 further preferably comprises a latching system which is described in further detail below. One example embodiment of the latching system generally comprises a first latch 65 on the torso portion 61 of the bench 60, a corresponding first latch receiver 46 on the second segment 40, a second latch 66 on the seat portion 62 of the bench 60, a plurality of corresponding second latch receivers 47 on the second segment 40, and one or more latch operators 67 connected to the first and second latches 65, 66.

The first latch 65 is operable to latch the bench 60 to the second segment 40 at the first latch receiver 46 to retain the bench 60 in a position proximal and parallel to the second segment 40 as the bench 60 is moved between the extended state and the retracted state. The second latch 66 is operable to latch the bench 60 to the second segment 40 at the plurality of second latch receivers 47, each of which corresponds to a different second inclined position of the bench 60, to retain the bench 60 in a selected inclined position.

The one or more latch operators 67 are operable by an exerciser to operate the first and second latches 65, 66 together to unlatch the bench 60 from the second segment 40 at the corresponding first and second latch receivers 46, 47 to enable the bench 60 to be moved on the second segment 40 between the first substantially horizontal position and a selected second inclined position and between different selected second inclined positions.

1. First Segment.

The first (or wall-connecting) segment 30 comprises an elongated structure with a front end portion, a rear end portion opposite the front end portion, a length, a width, a longitudinal axis, a first side and a second side opposite of the first side as best illustrated in FIGS. 1B, 2A, and 4B. The first segment 30 may be comprised of a single unitary structure or of multiple inter-connected components and is preferably comprised of a strong, rigid, but relatively lightweight material such as certain metals for example.

The first segment 30 and the second (or support) segment 40 described below together comprise a frame for the bench 60. As shown in FIGS. 1-2, the first segment 30 is used to pivotally extend the bench 60 away from the wall 12 to place the bench 60 in the extended state to allow for the performance of exercises with dumbbells or bars without interference from the wall 12 or any surrounding retractable rack, and to retract the bench 60 toward the wall 12 for compact storage.

The first segment 30 is pivotally connected to the mounting bracket 20 about a first pivot point or hinge 31 at or near the rear end portion of the first segment 30. More specifically, as shown in FIGS. 1C, 4B, and others, the first and second sides of the first segment 30 are pivotally connected to the first side bracket 22 and the second side bracket 24 of the mounting bracket 20 respectively at or near the rear end portion of the first segment 30.

Figure 7:
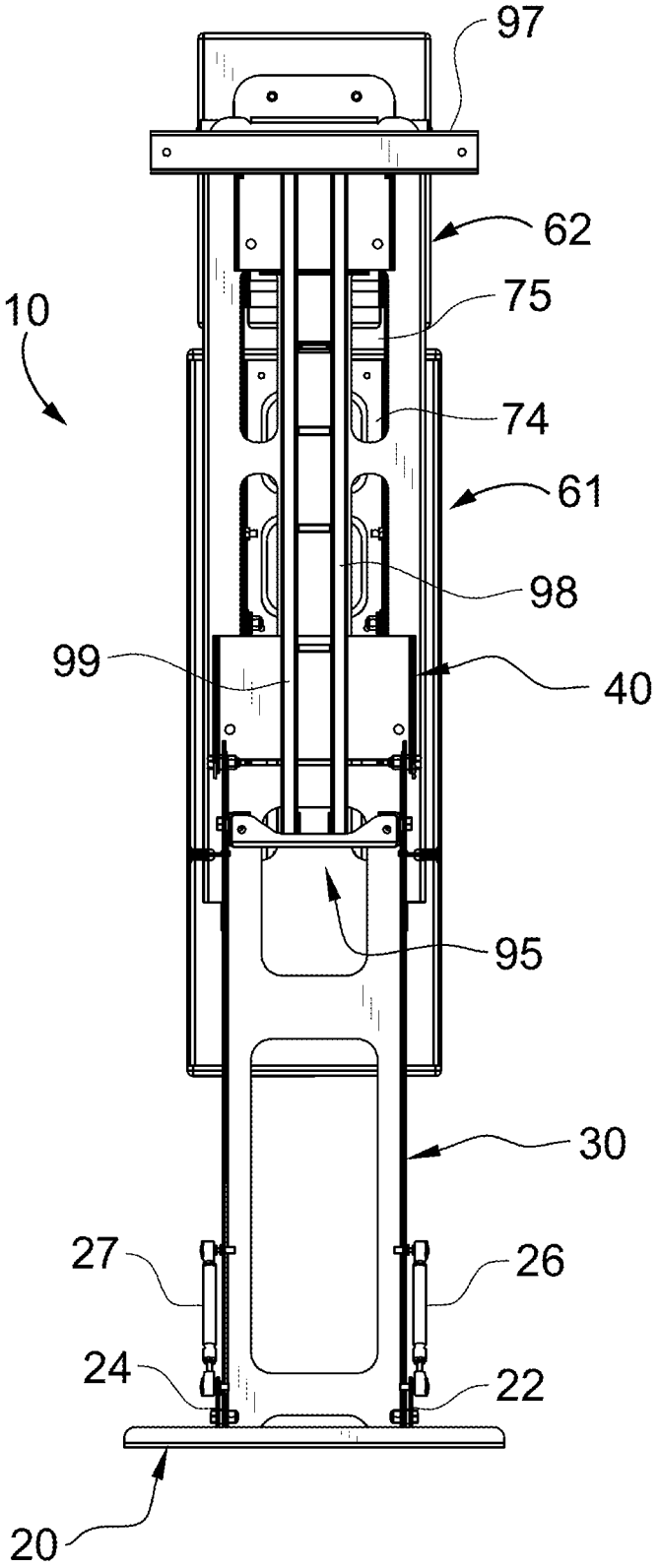
FIG. 7 is a bottom view of a retractable wall mountable inclinable bench in an extended state in a substantially horizontal position in accordance with an example embodiment.
Figure 8:
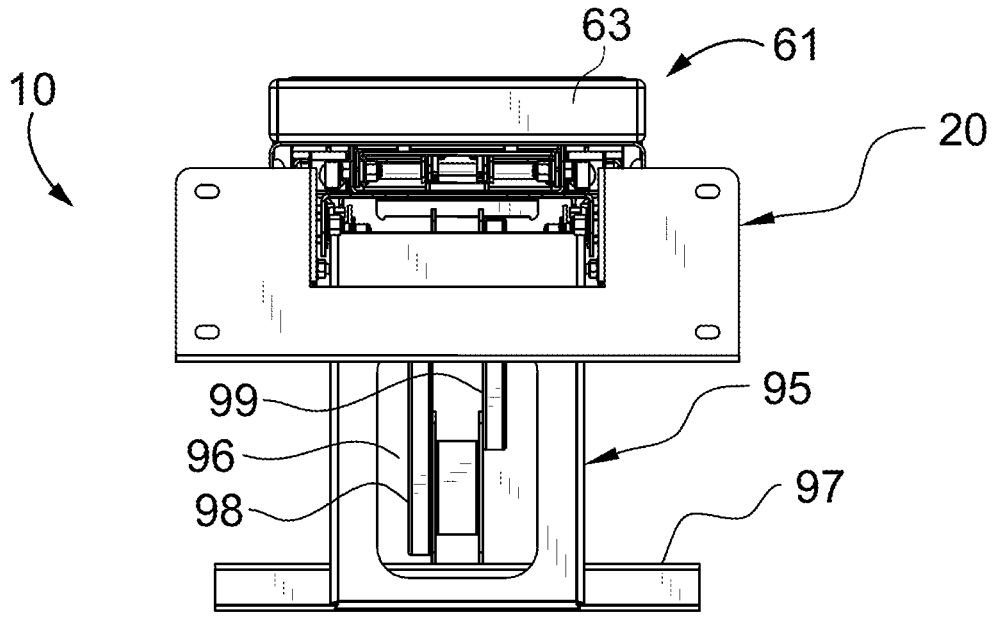
FIG. 8 is a rear view of a retractable wall mountable inclinable bench in an extended state in a substantially horizontal position in accordance with an example embodiment.
Figure 9:
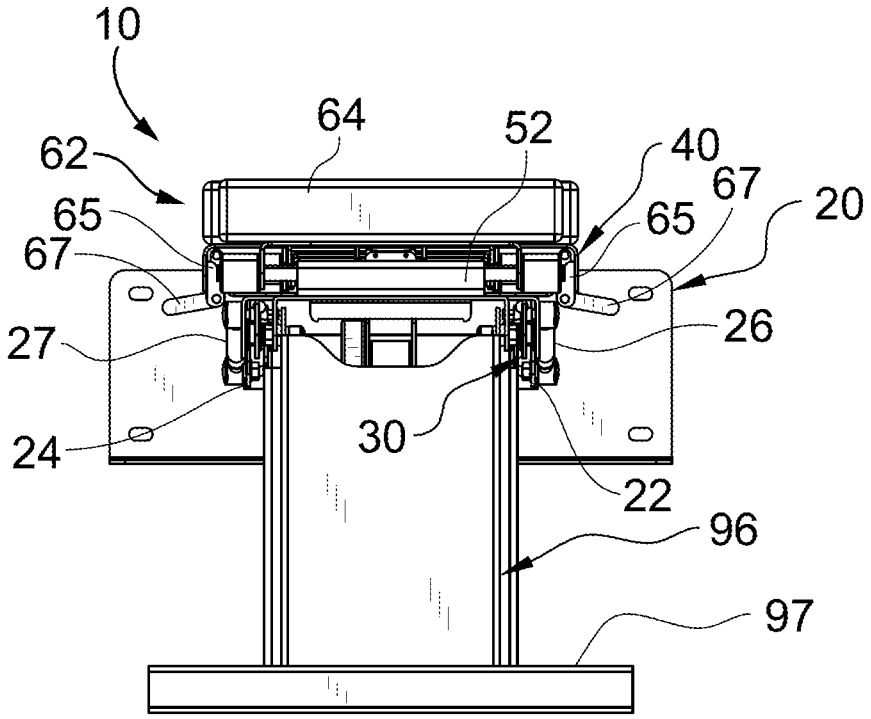
FIG. 9 is a front view of a retractable wall mountable inclinable bench in an extended state in a substantially horizontal position in accordance with an example embodiment.

The first segment 30 is pivotally connected to the rear end portion of the second segment 40 about a second pivot point or hinge 41 at or near the front end portion of the first segment 30. More specifically, as shown in FIGS. 4B, 7, and others, the first and second sides of the first segment 30 at or near the front end portion of the first segment 30 are pivotally connected to the first and second sides of the second segment 40 respectively at or near the rear end portion of the second segment 40.

It will be appreciated that the pivoting connections between the first segment 30 and the mounting bracket 20 and between the first segment 30 and the second segment 40 may be made by way of any suitable pivotable or rotatable connection. These may include for example one or more axles, hinges, pivot pins or the like.

The first segment 30 is preferably configured and arranged to be substantially parallel and co-planar with the second segment 40 when the bench 60 is in the extended state as well as when the bench 60 is in the retracted state as best illustrated in FIGS. 2A, 2C, 29, and 30A. When the bench 60 is in the extended state, the first segment 30 is preferably extended outwardly from the wall 12 in a substantially end-to-end arrangement with the second segment 40. When the bench 60 is in the retracted state, the first segment 30 is preferably folded with the second segment 40 in an overlapping manner to provide a flatter profile with respect to the wall 12 as shown in FIG. 2C. When the bench 60 is in the retracted state, the first and second surfaces of torso and seat portions 61, 62 of the bench 60 preferably extend less than 6 inches outwardly from the wall 12 to provide a compact storage profile.

2. Second Segment.

The second (or support) segment 40 comprises an elongated structure with a front end portion, a rear end portion opposite the front end portion, a length, a width, a longitudinal axis, a first side and a second side opposite of the first side as best illustrated in FIGS. 3-7, 12, 23 and others. The second segment 40 may be comprised of a single unitary structure or of multiple inter-connected components and is preferably comprised of a strong, rigid, but relatively lightweight material such as certain metals for example.

The second segment 40 provides movable support for the bench 60, including the torso portion 61 and the seat portion 62. As the frame for the bench 60, the second segment 40 and the first segment 40 together also support the weight of an exerciser on the torso portion 61 and the seat portion 62 when the bench 60 is in the extended state. The second segment 40 accordingly provides a first pivoting connection for a first support member 95 and a second pivoting connection for a second support member 96, which are described below.

The second segment 40 is pivotally connected to the front end portion of the first segment 30 about the second pivot point or hinge 41 at or near the rear end portion of the second segment 40. More specifically, as shown in FIGS. 4B, 7, and others, the first and second sides of the second segment 40 at or near the rear end portion of the second segment 40 are pivotally connected to the first and second sides of the first segment 30 respectively at or near the front end portion of the first segment 30. The pivotal connections between the second segment 40 and the first segment 30 may comprise any suitable pivotable or rotatable connections, including for example one or more axles, hinges, pivot pins or the like.

The second segment 40 is preferably configured and arranged to be substantially parallel and co-planar with the first segment 30 when the bench 60 is in the extended state as well as when the bench 60 is in the retracted state as best illustrated in FIGS. 2A, 2C, 29, and 30A. When the bench 60 is in the extended state, the second segment 40 is preferably extended outwardly from the wall 12 in a substantially end-to-end arrangement with the first segment 30. When the bench 60 is in the retracted state, the second segment 40 is preferably folded with the first segment 30 in an overlapping manner to provide a flatter profile with respect to the wall 12 as shown in FIG. 2C.

The second segment 40 has a substantially flat planar surface and an elongated track 42 that extends longitudinally along the surface between the front end portion and the rear end portion of the second segment 40 substantially parallel with the longitudinal axis of the second segment 40. In the example embodiment, the track 42 comprises a pair of opposing elongated track structures that extend upwardly from the surface of the second segment 40 and extend longitudinally along the opposite first and second sides of the second segment 40 as best illustrated in FIGS. 4B, 10-11, 15-16, 23-24, and 27. The opposing track structures are preferably substantially identical. The elongated track 42 supports the bench 60 and more specifically the seat portion 62 of the bench 60 for movement longitudinally along the second segment 40 to enable the bench 60 to be selectively moved between a first position that is substantially horizontal and parallel with the second segment 40 and a plurality of selectable second positions that are upwardly inclined at various angles in relation to the second segment 40.

The track 42 has a first level 43, a second level 44 that is elevated in relation to the first level 43, and an inclined ramp portion 45 that connects the first level 43 and the second level 44. Except for the ramp 45, the first level 43 and the second level 44 are substantially parallel with each other and with the surface of the second segment 40 as they extend longitudinally along the second segment 40. In the example embodiment, the first level 43 is substantially at the same level as the surface of the second segment 40 and the second level 44 is elevated vertically with respect thereto.

The first level 43 of the track 42 is adapted to engage, movably support, and guide one or more first corresponding movable elements 72 of the seat portion 62 of the bench 60, such as rollers, that are located at or near the rear end portion of the seat portion 62 as the bench 60 is moved between the first substantially horizontal position and the plurality of second inclined positions as described further below. The second level 44 of the track 42 is adapted to engage, movably support, and guide one or more second corresponding movable elements 73 of the seat portion 62 that are located at or near the front end portion of the seat portion 62 as the bench 60 is moved between the first position and the plurality of second inclined positions also as described further below.

The first level 43 of the track 42 preferably extends longitudinally toward the front end portion of the second segment 40 further than the second level 44. When the bench 60 is in the first substantially horizontal position in the extended state, the seat portion 62 is preferably located at or near the front end portion of the second segment 40 and the first and second movable elements 72, 73 of the seat portion 62 are all at the same level, i.e., the first level 43 of the track 42. As the bench 60 is moved longitudinally on the second segment 40 toward the rear end portion of the second segment 40 to place the bench 60 in a selected second inclined position, the first movable elements 72 engage and travel along the first level 43 of the track 42 and the rear end portion of the seat portion 62 remains at the same elevation in relation to the second segment 40. However, the second movable elements 73 engage and travel along the ramp 45 up to the elevated second level 44 of the track 42. This causes the front end portion of the seat portion 62 to automatically be elevated in relation to the second segment 40 and the rear end portion of the seat portion 62. It also causes the second surface of the seat portion 62 to automatically incline upwardly from horizontal at an angle with respect to the second segment 40 and to face the rear end portion of the second segment 40 and the front end portion and first surface of the torso portion 61. As the bench 60 is moved longitudinally on the second segment 40 between various selected inclined positions, the first and second movable elements 72, 73 move in parallel along the parallel first and second levels 43, 44 of the track 42 and the second surface of the seat portion 62 thus maintains the same inclined angle and direction with respect to the second segment 40 and the torso portion 61.

When the bench 60 is moved longitudinally toward the front end portion of the second segment 40 to return the bench 60 to the first substantially horizontal position, the operation described above is reversed. The front end portion of the seat portion 62 automatically returns to the same level as the rear end portion and the second surface of the seat portion 62 automatically returns to the substantially horizontal and parallel arrangement with respect to the second segment 40 and the co-planar arrangement with the first surface of the torso portion 61.

It will be appreciated that one, two or more combined, connected, or separate track structures may be used to accomplish the functionality described above. It will also be appreciated that one or more track structures may be used to provide two or more levels to provide multiple incline angles for the seat portion 62. It will further be appreciated that multiple levels may be provided by a single integrated track structure having multiple levels, by multiple interconnected track structures arranged to have different levels, or by separate track structures having different levels from each other.

As described briefly above, according to one example embodiment the second segment 40 also includes a first latch receiver 46 and a plurality of second latch receivers 47 that comprise a part of the latching system of the bench 60. The first latch receiver 46 corresponds to the first latch 65 on the torso portion 61 of the bench 60 and the plurality of second latch receivers 47 correspond to the second latch 66 on the seat portion 62 of the bench 60.

It will be appreciated that the first latch receiver 46 may comprise one or a plurality of individual latch receivers corresponding to one or a plurality of individual latches comprising the first latch 65. In the example embodiments, the first latch receiver 46 comprises two latch receivers that are located on the opposite first and second sides of the second segment 40 directly opposite each other as best illustrated in FIGS. 4B, 14, 19, 23, and 25. More specifically, the two latch receivers are formed in the opposing upwardly extending track structures that comprise the track 42 and that extend longitudinally along the opposite first and second sides of the second segment 40.

As best seen in FIGS. 20-21, each latch receiver comprises an opening 48 that is adapted to receive an extension 69 of the corresponding latch on the torso portion 61 of the bench 60 when the bench 60 is proximal and parallel to the second segment 40, e.g., when the bench 60 is in a first substantially horizontal position in the extended state or in a substantially vertical position in the retracted state. Each latch receiver also comprises an engagement surface 49 that is adapted to engage a corresponding engagement surface 70 of the corresponding latch to latch the bench 60 to the second segment 40, maintain the bench 60 in a position proximal and parallel to the second segment 40, and prevent the bench 60 from moving upwardly and/or outwardly away from the second segment 40 as the bench 60 is moved between the extended and retracted states.

It will be appreciated that while in this example embodiment the first latch receiver 46 comprises two individual latch receivers positioned directly opposite each other on the opposite sides of the second segment 40, the first latch receiver 46 may comprise one or any other number of latch receivers and the latch receivers may be positioned in any desired locations on the second segment 40 depending on the number and positions of corresponding latches comprising the first latch 65 on the bench 60.

As described briefly above and as best illustrated in FIGS. 4B, 6, 12, and 22-25, the plurality of second latch receivers 47 are positioned at spaced apart locations on the second segment 40 and more specifically at spaced apart locations along the longitudinal axis of the second segment 40. The longitudinal position of each second latch receiver 47 on the second segment 40 corresponds to a different selectable second inclined position of the bench 42 on the second segment 40. It will be appreciated that the second latch receivers 47 may be formed in or through the surface of the second segment 40 or in or through a plate or other structure on the second segment 40 so long as the plate or other structure does not interfere with movement of the bench 60 on the second segment 40.

Also as best illustrated in FIGS. 4B, 6, 12, and 22-25, in this example embodiment each second latch receiver 47 comprises an opening 50 in the shape of an elongated slot that is oriented substantially transversely to the longitudinal axis of the second segment 40. Each opening 50 is adapted to receive an extension 77 of the corresponding second latch 66 on the seat portion 62 of the bench 60 when the bench 60 is in the extended state and positioned at a selected second inclined position on the second segment 40. Each second latch receiver 47 also comprises one or more engagement surfaces 51 that are adapted to engage corresponding engagement surfaces 78 of the extension 77 of the corresponding second latch 66 to latch the bench 60 and more specifically the seat portion 62 of the bench 60 to the second segment 40 to maintain the bench 60 in the selected inclined position, and to prevent the bench 60 and more specifically the seat portion 62 from moving longitudinally with respect to the second segment 40 and the bench 60 from moving out of the selected inclined position.

It will be appreciated that while this example embodiment includes several spaced-apart second latch receivers 47 corresponding to several different selectable inclined positions of the bench 60, any number of second latch receivers 47 can be provided and the second latch receivers 47 can be positioned as desired on the second segment 40. It will also be appreciated that while the second latch receivers 47 in this example embodiment are shaped as elongated slots and are located along the longitudinal axis of the second segment 40, the second latch receivers 47 may have any other shapes and be positioned at any other locations on the second segment 40 depending on the shape and location of the corresponding second latch 66 on the seat portion 62 of the bench 60 and consistent with performing the functions described herein.

In one example embodiment the second segment 40 also includes a seat portion retainer 52 that is adapted to retain the seat portion 62 of bench 60 in a position proximal to and substantially parallel with the second segment 40 and with the second surface of the seat portion 62 substantially co-planar or parallel with the first surface of the torso portion 61. Accordingly, when the bench 60 is in a position proximal to and parallel with the second segment 40, e.g., when the torso portion 61 of the bench 60 is latched to the second member 40 by the first latch 65, the retainer 52 is adapted to prevent the seat portion 62 from moving away from the second segment 40 as the bench 60 is moved between the extended state and the retracted state.

Figure 10:
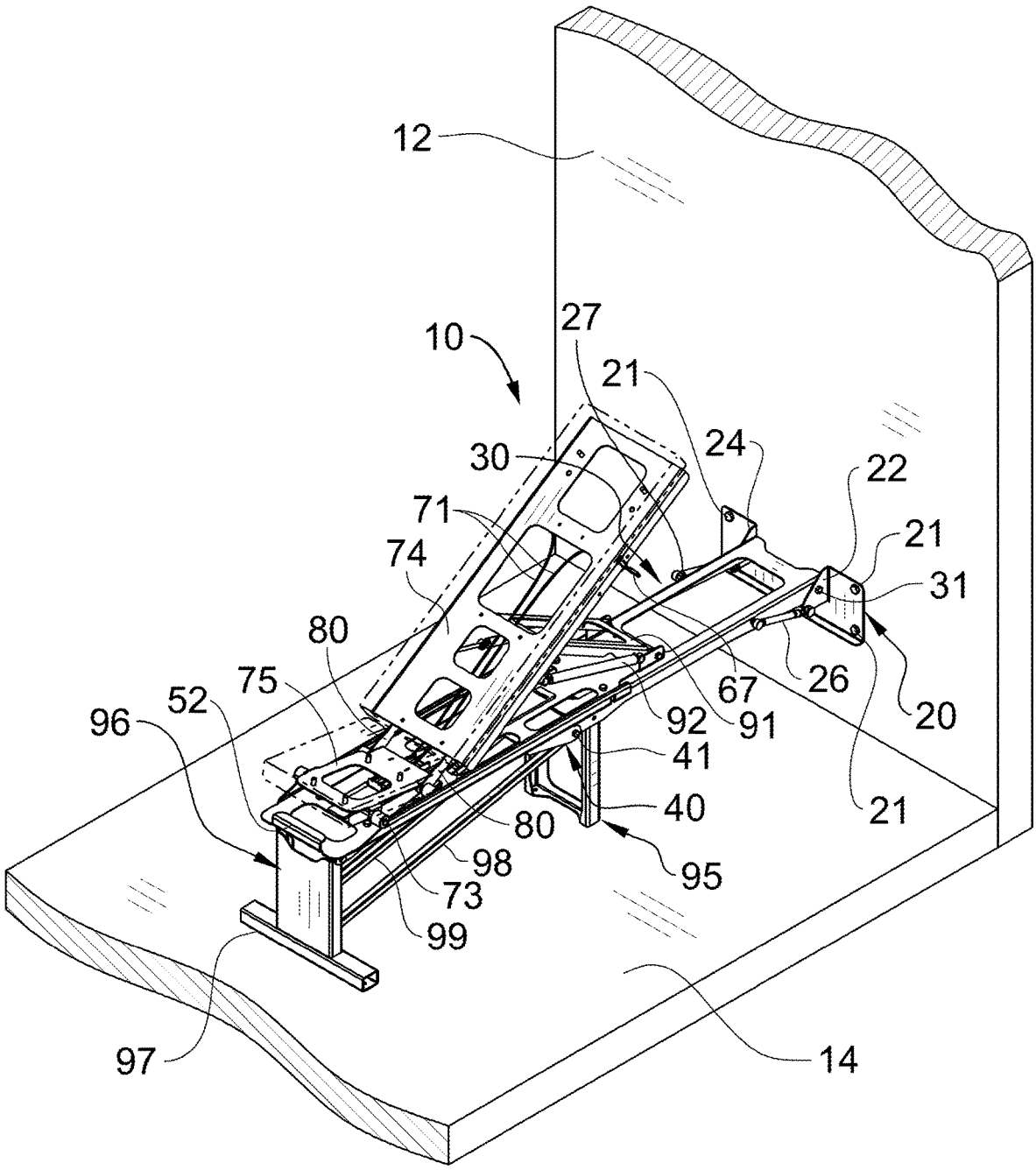
FIG. 10 is a front perspective view of a retractable wall mountable inclinable bench attached to a wall in an extended state in a selected inclined position illustrated partially transparent to reveal various components in accordance with an example embodiment.
Figure 11:
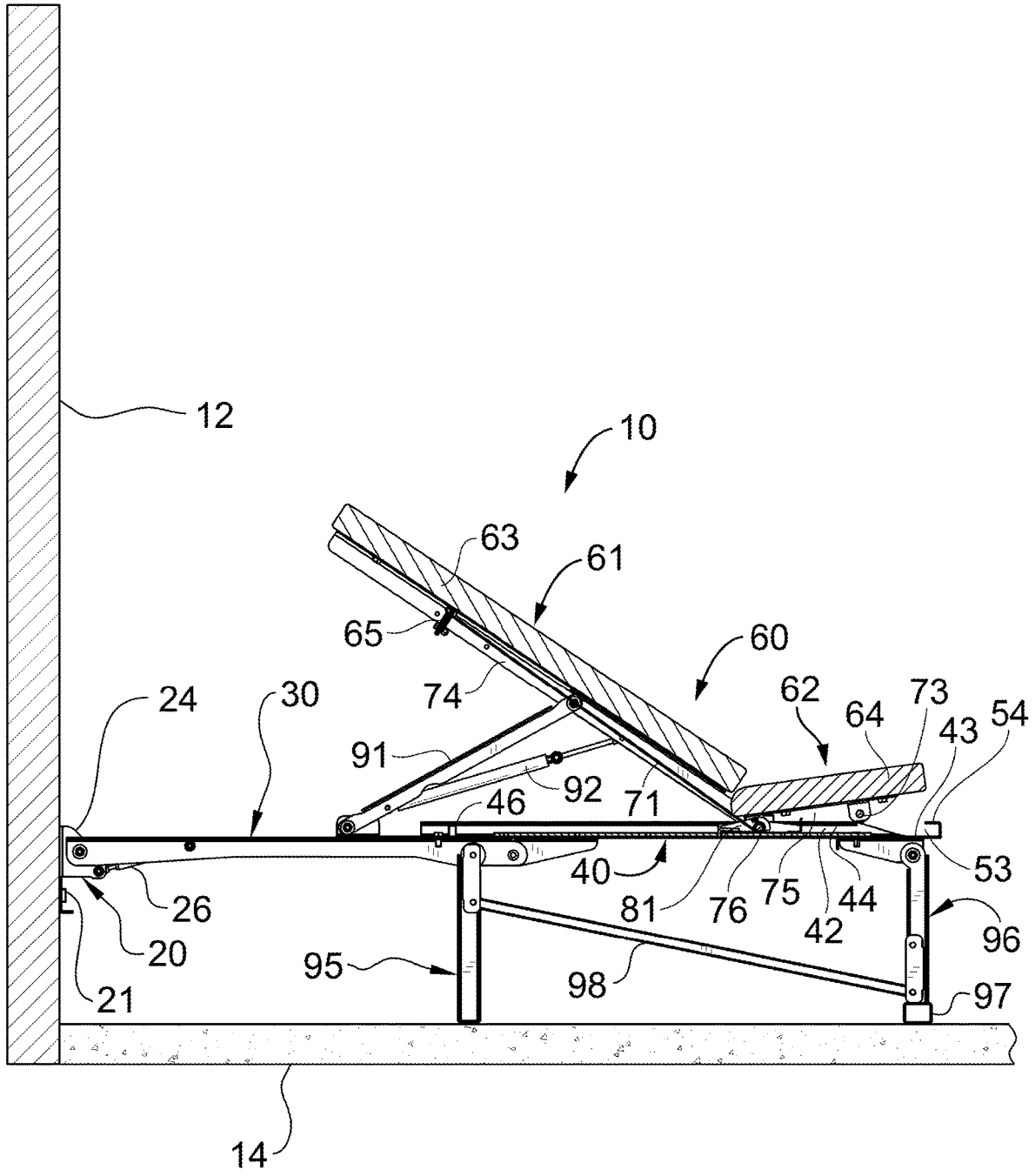
FIG. 11 is a side view of a retractable wall mountable inclinable bench attached to a wall in an extended state in a selected inclined position in accordance with an example embodiment.
Figure 12:
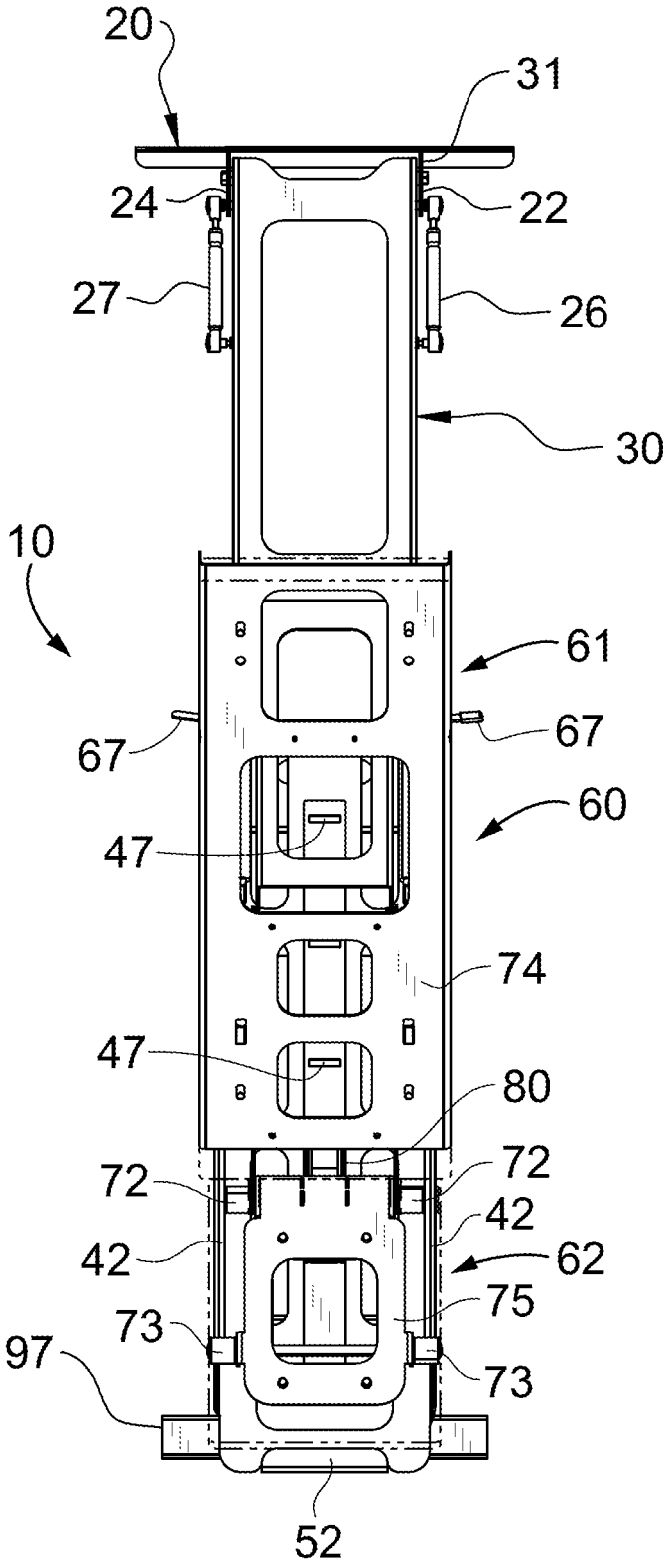
FIG. 12 is a top view of a retractable wall mountable inclinable bench in an extended state in a selected inclined position illustrated partially transparent to reveal various components in accordance with an example embodiment.
Figure 13:
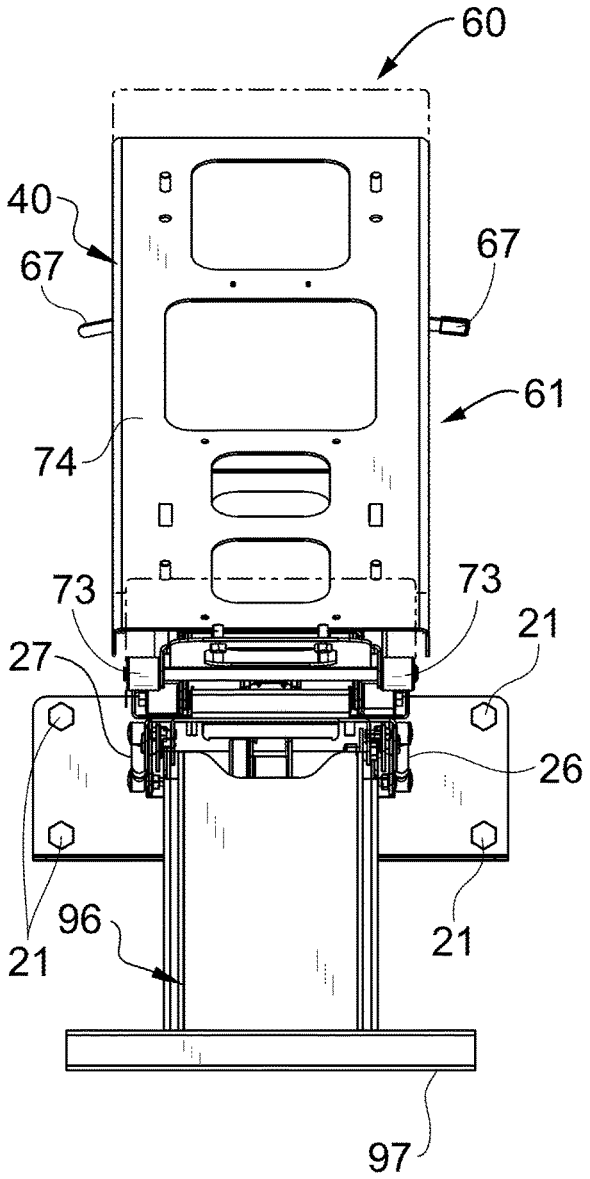
FIG. 13 is a front end view of a retractable wall mountable inclinable bench in an extended state in a selected inclined position illustrated partially transparent to reveal various components in accordance with an example embodiment.
Figure 14:
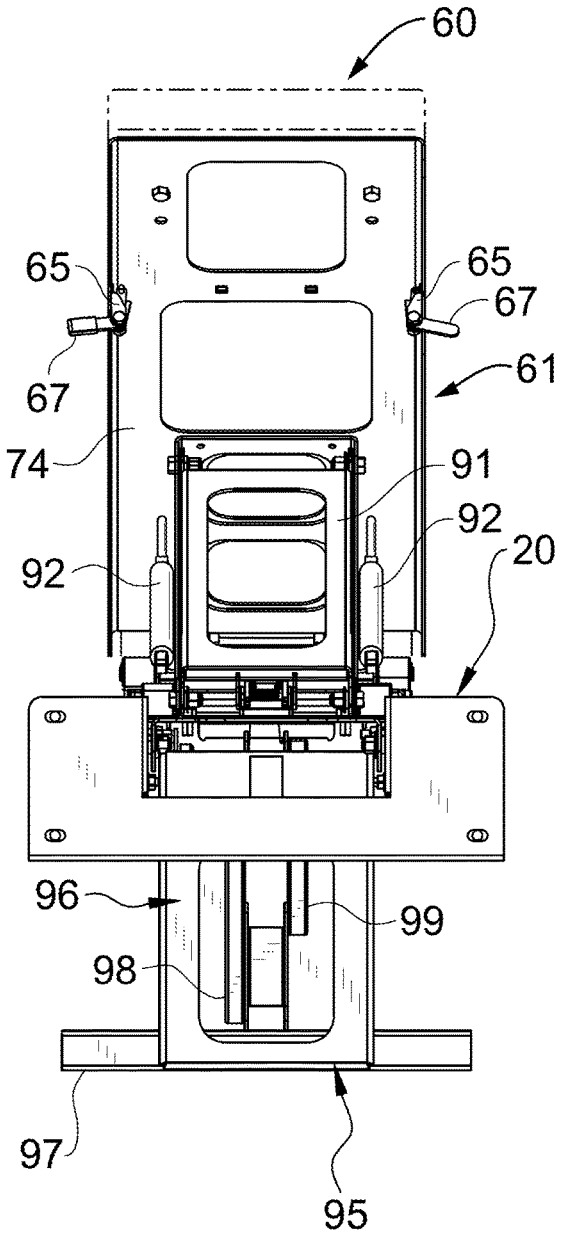
FIG. 14 is a rear end view is a rear end view of a retractable wall mountable inclinable bench in an extended state in a selected inclined position illustrated partially transparent to reveal various components in accordance with an example embodiment.
Figure 15:
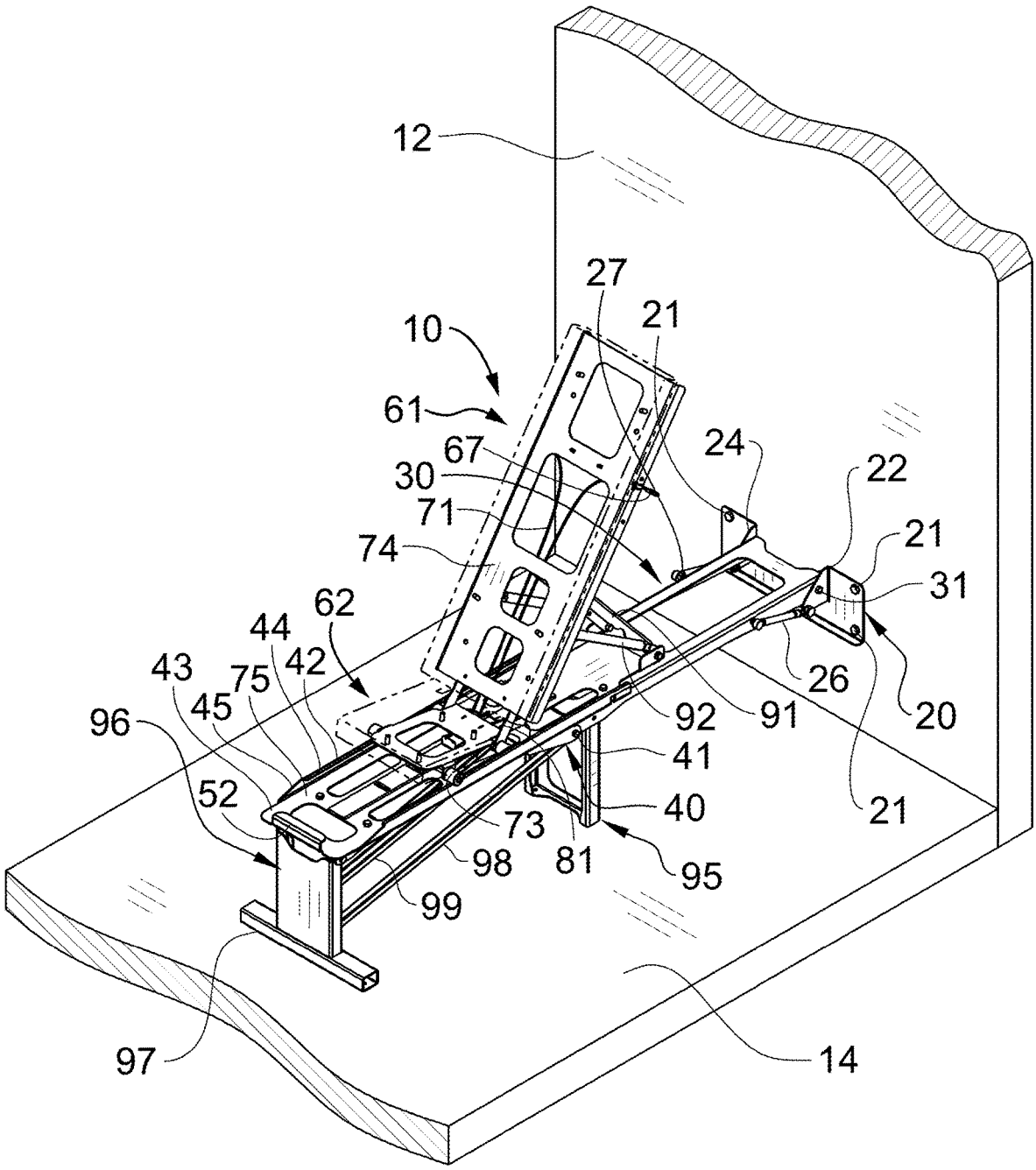
FIG. 15 is a front perspective view of a retractable wall mountable inclinable bench attached to a wall in an extended state in another selected inclined position illustrated partially transparent to reveal various components in accordance with an example embodiment.
Figure 16:
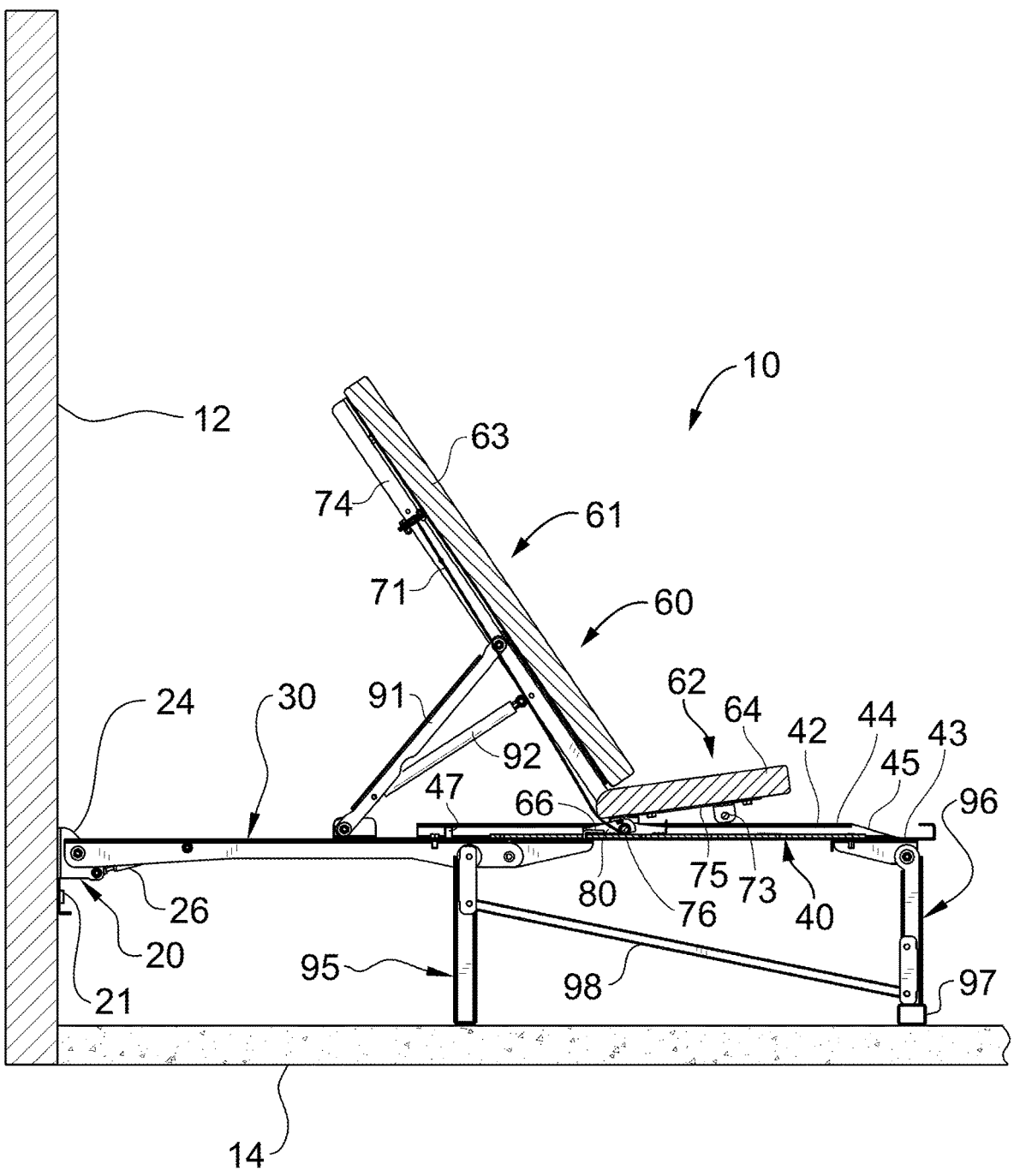
FIG. 16 is a side view of a retractable wall mountable inclinable bench attached to a wall in an extended state in another selected inclined position in accordance with an example embodiment.
Figure 17:
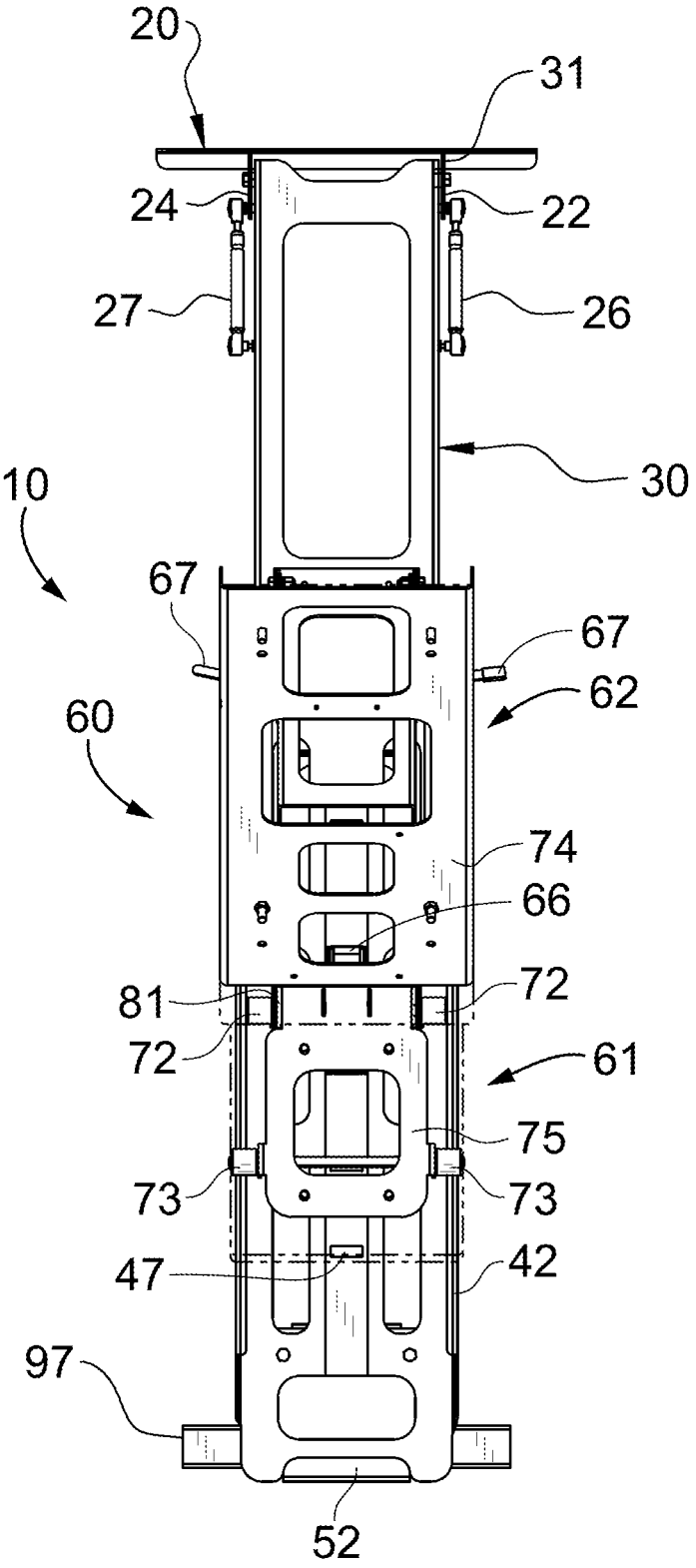
FIG. 17 is a top view of a retractable wall mountable inclinable bench in an extended state in another selected inclined position illustrated partially transparent to reveal various components in accordance with an example embodiment.
Figure 18:
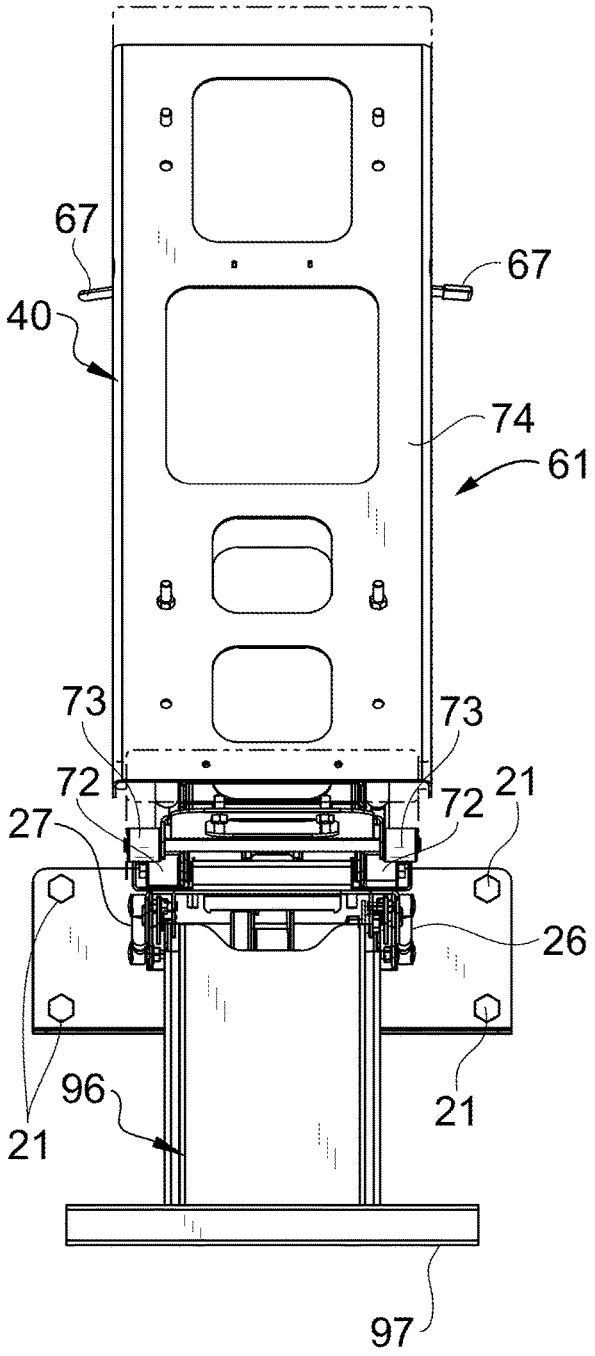
FIG. 18 is a front end view of a retractable wall mountable inclinable bench in an extended state in another selected inclined position illustrated partially transparent to reveal various components in accordance with an example embodiment.
Figure 19:
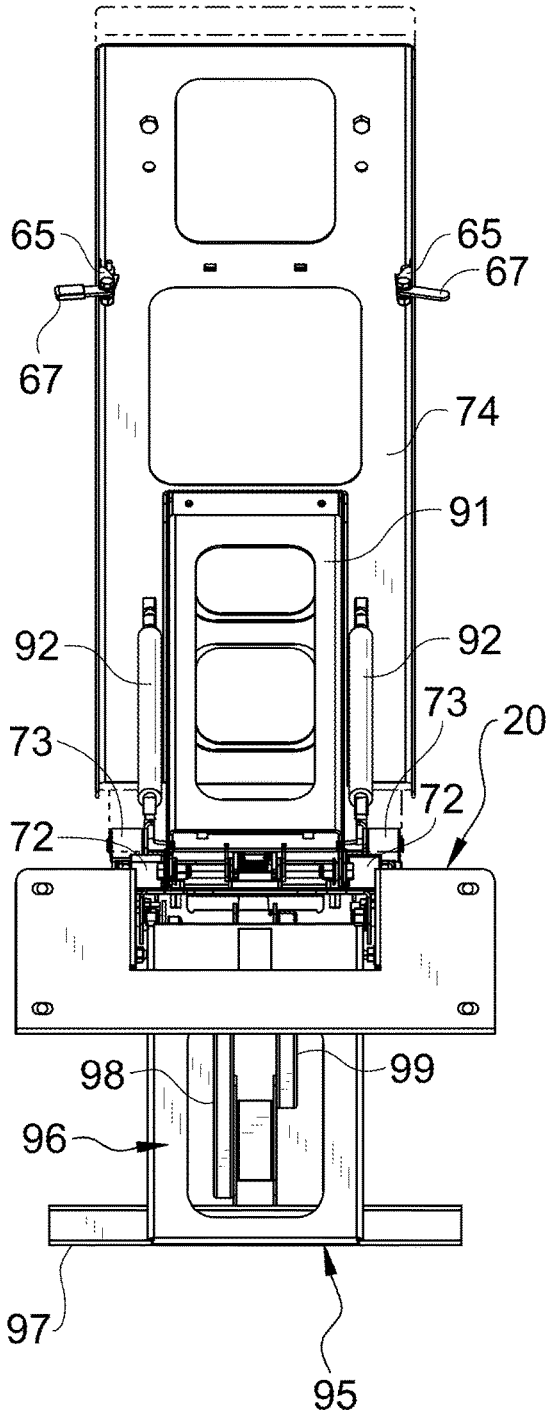
FIG. 19 is a rear end view of a retractable wall mountable inclinable bench in an extended state in another selected inclined position in accordance with an example embodiment.

In this example embodiment and as illustrated in FIGS. 4B, 10-11, and others, the retainer 52 may comprise a hook or similar structure with an opening 53 that is adapted to receive an element of the seat portion 62 when the bench 60 is in a position proximal and substantially parallel with the second segment 40 and a surface 54 that is positioned and adapted to engage the element of the seat portion 62 and prevent the seat portion 62 from moving away from the second segment 40, e.g., in a direction outwardly angled from the longitudinal axis of the second segment 40.

The element of the seat portion 62 that may be received and engaged may be any suitable element. In the example embodiment, the element comprises a second axle that comprises part of the second movable elements 73 of the seat portion 62 that are described further below. The axle extends transversely to the longitudinal axes of the second segment 40 and the seat portion 62 between the movable elements 73, e.g., rollers, that are located at or near the opposite first and second sides of the seat portion 62 near the front end portion of the seat portion 62. When the bench 60 is in a position proximal to and parallel with the second segment 40, the axle is received in the opening 53 of the retainer 52. If the seat portion 62 begins to move outwardly away from the second segment 40, the engagement surface 54 of the retainer 52 engages the axle and prevents the seat portion 62 from moving away from the second member 40.

3. Torso Portion.

The torso portion 61 of the bench 60 is movably supported on the second segment 40. The torso portion 61 has a first surface that is adapted to support a torso of an exerciser when the bench 60 is in the extended state. The first surface may comprise a surface of a cushion 63 as shown in FIGS. 1-2 and others for example or a non-cushioned surface of another type of support platform to support a body part of an exerciser. The first surface is preferably substantially flat and planar with a size and shape sufficient to properly support the torso or other body part of an exerciser during the performance of an exercise with or without a barbell or dumbbells (e.g., flat bench press, incline bench press, decline bench press, dips, inclined dumbbell flies, declined dumbbell flies).

The torso portion 61 preferably has an elongated shape with a length, a width, a longitudinal axis, a first side and a second side opposite of the first side. The length of the torso portion 61 is preferably greater than the width as best illustrated in FIGS. 1-7, 10-19, and others. Preferably, the torso portion 61 is arranged to be longitudinally co-axial with or longitudinally parallel with the second segment 40. The torso portion 61 also has a front end portion and a rear end portion opposite of the front end portion.

When the bench 60 is in the extended state, the first surface of the torso portion 61 comprises a portion of the upper surface of the bench 60 that an exerciser can position the torso (or another part) of the exerciser's body upon to perform an exercise, as illustrated in FIG. 1C for example. As described above, in the extended state the bench 60 can be selectively placed in a first substantially horizontal position and in a plurality of selectable second inclined positions. With the bench 60 in the first position, the first surface of the torso portion 43 is substantially horizontal and parallel with the second segment 40 and is substantially co-planar or parallel with the second surface of the seat portion 62 of the bench 60. When the bench 60 is in any of the selectable second inclined positions, the first surface of the torso portion 61 is inclined upwardly at an angle with respect to the surface of the second segment 40 and faces the front end portion of the second segment 40 and the seat portion 62 of the bench 60.

When the bench 60 is in the retracted state, the first surface of the torso portion 61 is substantially parallel with the wall 12, e.g., vertical, and with the second segment 40, and is substantially co-planar or parallel with the second surface of the seat portion 44. The first surface may be either facing outwardly from the wall 12 as shown in FIG. 1A or inwardly toward the wall 12 (not shown) depending upon the configuration of the pivoting system for the bench 60.

As described above, according to one example embodiment the torso portion 61 includes a first latch 65 that comprises part of the latching system of the bench 60. The first latch 65 corresponds to the first latch receiver 46 on the second segment 40 of the bench 60 described above.

It will be appreciated that the first latch 65 may comprise one or a plurality of individual latches corresponding to one or a plurality of individual latch receivers comprising the first latch receiver 46. In the example embodiments, the first latch 65 comprises two individual latches that are located on the opposite first and second sides of the torso portion 61 directly opposite each other as best illustrated in FIGS. 3, 4A, 4B, 7, 14, 19, 23, and 25. The latches are positioned so that each latch is adjacent to and directly faces a corresponding latch receiver of the first latch receiver 46 on the second segment 40 when the bench 60 is proximal to and parallel with the second segment 40 as shown in FIGS. 1A, 1C, 2A, and 2C for example.

More specifically, in this example embodiment, the torso portion 61 comprises a backing or mounting plate 74 that is preferably substantially planar and that has opposite first and second sides that extend downwardly toward the second segment 40 and have interior facing and exterior facing surfaces. The two latches comprising the first latch 65 are attached or connected to the interior facing surfaces so as to directly face the corresponding latch receivers of the first latch receiver 46 on the first and second opposite sides of the second segment 40. As best illustrated in FIGS. 6-7, 12-13, 17-19, and 24-25, the width dimension between the downwardly extending first and second sides of the torso portion 61 is somewhat greater than the width dimension between the opposing track structures comprising the track 42 on the second segment 40 to accommodate the latches between the interior facing surfaces of the first and second sides of the torso portion 61 and the track structures in which the corresponding latch receivers are formed.

Figure 20A:
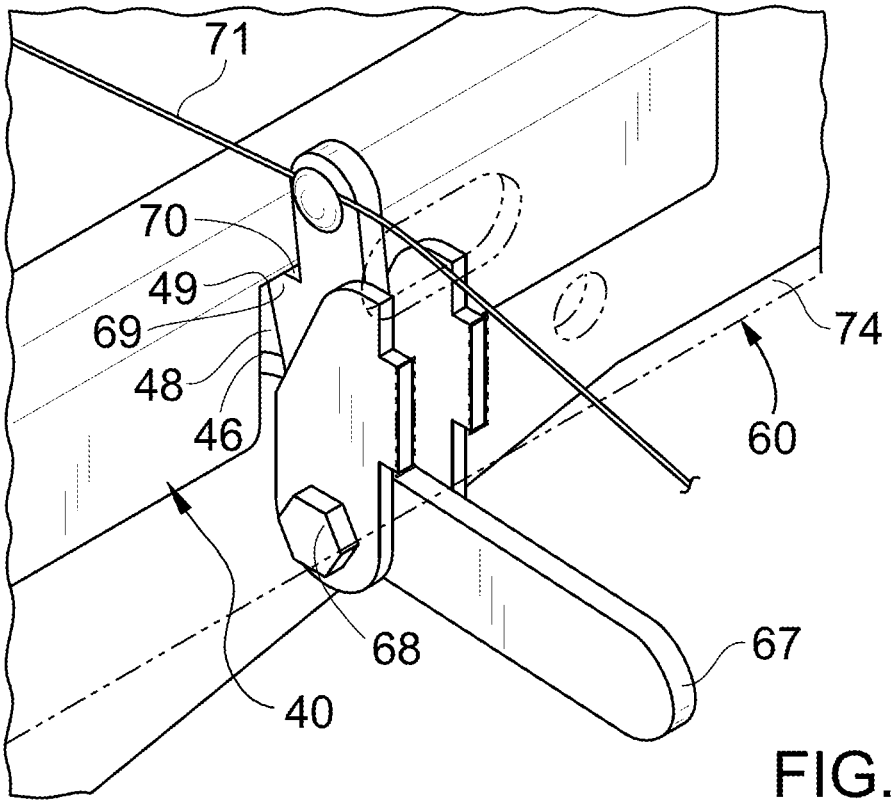
FIG. 20A is an enlarged partial perspective view of a retractable wall mountable inclinable bench showing a first latch and a latch operator with the first latch in a latched position with a segment of the bench in accordance with an example embodiment.
Figure 20B:
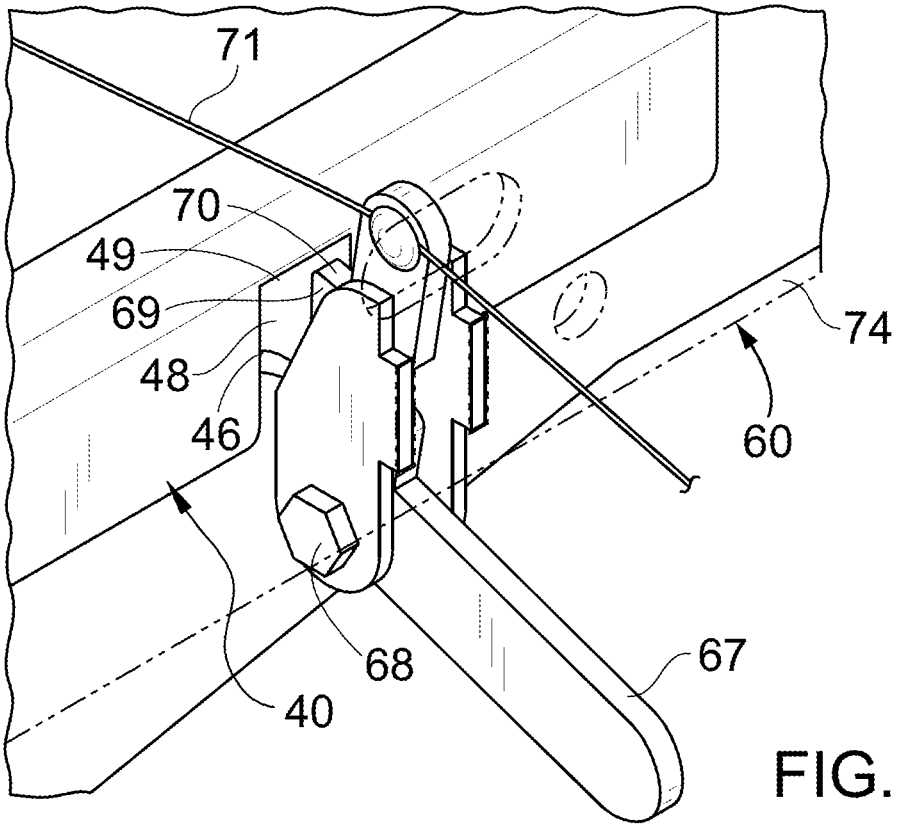
FIG. 20B is an enlarged partial perspective view of a retractable wall mountable inclinable bench showing a first latch and a latch operator with the first latch in an unlatched position with a segment of the bench in accordance with an example embodiment.
Figure 21A:
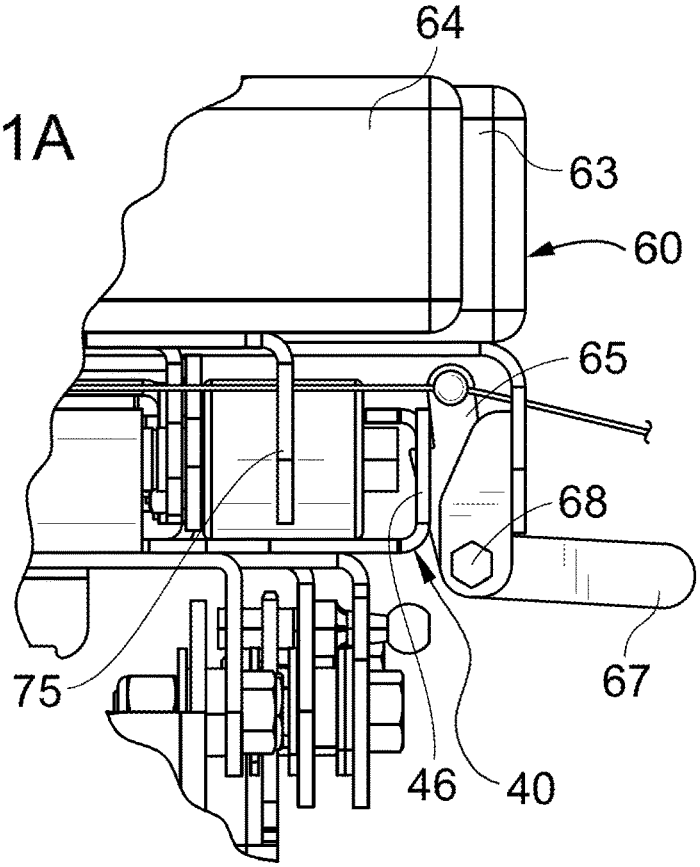
FIG. 21A is an enlarged partial cross-sectional front end view of a retractable wall mountable inclinable bench showing a first latch and a latch operator with the first latch in a latched position with a segment of the bench in accordance with an example embodiment.
Figure 21B:
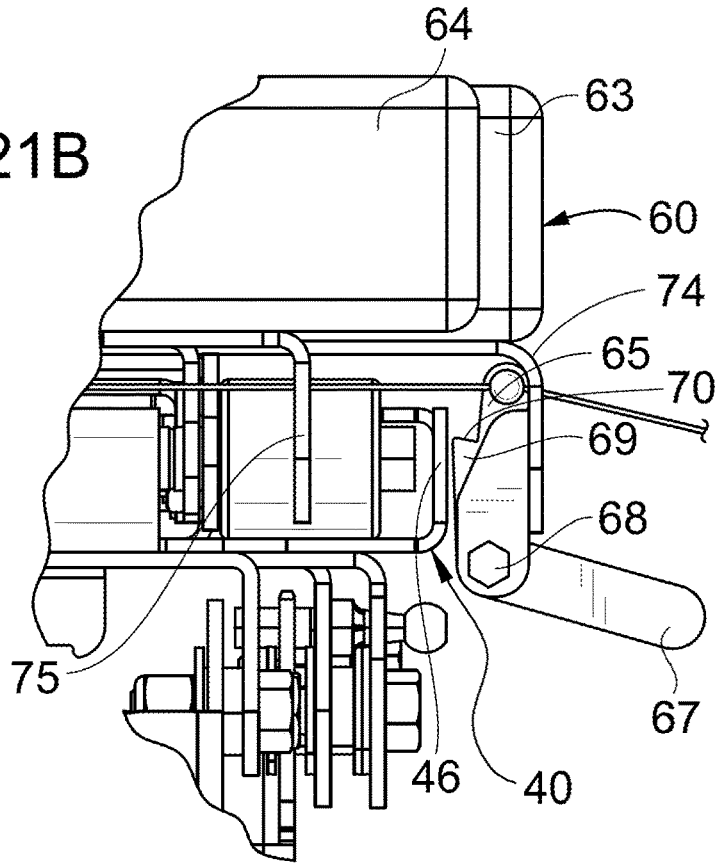
FIG. 21B is an enlarged partial cross-sectional front end view of a retractable wall mountable inclinable bench showing a first latch and a latch operator with the first latch in an unlatched position with a segment of the bench in accordance with an example embodiment.

As best seen in FIGS. 20-21, each latch comprising the first latch 65 is connected to the first or second side of the torso portion 43 by a pivoting connection 68 that enables the latch to pivot between a latched position (FIGS. 20A and 21A) and an unlatched position (FIGS. 20B and 21B). Each latch has an extension 69, such as a claw or pawl, with an engagement surface 70. When the latch pivots to the latched position, the extension 69 enters the opening 48 of the corresponding latch receiver on the second segment 40.

With the latch in the latched position, the engagement surface 70 of the extension 69 can engage with the corresponding engagement surface 49 of the corresponding latch receiver on the second segment 40 to prevent the bench 60 and more specifically the torso portion 61 from moving away from the second segment 40, i.e., away from the proximal and parallel position with respect to the second segment 40. Thus, with the latches in the latched positions, the bench 60 may be moved between the extended and retracted states while remaining proximal to and parallel with the second segment 40 and without moving upwardly or outwardly from the second segment 40. Further, with the latches in the latched positions and the bench 60 in the extended state in a substantially horizontal position parallel with the second segment 40, the bench 60 can be retained in a substantially flat horizontal exercise bench configuration with the first surface of the torso portion 61 substantially parallel or co-planar with the second surface of the seat portion 62 and the bench 60 cannot be moved into an inclined bench configuration without the latches first being released.

When the latch pivots to the unlatched position, the extension 69 retracts from the opening 48 of the corresponding latch receiver 46 on the second segment 40. With the latch in the unlatched position, the engagement surfaces 70 and 49 of the latch and the corresponding latch receiver can no longer engage to prevent the torso portion 61 from being moved upwardly and/or outwardly away from the second segment 40. Accordingly, with the latches in the unlatched positions, the torso portion 61 is free to be moved upwardly and away from the second segment 40 to a selected upwardly inclined position relative to the second segment 40.

Figure 23:
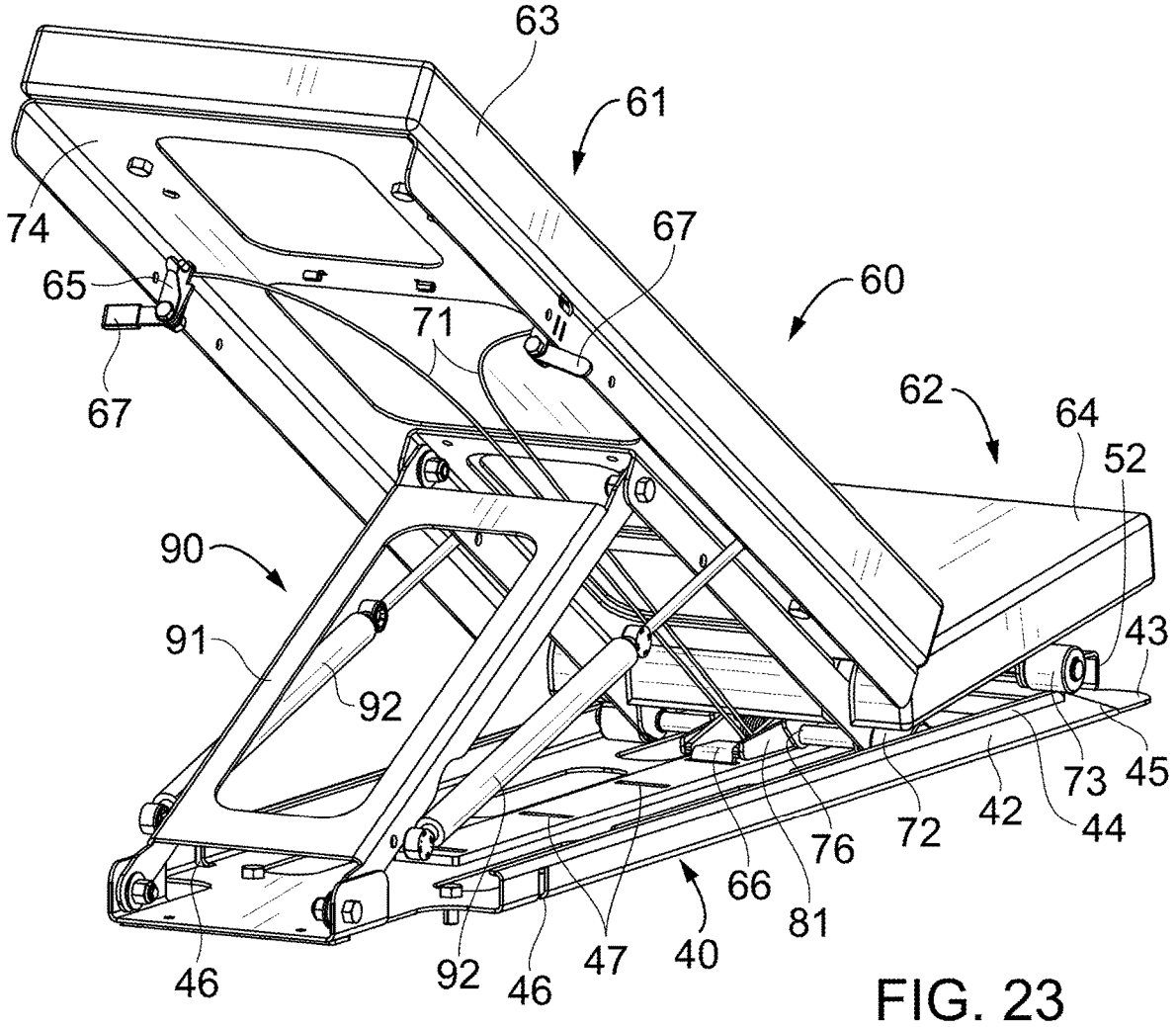
FIG. 23 is a rear perspective view of a retractable wall mountable inclinable bench in an extended state in a selected inclined position with a seat portion latched to a segment and inclined in a first direction and a torso portion supported and inclined in a second opposite direction in accordance with an example embodiment.
Figure 24:
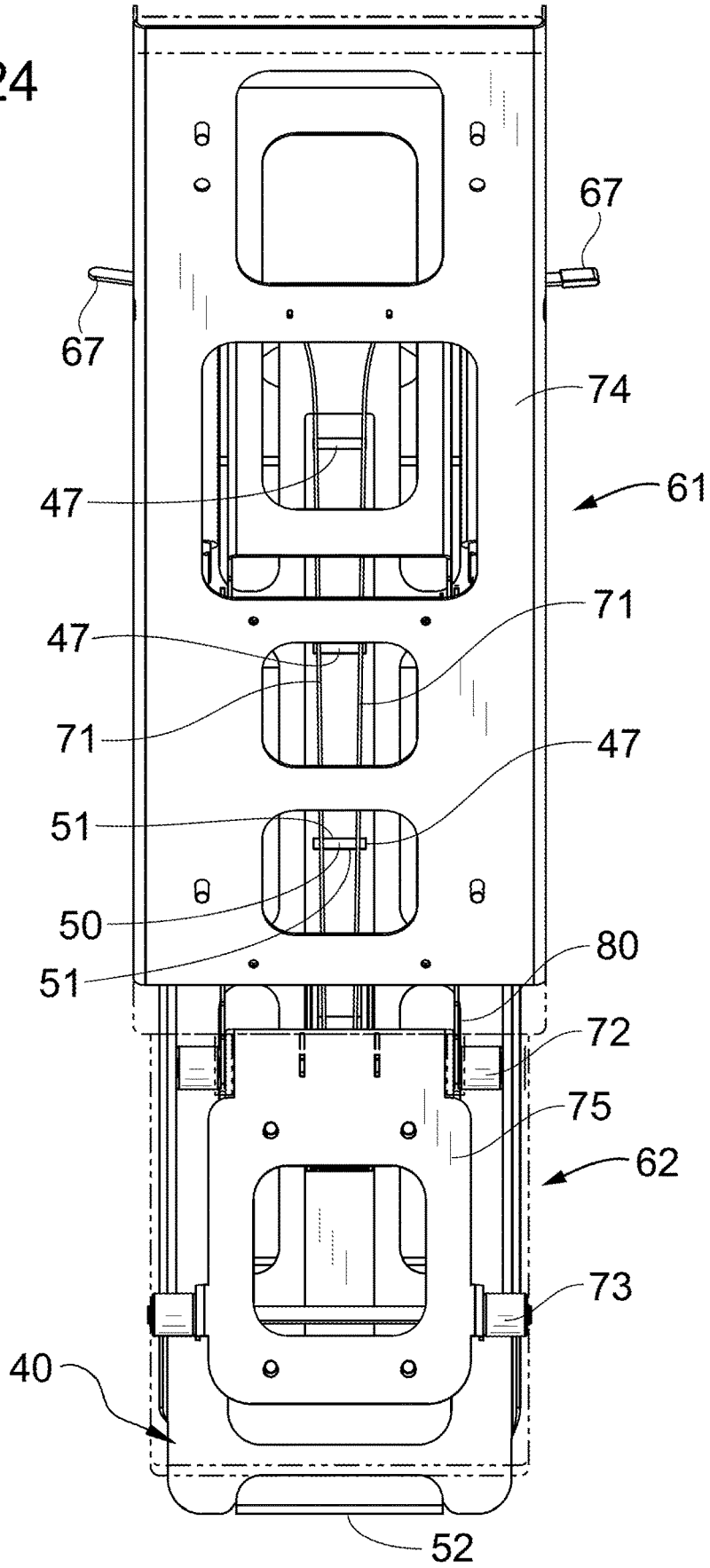
FIG. 24 is a top view of a retractable wall mountable inclinable bench in an extended state in a selected inclined position with a seat portion latched to a segment and inclined in a first direction and a torso portion supported and inclined in a second opposite direction illustrated partially transparent to reveal various components in accordance with an example embodiment.
Figure 25:
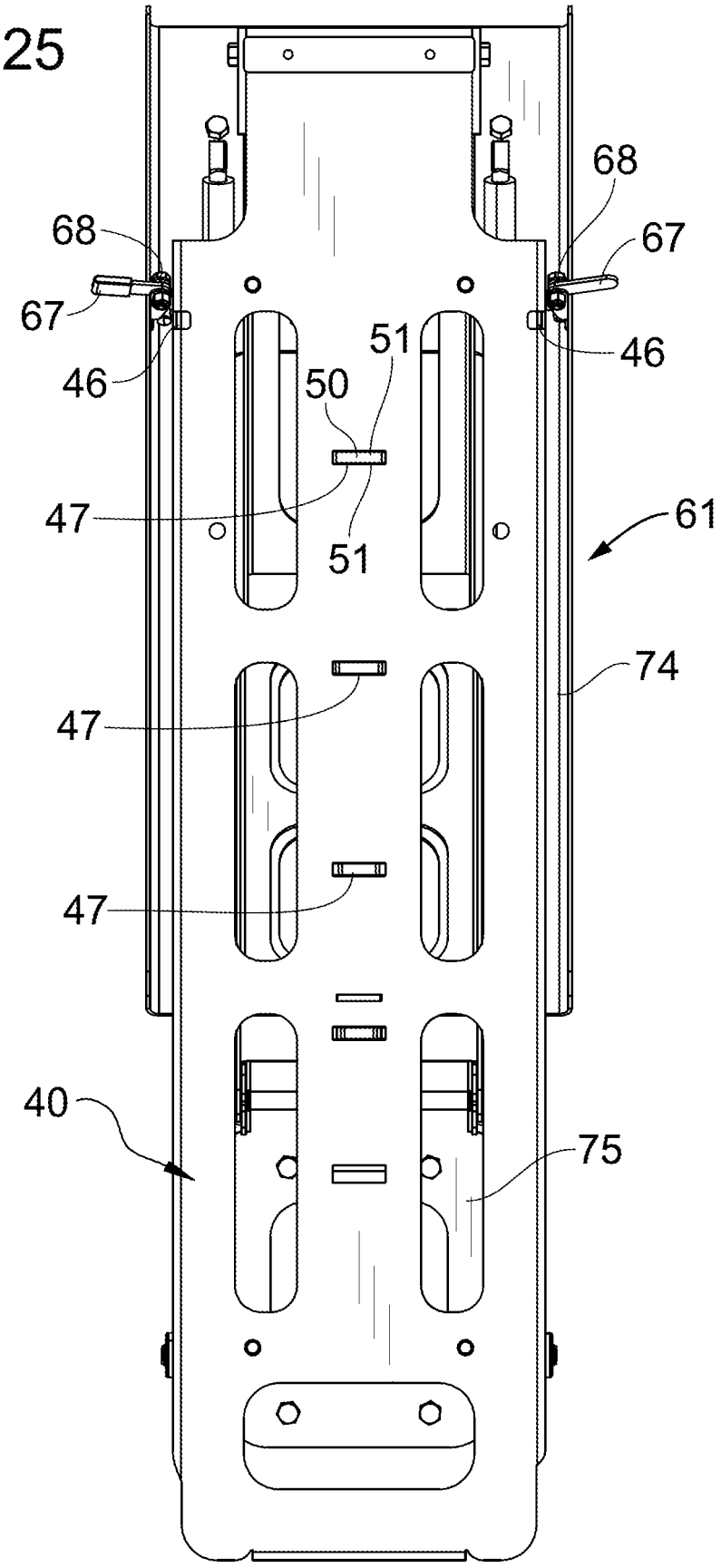
FIG. 25 is a bottom view of a retractable wall mountable inclinable bench in an extended state in a selected inclined position with a seat portion latched to a segment and inclined in a first direction and a torso portion supported and inclined in a second opposite direction in accordance with an example embodiment.
Figure 26:
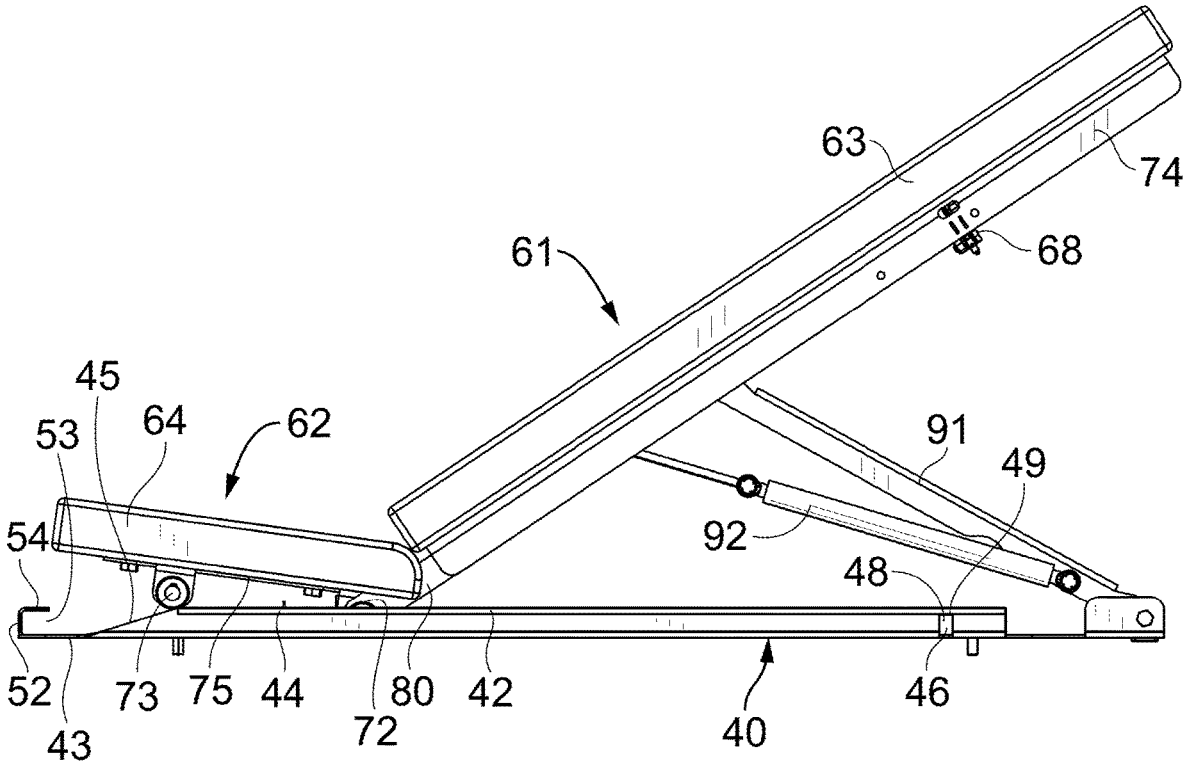
FIG. 26 is a side view of a retractable wall mountable inclinable bench in an extended state in a selected inclined position with a seat portion latched to a segment and inclined in a first direction and a torso portion supported and inclined in a second opposite direction in accordance with an example embodiment.

The latches comprising the first latch 65 are preferably urged in the latched position by a bias force. The magnitude of the bias force is preferably sufficient to avoid inadvertently or accidentally unlatching the bench 60 from the second segment 40 during exercise or movement of the bench 60 between the extended and retracted states. However, the magnitude is preferably sufficiently small that an exerciser can relatively easily cause the latches to pivot to the unlatched position in order to unlatch the bench 60 from the second segment 40 to move the torso portion 61 from a first position substantially horizontal and parallel with the second segment 40 and a second selected position upwardly inclined with respect to the second segment 40. As best illustrated in FIGS. 20, 21, and 23 the bias force can be provided by one or more tensioned control wires or cables 71 connected to the latches comprising the first latch 65. Alternatively or in addition, one or more spring elements can be used.

It will be appreciated that while in this example embodiment the first latch 65 comprises two latches positioned directly across from each other on the opposing first and second sides of the torso portion 61, the first latch 65 may comprise one or any other number of latches and the latches may be positioned in any desired locations on the torso portion 61 depending on the number and positions of the corresponding latch receivers comprising the first latch receiver 46 on the second segment 40 and consistent with performing the functions described herein.

Also as described above, the torso portion 61 comprises one or more latch operators 67 that comprise part of the latching system of the bench 60. The latch operators 67 are operatively connected to the first latch 65 on the torso portion 61 and to the second latch 66 on the seat portion 62, which is described in further detail below. Preferably, the latch operators 67 are adapted to be selectively operated by a user or exerciser to place the first latch 65 and the second latch 66 in the unlatched position substantially together and at the same time in order to unlatch the torso portion 61 and the seat portion 62 of the bench 60 from the second segment 40 and enable the bench 60 to be moved on the second segment 40 between a first substantially horizontal position and a selected second inclined position, as well as between selected second inclined positions. The latch operators 67 are preferably positioned on the torso portion 61 so as to be readily accessible to and operable by an exerciser for that purpose.

The latch operators 67 may take any form consistent with performing the functions described herein. The latch operators 67 may be directly or indirectly connected with the first latch 65 and the second latch 66. The latch operators 67 also may be connected to the first latch 65 and the second latch 66 by hardwired means or wirelessly, e.g., by means of wireless transceivers.

In this example embodiment and as best illustrated in FIGS. 6, 9, 12-14, 17-19, and 23-25, two latch operators 67 are present on the torso portion 61 with each latch operator being located on a first or second opposing side of the torso portion 61 directly across from the other latch operator. Each latch operator 67 comprises an elongated lever with a first end and a second end opposite the first end. Preferably, the first end extends outwardly beyond the side of the torso portion 61 on which the latch operator 67 is attached and is readily accessible for manipulation by an exerciser. The second end may be an integral part of or may be connected to the latch or latches to be operated by the latch operator 67.

In this example embodiment and as best illustrated in FIGS. 20-21, each latch operator 67 is connected to a latch of the first latch 65 so that as the latch operator 67 is moved between a first position, and a second position the latch is caused to pivot on the pivot connection 68 between the latched position and the unlatched position. More specifically, as the lever of the latch operator 67 is moved from an up position to a down position, the motion of the lever causes the latch to pivot from the latched position to the unlatched position. If the latch is biased toward the latched position as is preferred, then the latch only remains in the unlatched position for as long as the lever is depressed and automatically returns to the latched position when the lever is no longer depressed.

As best illustrated in FIGS. 15, and 22-24, the latch operators 67 are preferably operatively connected to both the latches comprising the first latch 65 on the torso portion 61 and to the second latch 66 on the seat portion 44 by cables or wires 71 so that when the latch operators 67 are operated, both the first latch 65 and the second latch 66 are placed in the unlatched position substantially together and at the same time. More specifically, in this example embodiment a first latch operator 67 on a first side of the torso portion 61 is connected by a cable or wire 71 to both a latch of the first latch 65 on the first side of the torso portion 61 and to a first side of the second latch on the seat portion 62. Similarly, a second latch operator 67 on the second side of the torso portion 61 is connected by another cable or wire 71 to both a latch of the first latch 65 on the second side of the torso portion 61 and to a second side of the second latch on the seat portion 62.

It will be appreciated that with this configuration, both the first and the second latch operator 67 must be actuated to unlatch the torso portion 61 and the seat portion 62 of the bench 60 from the second segment 40 in order to move the bench 60 on the second segment 40. However, it will also be appreciated that the configuration can be readily changed to require the operation of only one latch operator to control all of the latches comprising the first latch 65 and the second latch 66 together, or for multiple latch operators to control different combinations of latches comprising the first latch 65 and the second latch 66. It will also be appreciated that the number and locations of latches comprising the first latch 65 and second latch 66 can be readily changed as desired for particular applications. All of these modifications can be made without departing from the spirit and scope of the present disclosure.

The front end portion of the torso portion 61 is preferably pivotally connected to the rear end portion of the seat portion 62 of the bench 60 by a pivoting connection 79 as best shown in FIGS. 10-11, 15-16, and 23. The pivoting connection 79 may comprise any suitable pivoting connection, such as a hinge, axle, or one or more pivot pins. In the example embodiments specifically, the pivoting connection 79 comprises a pair of extension arms 80 having axle openings that are connected to the torso portion 61 at or near its front end portion and that extend longitudinally outward from the front end portion toward the rear end portion of the seat portion 62. A rotatable axle that is connected to the seat portion 62 at or near the rear end portion thereof and that connects the first movable elements 72, e.g., rollers, of the seat portion 62 on the opposing first and second sides of the seat portion 62 extends through the axle openings and completes the pivoting connection.

Any other type of pivoting connection or other connection between the torso portion 61 and the seat portion 62 that enables them to move together in a longitudinal direction on the second segment 40 and to also be inclined upwardly from the second segment 40 at different and opposing angles with the first surface of the torso portion 61 and the second surface of the seat portion 62 facing, such as illustrated in FIGS. 11, 16, 23, 26-27, 30B, and others may also be used. For one example, a bellows or other type of flexible, compressible and expandable connection or structural segment could be used in place of a pivoting connection.

4. Seat Portion.

Similar to the torso portion 61, the seat portion 62 of the bench 60 is movably supported on the second segment 40. The seat portion 62 has a second surface that is adapted to support the seat or other body part of an exerciser when the bench 60 is in the extended state. Like the first surface, the second surface may comprise a surface of a cushion 64 as shown in FIGS. 1-2 for example, or non-cushioned surface of another type of support structure to support a body part of an exerciser. The cushion 64 may be a separate cushion from the cushion 63 or may comprise a portion of the cushion 63. The second surface is preferably substantially flat and planar with a size and shape sufficient to properly support the seat or other body part of an exerciser during the performance of an exercise with or without a barbell or dumbbells, such as one or more of the exercises identified herein above.

The seat portion 62 may have a substantially square, rectangular, elongated, or other shape. The seat portion 62 may have a length, a width, a longitudinal axis, a first side and a second side opposite of the first side. The length of the seat portion 62 may be and preferably is somewhat greater than the width as best illustrated in FIGS. 1-7, 10-19, and others. Preferably, the seat portion 62 is arranged to be longitudinally co-axial with or longitudinally parallel with the second segment 40. The seat portion 62 also has a front end portion and a rear end portion opposite of the front end portion.

When the bench 60 is in the extended state, the second surface of the seat portion 62 comprises a portion of the upper surface of the bench 60 that an exerciser can position the seat (or another part) of the exerciser's body upon to perform an exercise, as illustrated in FIG. 1C for example. As described above, in the extended state the bench 60 can be selectively placed in a first substantially horizontal position and in a plurality of selectable second inclined positions. With the bench 60 in the first position, the second surface of the seat portion 62 is substantially horizontal and parallel with the second segment 40 and is substantially co-planar or parallel with the first surface of the torso portion 61 of the bench 60. When the bench 60 is in any of the selectable second inclined positions, the second surface of the seat portion 62 is inclined upwardly at an angle with respect to the surface of the second segment 40 and faces the rear end portion of the second segment 40 and the torso portion 61 of the bench 60. It will be appreciated that the angle at which the seat portion 62 is inclined will be different than and opposed to the various angles at which the torso portion 61 may be inclined.

When the bench 60 is in the retracted state, the second surface of the seat portion 62 is substantially parallel with the wall 12, e.g., vertical, and with the second segment 40, and is substantially co-planar or parallel with the first surface of the torso portion 61. The second surface may be either facing outwardly from the wall 12 as shown in FIG. 1A or inwardly toward the wall 12 (not shown) depending upon the configuration of the pivoting system for the bench 60.

As described above, according to one example embodiment the seat portion 62 includes a second latch 66 that comprises part of the latching system of the bench 60. The second latch 66 corresponds to the plurality of second latch receivers 47 on the second segment 40 of the bench 60 described above.

Figure 6:
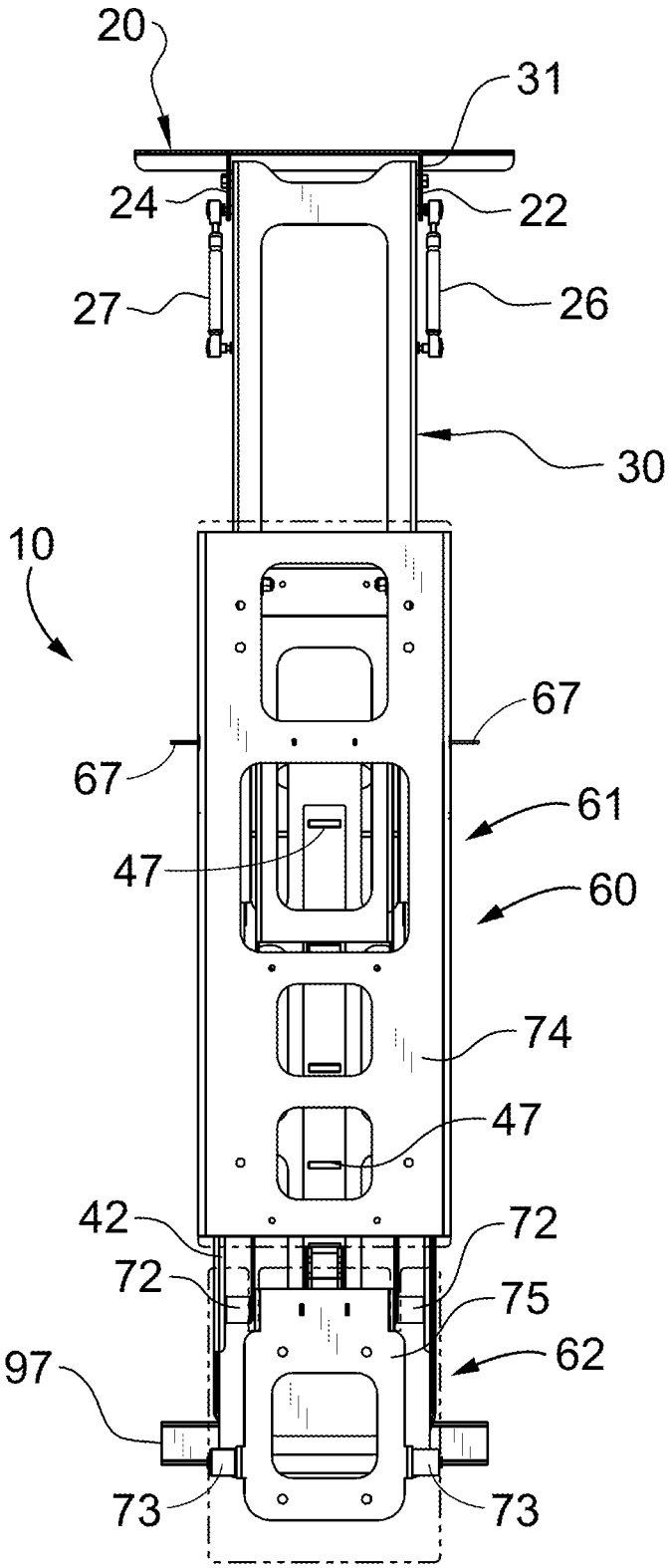
FIG. 6 is a top view of a retractable wall mountable inclinable bench in an extended state in a substantially horizontal position illustrated partially transparent to reveal various components in accordance with an example embodiment.

It will be appreciated that the second latch 66 may comprise one or a plurality of individual latches. In the example embodiment and as best illustrated in FIGS. 6, the second latch 66 comprises a single latch connected to the seat portion 62 on or near the longitudinal axis of the seat portion 62 in alignment with the longitudinal axis of the second segment 40 and the plurality of second latch receivers 47 thereon. The second latch 66 is connected to the seat portion 62 at or near the rear end portion thereof and adjacent to and facing the second latch receivers 47 when the seat portion 62 is supported on the track 42 above them as shown in FIGS. 22-23 and others.

More specifically, the seat portion 62 comprises a backing or mounting plate 75 and the second latch 66 is pivotally connected to the plate 75 by a pivoting connection 76. The pivoting connection 76 may comprise any suitable pivoting connection, such as a hinge, axle, or one or more pivot pins. In the example embodiments specifically, the pivoting connection 76 comprises a pair of extension arms 81 having axle openings that are connected to opposite first and second sides of the second latch 76 and that extend longitudinally toward the front end portion of the seat portion 62. The same rotatable axle described above that is connected to the seat portion 62, and more specifically the plate 75, and that connects the first movable elements 72, e.g., rollers, of the seat portion 62 on the opposing first and second sides of the seat portion 62 extends through the axle openings and completes the pivoting connection.

As best seen in FIGS. 22-23, the second latch 66 comprises an extension 77, such as a claw or pawl. The extension 77 has engagement surfaces 78. The extension 77 is preferably laterally elongated in a direction substantially transverse to the longitudinal axis of the second segment 40 to correspond to the transversely elongated slot shapes of the second latch receivers 47. However, it will be appreciated that the extension 77 and the corresponding second latch receivers 47 can have many other shapes consistent with providing the functions described herein.

The second latch 66 is pivotable on the pivoting connection 76 between a latched position and an unlatched position. When the second latch 66 pivots into the latched position, the extension 69 enters the opening 50 of a corresponding second latch receiver 47 on the second segment 40. In the latched position, the engagement surfaces 78 of the extension 77 can engage with the corresponding engagement surfaces 51 of the corresponding second latch receiver on the second segment 40 to prevent the bench 60 and more specifically the seat portion 62 from moving longitudinally with respect to the second segment 40. Thus, in combination with the inclined position support 90 described below, the second latch 66 is operable to latch the bench 60 to the second segment 40 at the position of the corresponding second latch receiver 47 and to maintain the bench in the selected inclined position that corresponds to the location of that second latch receiver 47 on the second segment 40. The bench 60 cannot be moved from the selected inclined position to the substantially horizontal position parallel with the second segment 40 or to another selected inclined position as long as the second latch 66 remains in the latched position and until it is released.

When the second latch 66 pivots into the unlatched position, the extension 77 retracts from the opening 50 of the corresponding second latch receiver 47 on the second segment 40. In the unlatched position, the engagement surfaces 78 and 51 of the second latch 66 and the corresponding second latch receiver 47 can no longer engage to prevent the bench 60 and more specifically the seat portion 62 from being moved longitudinally on the second segment 40. Accordingly, with the second latch in the unlatched position, the bench 60 including the seat portion 62 is free to be moved longitudinally on the second segment 40 to another selected upwardly inclined position relative to the second segment 40 or to the substantially horizontal position parallel to the second segment 40.

Similarly to the first latch 65, the second latch 66 is preferably urged in the direction of the latched position by a bias force that is sufficient to avoid inadvertent or accidental unlatching of the second latch 66 but readily overcome by an exerciser desiring to move the bench 60 to another position. Also similarly to the first latch 65, the bias force can be provided to the second latch 66 by a tensioned wire or cable, such as a wire or cable 71. Alternatively or in addition, the bias force can be provided by one or more springs, a combination of cable and spring, or by any other suitable means.

Figure 22A:
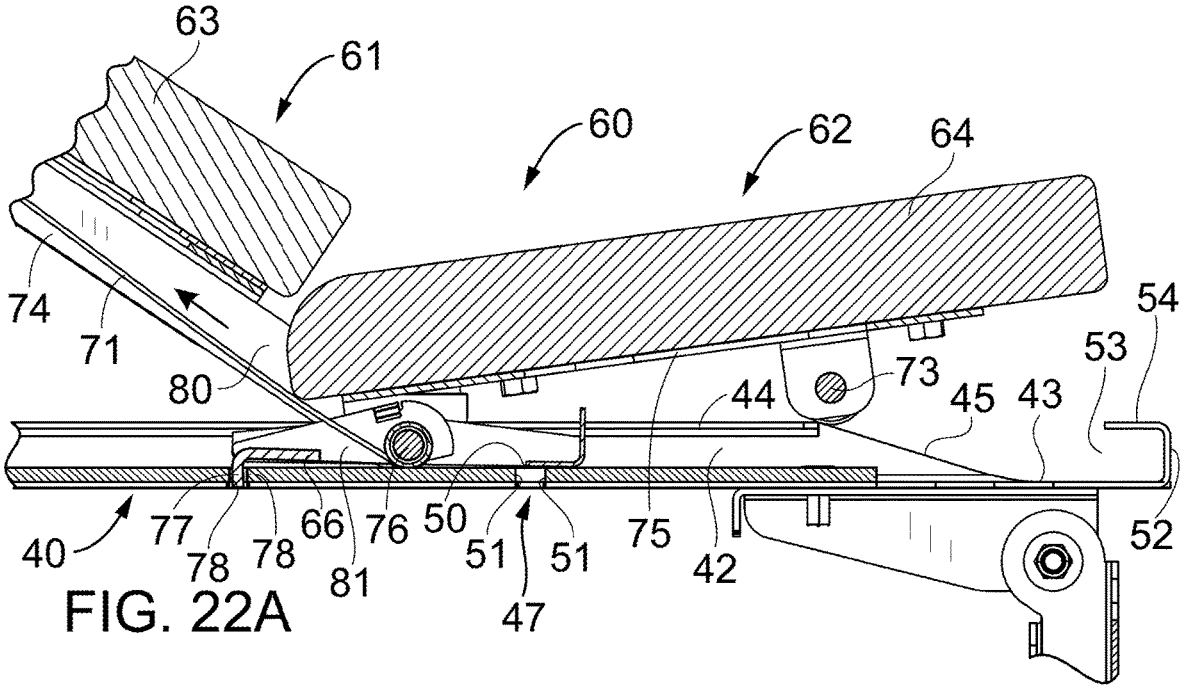
FIG. 22A is a partial cross-sectional side view of a retractable wall mountable inclinable bench in an extended state with the bench at a selected inclined position showing a second latch in a latched position with a segment of the bench in accordance with an example embodiment.
Figure 22B:
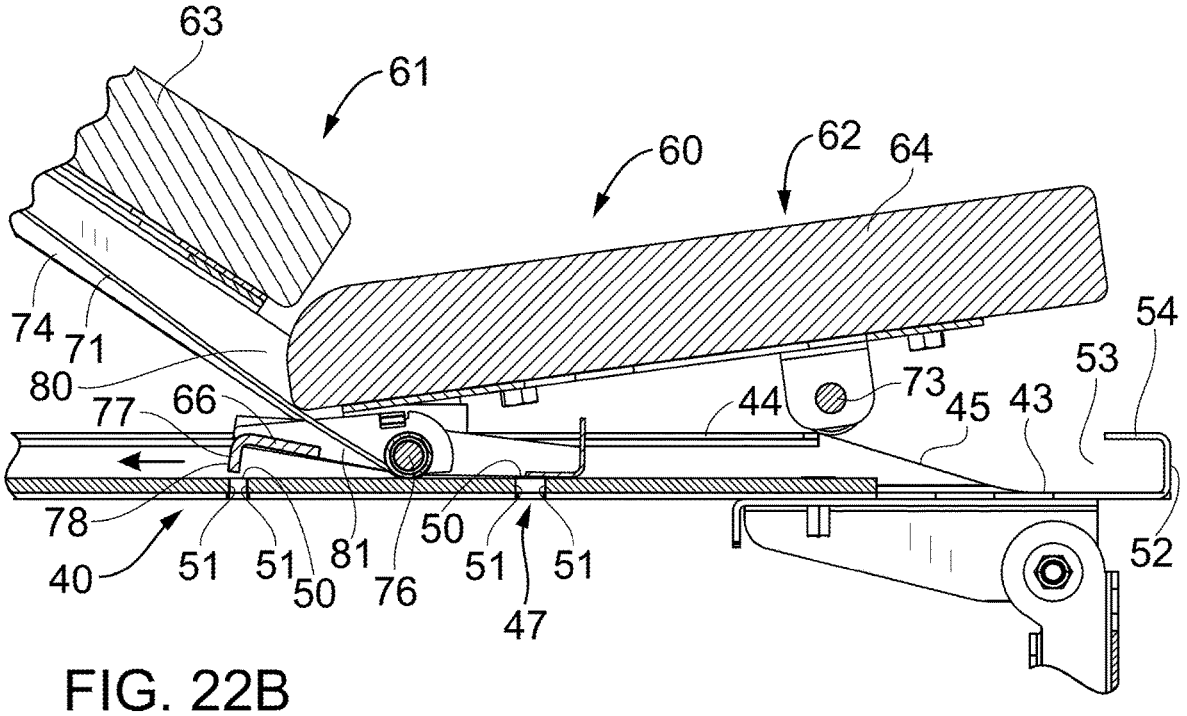
FIG. 22B is a partial cross-sectional side view of a retractable wall mountable inclinable bench in an extended state with the bench at a selected inclined position showing a second latch in an unlatched position with a segment of the bench in accordance with an example embodiment.

As described above, the latch operators 67 are operatively connected to the second latch 66, and are preferably operable to operate the second latch 66 and the first latch 65 together to unlatch the bench 60 from the second segment 60. In this example embodiment and as best illustrated in FIGS. 10, 15, and 22-24, each of the latch operators 67 on the opposite first and second sides of the torso portion 61 of the bench 60 is connected to one of the extension arms 81 on each opposite side of the second latch 66 by a wire or cable 71. As a latch operator 67 is moved, e.g., depressed, from a first position, e.g., up position, to a second position, e.g., down position as described above, the extension arm 81 to which it is connected by the wire or cable 71 is caused to pivot on the pivot connection 76 and urge the second latch 66 to pivot from the latched position to the unlatched position as seen in FIGS. 22A-22B. Because in the example embodiment the second latch 66 comprises an extension arm 81 on each opposite side of the latch, both of the latch operators 67 on opposite sides of the torso portion 61 must be operated to cause the second latch 66 to pivot from the latched position to the unlatched position. However, as described above, this configuration can be modified if desired or needed for a particular application. For example, the configuration could be modified so that only a single latch operator 67 is connected to the second latch 66 to control its operation, or so that if either latch operator 67 is depressed, the second latch 66 is caused to pivot to the unlatched position.

If the second latch 66 is biased toward the latched position as is preferred, then the second latch 66 only remains in the unlatched position for as long as the latch operators 67 are depressed and then automatically returns to the latched position. As long as the extension 77 of the second latch 66 is aligned with an opening 50 of a second latch receiver 47 when the latch operators 67 are released, the bench 60 and more specifically the seat portion 61 will be automatically latched to the second segment 40 in the selected inclined position. If the latch operators 67 are released when the extension 77 is not aligned with an opening 50, the seat portion 61 can be moved longitudinally on the second segment 40 until the extension 77 reaches alignment with an opening 50 of a second latch receiver 47. The bench 60 will then be automatically latched in the inclined position corresponding to that second latch receiver 47.

It will be appreciated that while in the example embodiment the second latch 66 comprises a single latch positioned along the longitudinal axis of the seat portion 62 and adapted to latch/unlatch with a single opening 50 of a second latch receiver 47, the second latch 66 may comprise one or any other number of latches and the latches may be positioned at any desired locations on the seat portion 62 depending on the number, positions, and openings of the corresponding second latch receivers 47 on the second segment 40 and consistent with performing the functions described herein. All of these modifications can be made without departing from the spirit and scope of the present disclosure.

As described above, the rear end portion of the seat portion 62 is pivotally connected to the front end portion of the torso portion 61 by a pivoting connection 79. Accordingly, the seat portion 62 and the torso portion 61 of the bench 60 are enabled to be moved longitudinally on the second segment 60 together and are also enabled to be moved into upwardly inclined positions both with respect to the surface of the second segment 40 and with respect to (and facing) each other as shown in FIGS. 10-11, 15-16, 22-23, 26-27, and 30B-30C.

Also as described above, the second surface of the seat portion 62 is automatically inclined upwardly from the second segment 40 facing the rear end portion of the second segment 40 and the first surface of the torso portion 61 as the seat portion 62 moves longitudinally toward the rear end portion of the second segment 40 on the track 42. For that purpose among others, the seat portion 62 comprises one or more first movable elements 72 that are located at or near the rear end portion of the seat portion 62, and one or more second movable elements 73 that are located at or near the front end portion of the seat portion 62. The movable elements 72, 73 may comprise rollers, sliders, bearings, or any other movable element that is suitable to be movable on and to be guided and supported by the track 42. In the example embodiments specifically, the movable elements comprise rollers.

More specifically, the first movable elements 72 comprise a first pair of rollers that are mounted and spaced apart on a first rotatable axle. The first axle is rotatably connected to the mounting or back plate 75 of the seat portion 62 at or near the rear end portion of the seat portion 62 and at or near the opposite first and second sides of the seat portion 62 by a first set of axle mounts that project downwardly from the plate 75 toward the second segment 40. The first axle is rotatably supported in axle openings of the first axle mounts. The first axle extends substantially transverse to the longitudinal axis of the seat portion 62 and the second segment 40. The first rollers are spaced apart on the first axle and are inset from the opposite first and second sides of the seat portion 62 in alignment with the first level 43 of the track 42. The first rollers move along and are guided and supported on the first level 43 of the track 42 as the seat portion 62 is moved longitudinally on the second segment 40. The rear end portion of the seat portion 62 thus maintains a substantially constant elevation with respect to the second segment 40 as the seat portion 62 moves longitudinally with respect thereto.

Figure 27:
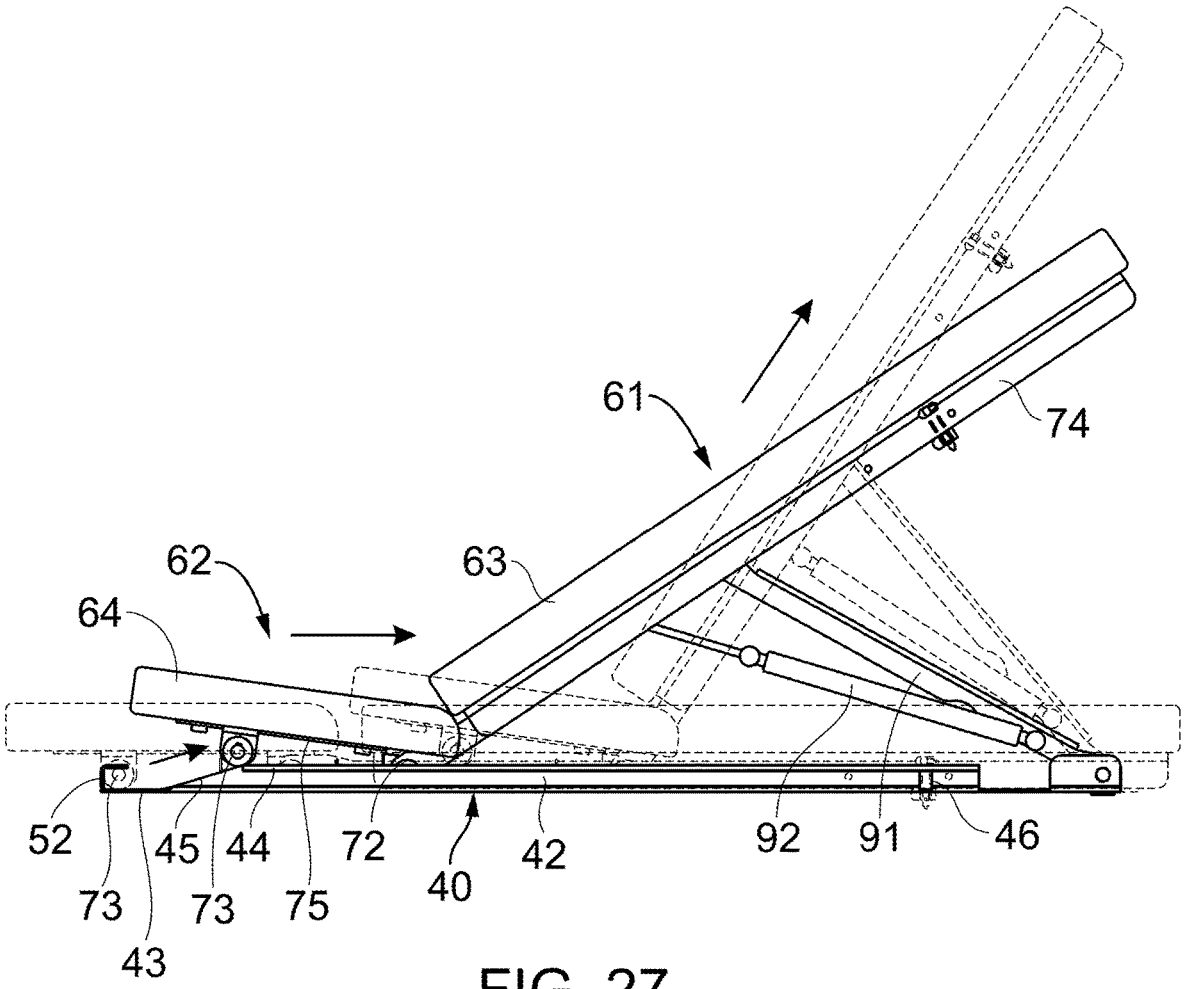
FIG. 27 is a side view of a retractable wall mountable inclinable bench in an extended state showing movement of the bench between a substantially horizontal position and a plurality of selected inclined positions shown in outline in accordance with an example embodiment.

Similarly, the second movable elements 73 also comprise a second pair of rollers that are mounted and spaced apart on a second rotatable axle. The second axle is rotatably connected to the mounting or back plate 75 of the seat portion 62 at or near the front end portion of the seat portion 62 and at or near the opposite first and second sides of the seat portion 62 by a second set of axle mounts that project downwardly from the plate 75 toward the second segment 40. The second axle is rotatably supported in axle openings of the second axle mounts. The second axle extends substantially parallel with the first axle and substantially transverse to the longitudinal axis of the seat portion 62 and the second segment 40. The second rollers are spaced apart on the second axle at or near the opposite first and second sides of the seat portion 62 in alignment with the ramp 45 and second level 44 of the track 42. The second rollers are located nearer to the first and second sides of the seat portion than the first set of rollers, which in other words are more inset from the sides of the seat portion 62 than the second rollers. The second rollers move along and are guided and supported on the ramp 45 and the second level 44 of the track 42 as the seat portion 62 is moved longitudinally on the second segment 40. The front end portion of the seat portion 62 thus is automatically elevated with respect to the second segment 40 and the second surface of the seat portion 62 is automatically inclined upwardly from the second segment 40 and faces the rear end portion of the second segment 40 and the first surface of the torso portion 61 as the seat portion 62 moves longitudinally toward the rear end portion of the second segment 40. As best illustrated in FIG. 27, once the second rollers 73 are on the second level 44 of the track 42, the second surface of the seat portion 62 maintains the same upward angle of inclination with respect to the second segment 42 and the torso portion 61 as the bench 60 is moved further toward the rear end portion of the second segment 40. However, the first surface of the torso portion 61 is able to assume a plurality of different upward angles of inclination at various selectable inclined positions and while facing the front end portion of the segment 40 and the second surface of the seat portion 62.

5. Inclined Position Support.

An inclined position support 90 is pivotally connected to the bench 60 and more specifically to the torso portion 61 and is adapted to support the bench 60 in a selected inclined position and to assist in lifting the bench 60 into a selected inclined position. The inclined position support 90 comprises one or more rigid support members 91 and may optionally include one or more actuators 92.

The rigid support member 91 preferably comprises an elongated member having a first end and a second end. The first end is pivotally connected to the second segment 40 preferably at or near its rear end portion. The second end is pivotally connected to the bench 60 and more specifically to the torso portion 61 preferably between the front end portion and the rear end portion of the bench 60 and more specifically between the front end portion and the rear end portion of the torso portion 61. As the bench 60 is moved between a substantially flat horizontal position parallel to the second segment 40 and a selected inclined position, the first and second ends of the rigid support member 91 pivot relative to the second segment 40 and the bench 60 respectively. When the bench 60 is in a selected inclined position, the rigid support member 91 supports and maintains the bench 60 and more specifically the torso portion 61 in that position and prevents the bench 60 from returning to the flat horizontal position on the second segment 40 until the latch maintaining the bench 60 in the inclined position on the second segment 40 is released. In one example embodiment, the second latch 66 is released using the latch operators 67. When the second latch 66 is released, the bench 60 can be moved to another selected inclined position or to a flat horizontal position on the second segment 40, and the first and second ends of the rigid support member 91 pivot relative to the second segment 40 and the bench 60 respectively as the bench 60 is moved. The rigid support member 91 is arranged so that when the bench 60 is in the flat horizontal position, the rigid support member 91 also lies in a substantially flat horizontal configuration between the bench 60 and the second segment 40 for retraction and storage.

In one embodiment, the rigid support member 91 comprises a structure with elongated opposite lateral sides that extend between the first end and the second end. In this embodiment, the first end is pivotally connected to the second segment 40 on each side and the second end is pivotally connected to the bench 60 on each side.

The pivoting connections between the rigid support member 91, the second segment 40, and the bench 60 may comprise one or more pivot pins, axles, hinges, or any other suitable pivoting connector. It will be appreciated that the rigid support member 91 may have a single pivoting connection to the second segment 40 and/or to the bench 60 or multiple pivoting connections.

If used, the optional actuator 92 may comprise an elongated linear actuator having a first end and a second end. The first end is pivotally connected to the rigid support member 91 preferably at or near its first end, or to the second segment 40 preferably at or near its rear end portion. The second end is pivotally connected to the bench 60 and more specifically to the torso portion 61 preferably between the front end portion and the rear end portion of the bench 60 and more specifically between the front end portion and the rear end portion of the torso portion 61.

The optional actuator 92 is adapted to apply a biasing force to the bench 60 in a direction upward from the second segment 40 and toward the front end portion of the bench 60 to assist in lifting the bench 60 into a selected inclined position and to help maintain the bench 60 in the selected inclined position as shown in FIGS. 10-11, 14-16, 19, 23, 26-27, and 30B-30C.

As the bench 60 is moved between a substantially flat horizontal position parallel to the second segment 40 and a selected inclined position, the first and second ends of the optional actuator 92 pivot relative to the rigid support member 91 (or the second segment 40) and the bench 60 respectively and apply the bias force as described to assist in moving the bench 60 into the selected inclined position. When the bench 60 is in a selected inclined position, the optional actuator 92 applies the bias force as described to help maintain the bench 60 and more specifically the torso portion 61 in the selected inclined position and prevent the bench 60 from returning to the substantially flat horizontal position on the second segment 40 until the latch maintaining the bench 60 in the inclined position is released. In one example embodiment, the second latch 66 is released using the latch operators 67. When the second latch 66 is released, the bench 60 can be moved to another selected inclined position or to the substantially flat horizontal position on the second segment 40 and the first and second ends of the actuator 92 pivot relative to the rigid support member 91 (or the second segment 40) and the bench 60 respectively as the bench 60 is moved. If used, the optional actuator 92 is arranged so that when the bench 60 is in the substantially flat horizontal position, the actuator 92 also lies in a substantially flat horizontal configuration between the bench 42 and the second segment 40 for retraction and storage.

In an embodiment, the optional actuator 92 may comprise one actuator element pivotally connected between the rigid support member 91 and the torso portion 61 of the bench 60 at or near a first side of the rigid support member 91 and a corresponding first side of the bench 60. In another embodiment, the optional actuator 92 may comprise a second actuator element pivotally connected between the rigid support member 91 and the torso portion 61 of the bench 60 at or near a second side of the rigid support member 91 and a corresponding second side of the bench 60 that are opposite the first sides. In this embodiment, both actuator elements apply the upward and forward biasing force to the bench 60 as previously described to assist in lifting the bench 60 upwardly and forwardly into the selected inclined position and to maintain the bench 60 in the selected inclined position. Both actuator elements also pivot relative to the rigid support member 91 (or the second segment 40) and the bench 60 respectively in the same manner described above as the bench 60 is moved. Both actuator elements are arranged so that when the bench 60 is in the flat horizontal position, both actuator elements lie in a substantially flat horizontal configuration between the bench 60 and the second segment 40 for retraction and storage.

The pivotal connections between the optional actuator 92, the rigid support member 91 (or the second segment 40), and the bench 60 may comprise one or more pivot pins, axles, hinges, or any other suitable pivotable connector. It will be appreciated that if used the optional actuator 92 may have a single pivoting connection to the rigid support member 91 (or the second segment 40) and/or to the bench 60 or multiple pivoting connections.

If used the optional actuator 92 may be comprised of various types of actuators that provide a biasing force such as, but not limited to, linear actuators. Examples of suitable linear actuators include, but are not limited to, gas actuators, gas springs, pneumatic actuators, hydraulic actuators, hydraulic gas lift support arms, spring actuators, mechanical compression struts, compression actuators, dampers and the like. The optional actuator 92 may also comprise rotary actuators such as, but not limited to, torsion springs, coil springs and the like. The actuator 92 may be motorized such as an electro-mechanical actuator or servomotor actuator to lift the bench 60 to the selected inclined position without a user having to lift the structure. In addition, a ratchet system may be connected between the bench 60 and the rigid support member 91 or the second segment 40 to prevent the bench 60 from lowering toward the substantially flat horizontal position during a lifting procedure.

D. Support Members

FIGS. 1C, 2A, 3, 5 and others illustrate a first support member 95 and a second support member 96 pivotally attached to the bench 60. The support members 95, 96 engage the floor 14 or other type of ground surface to provide support to the bench 60 when in the extended state. The support members 95, 96 retract towards the bottom surface of the bench 60 when the bench 60 is in the retracted state to provide a compact storage structure when not in use. The support members 95, 96 each form a leg structure that supports the bench 60.

The first support member 95 is preferably positioned nearer the rear end portion of the bench 42 and the second support member 96 is preferably positioned nearer the front end portion of the bench 60. However, it will be appreciated that the support members 95, 96 may be positioned in various locations along the bench 60. The support members 95, 96 extend downwardly from the bottom surface of the bench 60 and are preferably substantially vertical when the bench 60 is in the extended position to provide support for the bench 60 and to elevate the exercise surfaces of the bench 42 above the floor 14 as illustrated in FIGS. 1C, 2A, 4B and others. The first support member 95 is preferably pivotally connected to the first segment 30 of the bench 60 near the second hinge 41 as best illustrated in FIGS. 1B and 2B. The second support member 96 is preferably pivotally connected to the second segment 40 of the bench 60 near the front end portion of the bench 42 as further shown in FIGS. 1B, 2B, 4B and others. The second support member 96 includes a base member 97 and the first support member 95 may also include a base structure.

With the bench 60 in the extended state and not in an inclined position, the first support member 95 and the second support member 96 extend downward from the bench 60 in a substantially vertical direction and substantially transverse to the first and second surfaces of the torso and seat portions 61, 62. The first support member 95 and the second support member 96 are preferably substantially parallel to the first and second surfaces of the torso and seat portions 61, 62 when the bench 60 is in the retracted state as best illustrated in FIG. 2C.

The lower end of the first support member 95 and the lower end of the second support member 96 are distally spaced above the floor 14 when the bench 60 is in the retracted state as further shown in FIG. 2C. The lower end of the first support member 95 and the lower end of the second support member 96 engage the floor 14 when the bench 60 is in the extended state to support the bench 60 above the floor 14 as shown in FIGS. 1C, 2A, and others.

To keep the first support member 95 and the second support member 96 aligned with one another, a first connector 98 and a second connector 99 preferably extend between the first support member 95 and the second support member 96 (pivotally connected thereto). The first connector 98 and the second connector 99 ensure than the support members are aligned parallel with respect to one another when the bench 60 is in the extended state and the retracted state. The first connector 98 and the second connector 99 are preferably parallel with respect to one another as best illustrated in FIGS. 2A and 2B.

The first support member 95 and the second support member 96 each preferably has approximately the same length when the support members are non-adjustable in length so that corresponding first surfaces of the torso and seat portions 61, 62 of the bench 60 are substantially horizontal and level when the bench 60 is in the extended position and not inclined. Alternatively, one or both of the support members 95, 96 may have an adjustable length to maintain the corresponding first surfaces substantially horizontal and level when the floor 14 is uneven.

E. Retracted Position Retention Structures

In one embodiment, a first actuator 26 is pivotally connected to the bench 60 and is adapted to be pivotally connected directly to the wall 12 or mounting bracket 20. The first actuator 26 applies an upward biasing force to the bench 60 to assist in lifting the bench 60 upwardly into the retracted state and to keep the bench 60 in the retracted state once the bench 60 is in the vertical storage position as shown in FIG. 2C. A second actuator 27 may also be pivotally connected to the bench 60 that is adapted to be pivotally connected to the wall 12 or mounting bracket 20. The second actuator 27 applies an upward biasing force to the bench 60 to assist in lifting the bench 60 upwardly into the retracted state and to keep the bench 60 in the retracted state once the bench 60 is in the vertical storage position as shown in FIG. 2C of the drawings.

The first actuator 26 and the second actuator 27 may be comprised of various types of actuators that provide a biasing force such as, but not limited to, linear actuators. Examples of suitable linear actuators include, but are not limited to, gas actuators, gas springs, pneumatic actuators, hydraulic actuators, hydraulic gas lift support arms, spring actuators, mechanical compression struts, compression actuators, dampers and the like. The actuators may also be rotary actuators such as, but not limited to, torsion springs, coil springs and the like. The actuators may be motorized such as an electro-mechanical actuator or servomotor actuator to lift the present invention from the extended position to the retracted position without the user having to lift the structure. In addition, a ratchet system may be connected to the arms to prevent the rack system from lowering during a lifting procedure.

F. Operation of Example Embodiment

In use, the mounting bracket 20 of the retractable wall mountable inclinable bench system 10 is attached to the wall 12 with fasteners 21 as shown in FIGS. 1A-2C, 4B, 36-45 and others. The mounting bracket 20 is positioned a height above the floor 14 corresponding to the height of the support members 95, 96 as shown in FIG. 2A for example. It may be easier for a user to attach the mounting bracket 20 to the wall without the mounting bracket 20 being pivotally attached to the first segment 30 of the bench 60 as shown in FIGS. 1A-2C and others. If so, the mounting bracket 20 may be attached to the wall 12 and then pivotally attached to the first segment 30 using suitable connectors and/or fasteners as shown in FIG. 4B for example.

The various embodiments of the present disclosure may be attached to a wall without any other exercise equipment attached to the wall as shown in FIGS. 1A-2C, or alternatively the various embodiments of the present disclosure may be attached to a wall near or within other types of exercise equipment (e.g. exercise rack, exercise machine) such as, but not limited to, a retractable wall mounted exercise rack as shown in FIGS. 36-45. As shown in the embodiment of FIGS. 36-45, the mounting bracket 20 is mounted to the wall in a location centrally positioned between the two vertical supports of the rack 16 that adjustably receive J-hooks for supporting a barbell 18 so that the bench 60 extends outwardly past the vertical support members of the rack 16 when fully extended in one or more of the various embodiments herein. U.S. Pat. No. 9,333,387 illustrates an exemplary rack titled Retractable Wall Mounted Exercise Rack System suitable for use in combination with one or more of the various embodiments disclosed herein. U.S. Pat. No. 9,333,387, the entire disclosure of which, except for any definitions, disclaimers, disavowals, and inconsistencies, is incorporated herein by reference. U.S. Pat. No. 10,953,301 illustrates another exemplary rack titled Folding Exercise Rack System suitable for use in combination with one or more of the various embodiments disclosed herein in a manner related to U.S. Pat. No. 9,333,387 with the mounting bracket 20 mounted between and the bench 60 extending between the vertical supports of the rack when the rack is fully extended. U.S. Pat. No. 10,953,301, the entire disclosure of which, except for any definitions, disclaimers, disavowals, and inconsistencies, is incorporated herein by reference. The rack 16 may be a foldable rack as illustrated in FIGS. 36-45 or the rack 16 may be a stationary rack that is non-movably attached to the wall 12 and/or the floor 14. The rack 16 may be a squat rack with or without a pull-up bar, or other types of exercise racks. The various embodiments of the present disclosure may also be used in combination with various types of exercise machines such as, but not limited to, weightlifting machines such as a bench press machine, incline press machine, squat machine and the like. The various embodiments of the present disclosure may also be used with a rack or exercise machine that has either a stationary distance lifting location with respect to the wall 12 (e.g. the outside of the vertical support members of a rack 16 that support the J-hooks and the barbell 18) or a variable distance lifting location with respect to the wall 12.

Figure 36:
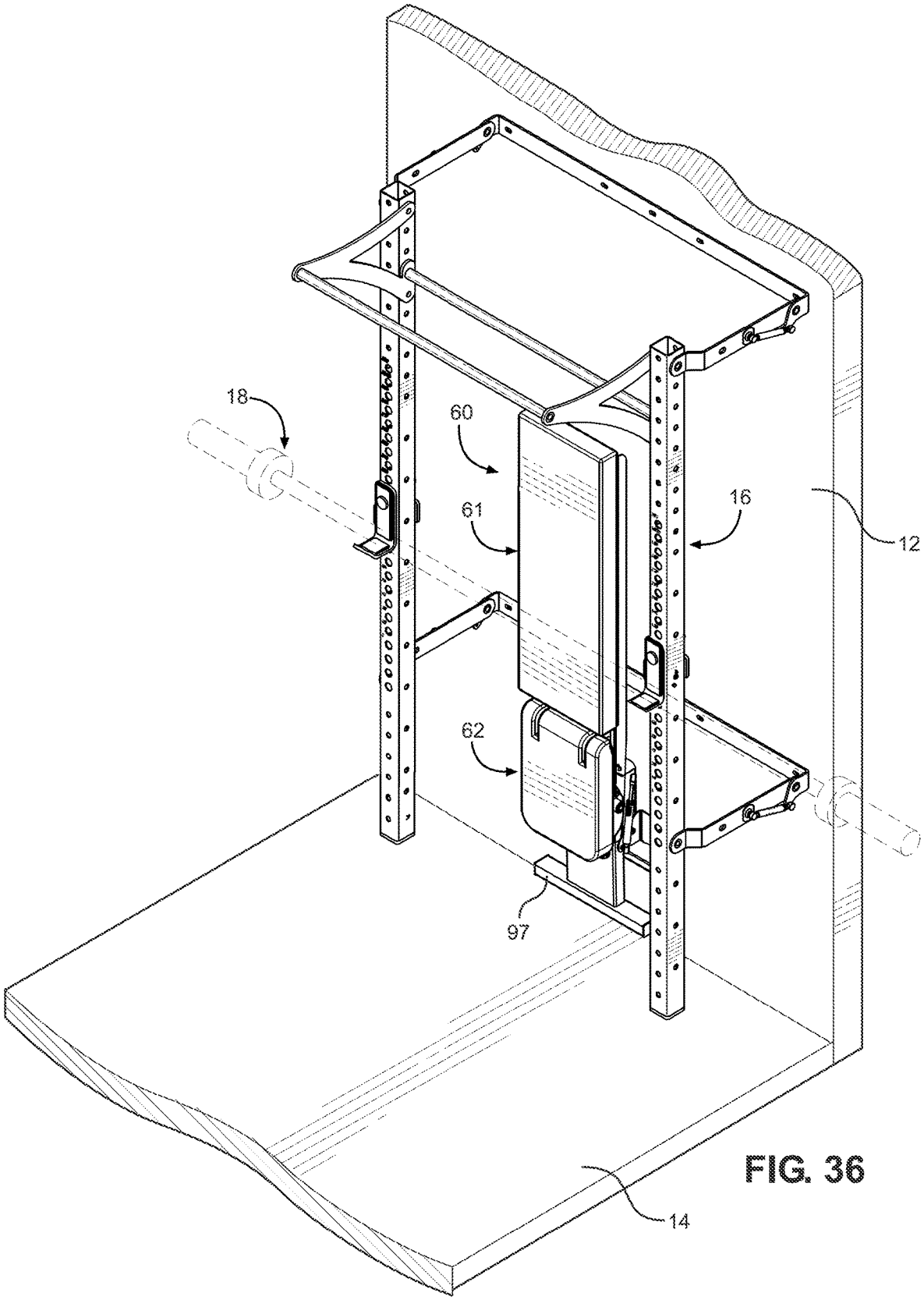
FIG. 36 is an upper perspective view of an example embodiment attached to a wall between vertical support members of an exercise rack in a retracted position.
Figure 40:
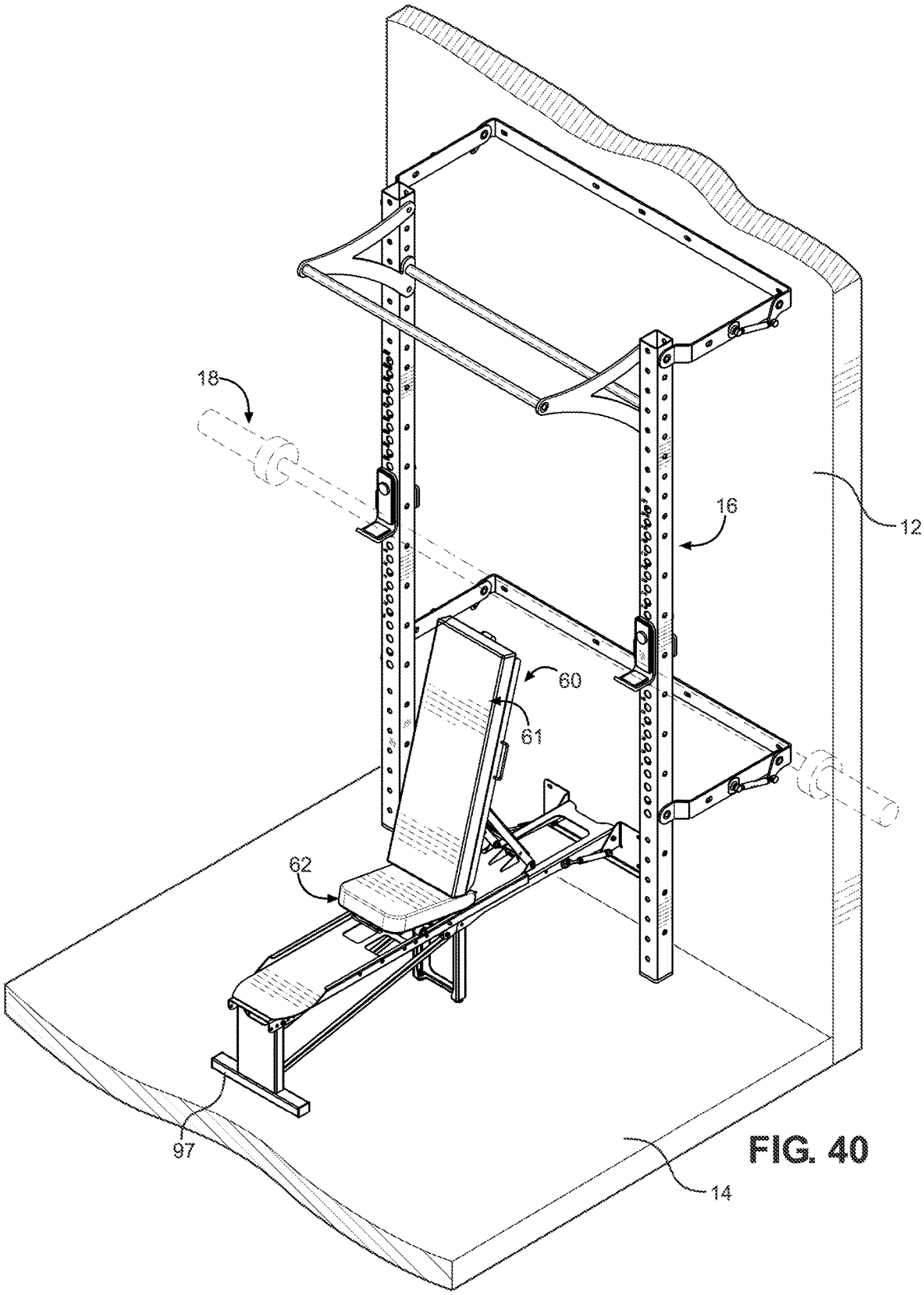
FIG. 40 is an upper perspective view of an example embodiment attached to a wall between support members of an exercise rack in a fully extended position with the bench in a fully inclined state for incline weight bench exercises.
Figure 41:
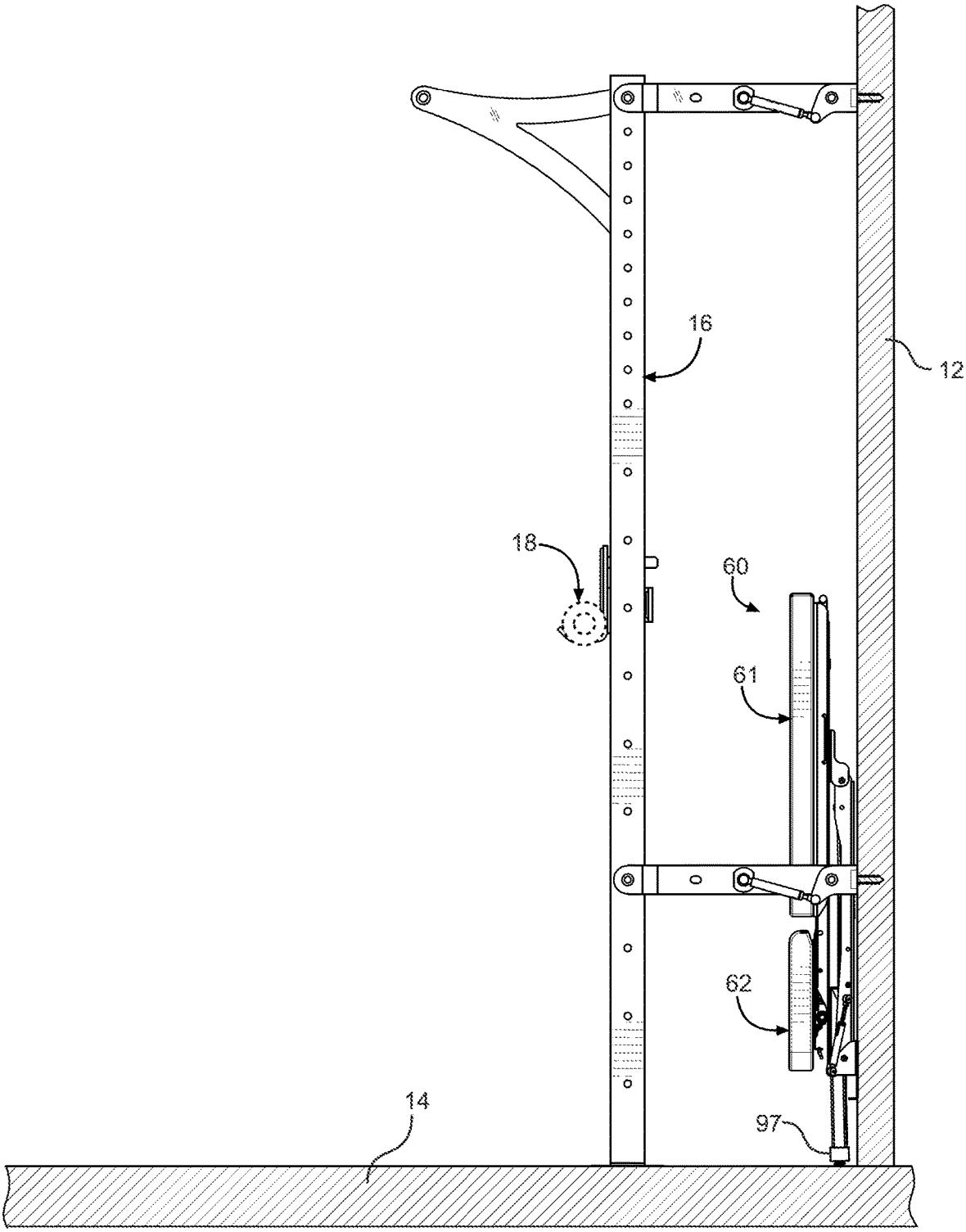
FIG. 41 is a side view of an example embodiment attached to a wall between vertical support members of an exercise rack in a retracted position.

With the mounting bracket 20 attached to the wall 12 and the bench 60 in the compact retracted state as shown in FIGS. 1A, 36 and 40, the bench 60 is positioned substantially flat against the wall 12 to give more room on the floor 14 and to allow the exerciser to use the rack 16 for other types of exercises (e.g. squats, pullups, etc.) without interference by the various embodiments in the present disclosure.

Figure 37:
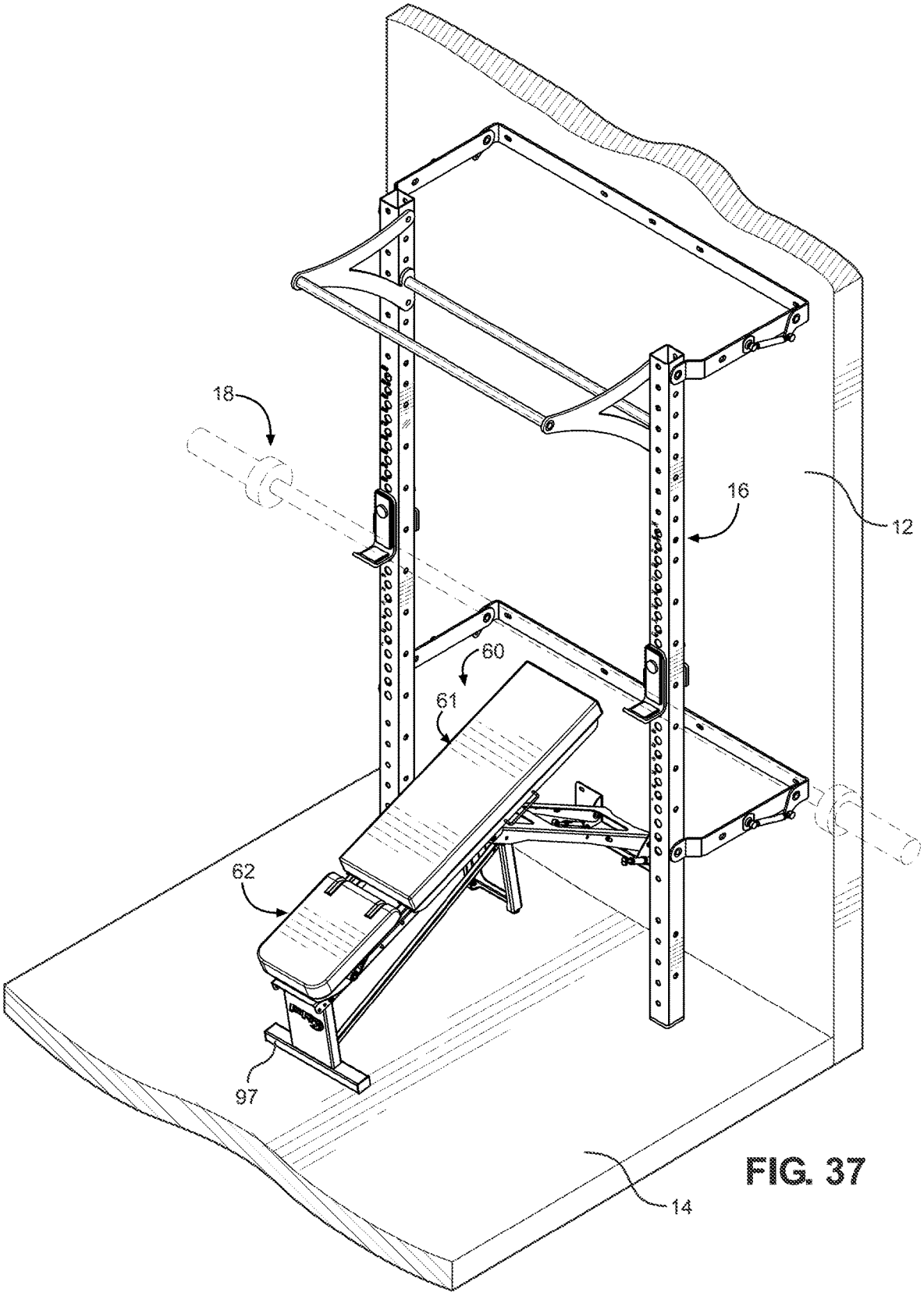
FIG. 37 is an upper perspective view of an example embodiment attached to a wall between support members of an exercise rack in a partially extended position.
Figure 38:
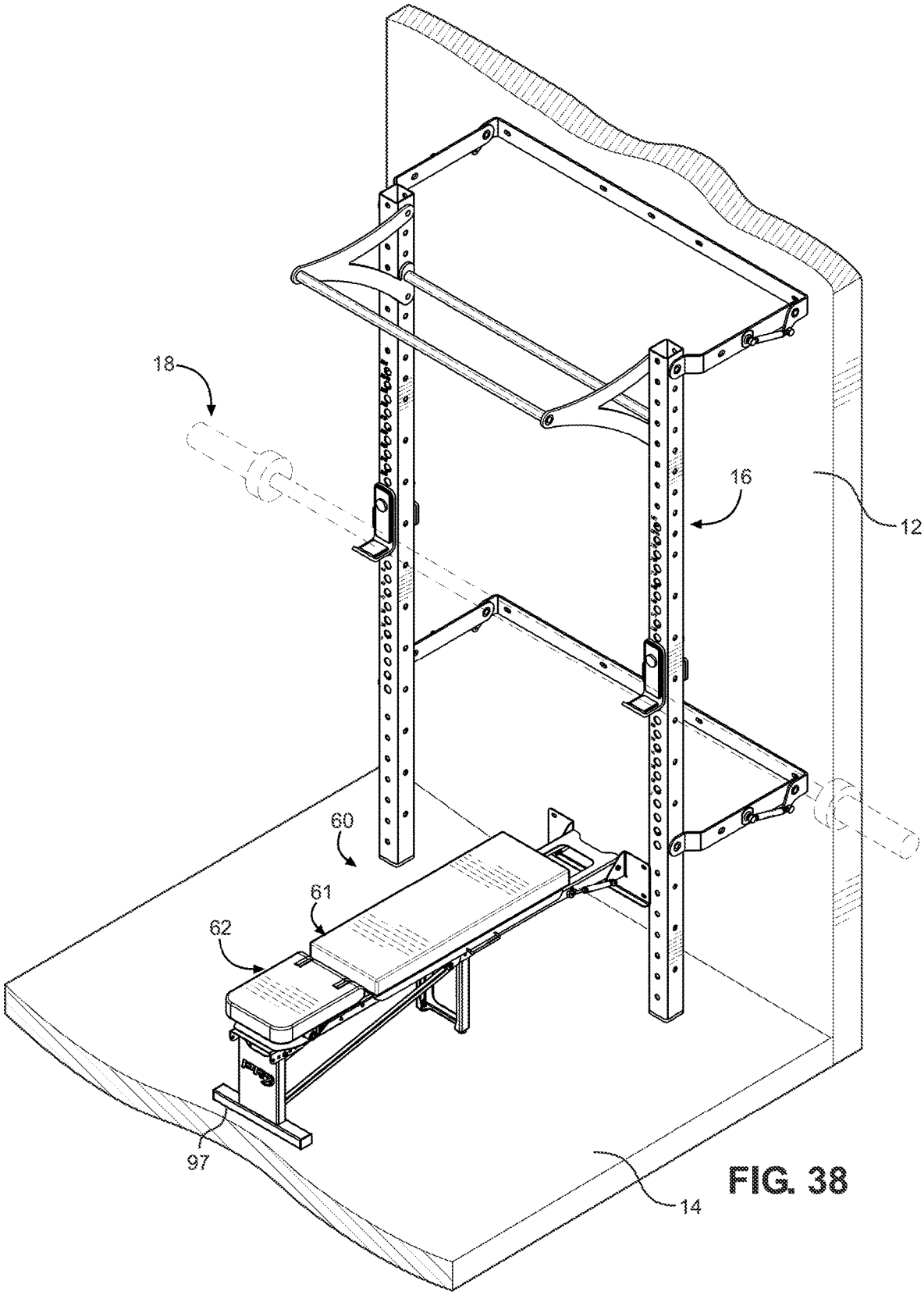
FIG. 38 is an upper perspective view of an example embodiment attached to a wall between support members of an exercise rack in a fully extended position with the bench in a flat-state for bench presses and other exercises that can be performed on a flat bench.
Figure 39:
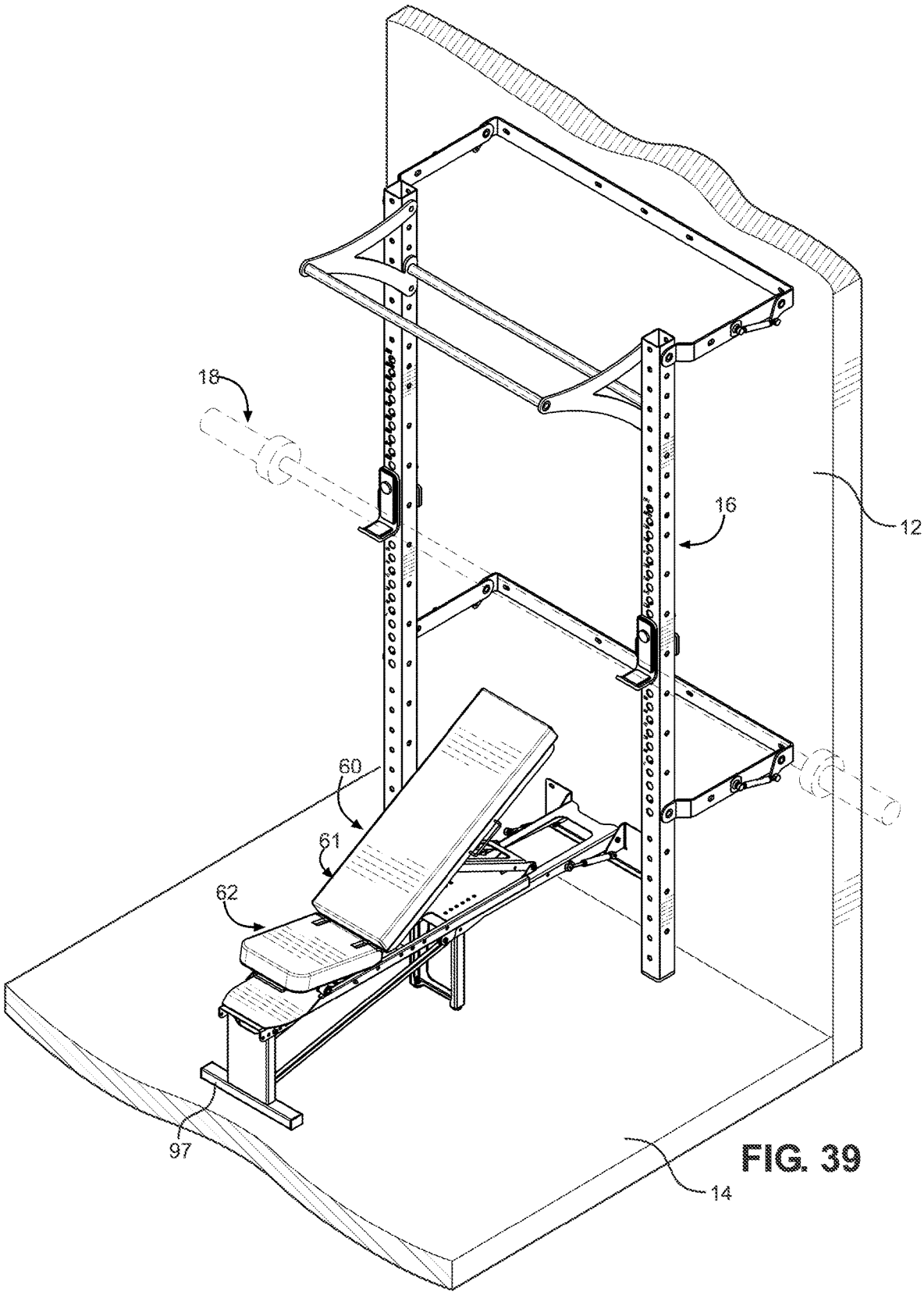
FIG. 39 is an upper perspective view of an example embodiment attached to a wall between support members of an exercise rack in a fully extended position with the bench in a partially inclined state for incline weight bench exercises.
Figure 42:
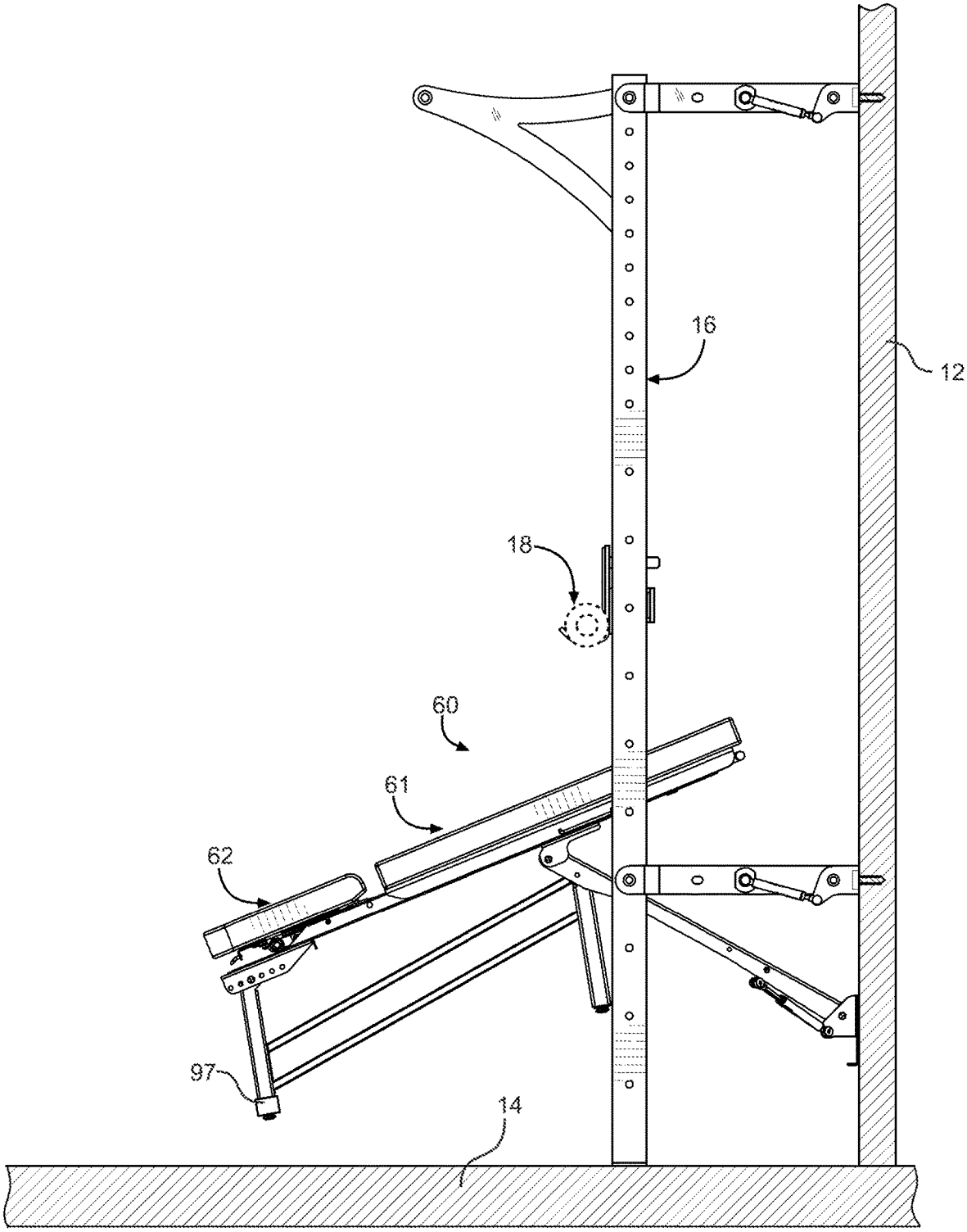
FIG. 42 is a side view of an example embodiment attached to a wall between support members of an exercise rack in a partially extended position.

To use the bench 60, the exerciser pulls the bench 60 downwardly (or sideways depending upon the pivot axis used for the first hinge 31) into the extended state (see FIGS. 37 and 42) where an exerciser can use the bench 60 as desired for weightlifting or other exercises performable on a flat-bench or inclined bench. As shown in FIGS. 37 and 42, as the bench 60 is moved into the extended state, the first support member 95 and the second support member 96 each pivot downwardly from the bench 60 to support the bench 60 on the ground 14.

Initially in the fully extended state, the bench 60 may extend outwardly from the wall 12 in a substantially flat horizontal manner as shown in FIGS. 1C, 2A, 38 and 43 of the drawings. The torso portion 61 and seat portion 62 are latched to the second segment 40 in a substantially flat horizontal arrangement and the first and second surfaces of torso portion 61 and the seat portion 62 are substantially co-planar or parallel. If desired, the exerciser may use the bench 60 in this configuration to lift weights or perform other exercises.

While the bench 60 is in the extended position, the exerciser may, if desired, move the bench 60 from the substantially flat horizontal position (see FIGS. 38 and 43) to a selected inclined position to perform a bench press exercise or other exercises to be performed on a flat-bench (see FIGS. 39, 40, 44 and 45). In one example embodiment, the exerciser uses the latch operators 67 to release the first latch 65 and the second latch 66 together. This releases both the torso portion 61 and the seat portion 62 of the bench 60 from the second segment 40 and allows the bench 60 to be moved upwardly and outwardly as well as longitudinally with respect to the second segment 40. The exerciser may then move the bench 60 into a selected inclined position (see FIGS. 39, 40, 44 and 45) by lifting the torso portion 61 upward and forward from the second segment 40 while moving the seat portion 62 longitudinally toward the rear end portion of the second segment 40 until the selected inclined position is reached. As the exerciser moves the seat portion 62 longitudinally along the second segment 40, the front end portion of the seat portion 62 automatically pivots upwardly and the second surface of the seat portion 62 inclines upwardly relative to the second segment 40 and faces toward the rear end portion of the second segment 40 and the first surface of the torso portion 61. When the bench 60 reaches a selected inclined position on the second segment 40, the second latch 66 may automatically latch the bench 60 to the second segment 40 in the selected position and together with the inclined position support 90 maintains the bench 60 in the selected inclined position. In this position, both the torso portion 61 and the seat portion 62 are inclined upwardly in relation to the second segment 40. The first surface of the torso portion 61 faces the forward end portion of the second segment 40 and the second surface of the seat portion 62 and the first and second surfaces are inclined at an obtuse angle to each other. With this arrangement, the exerciser may position and support a body part on the seat portion 62 without potentially sliding off. The exerciser may then perform additional and/or other weight-lifting or other exercises as desired.

Figure 44:
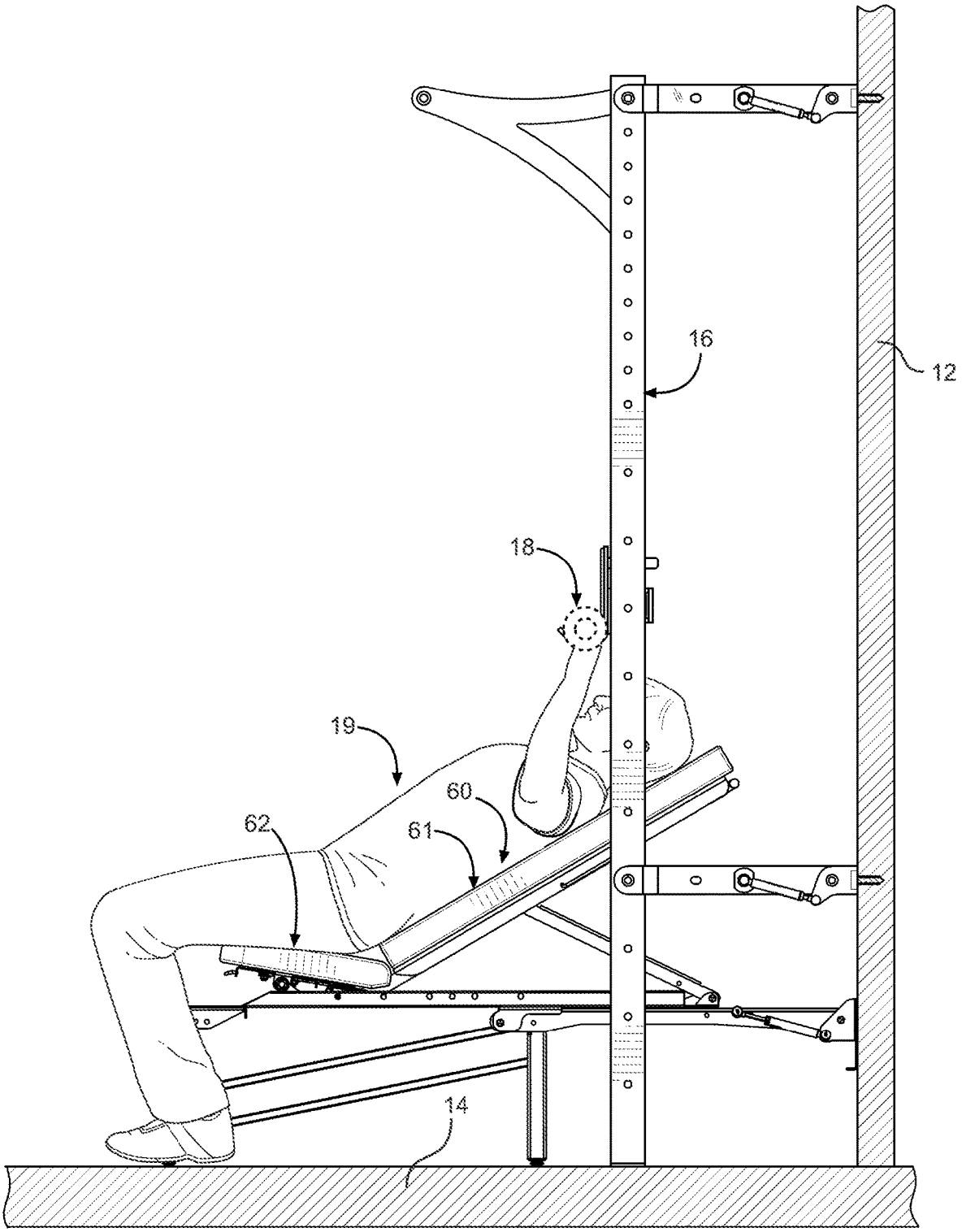
FIG. 44 is a side view of an example embodiment attached to a wall between support members of an exercise rack in a fully extended position with the bench in a partially inclined state with a weightlifter positioned on the bench grasping the barbell for an incline bench press exercise.
Figure 45:
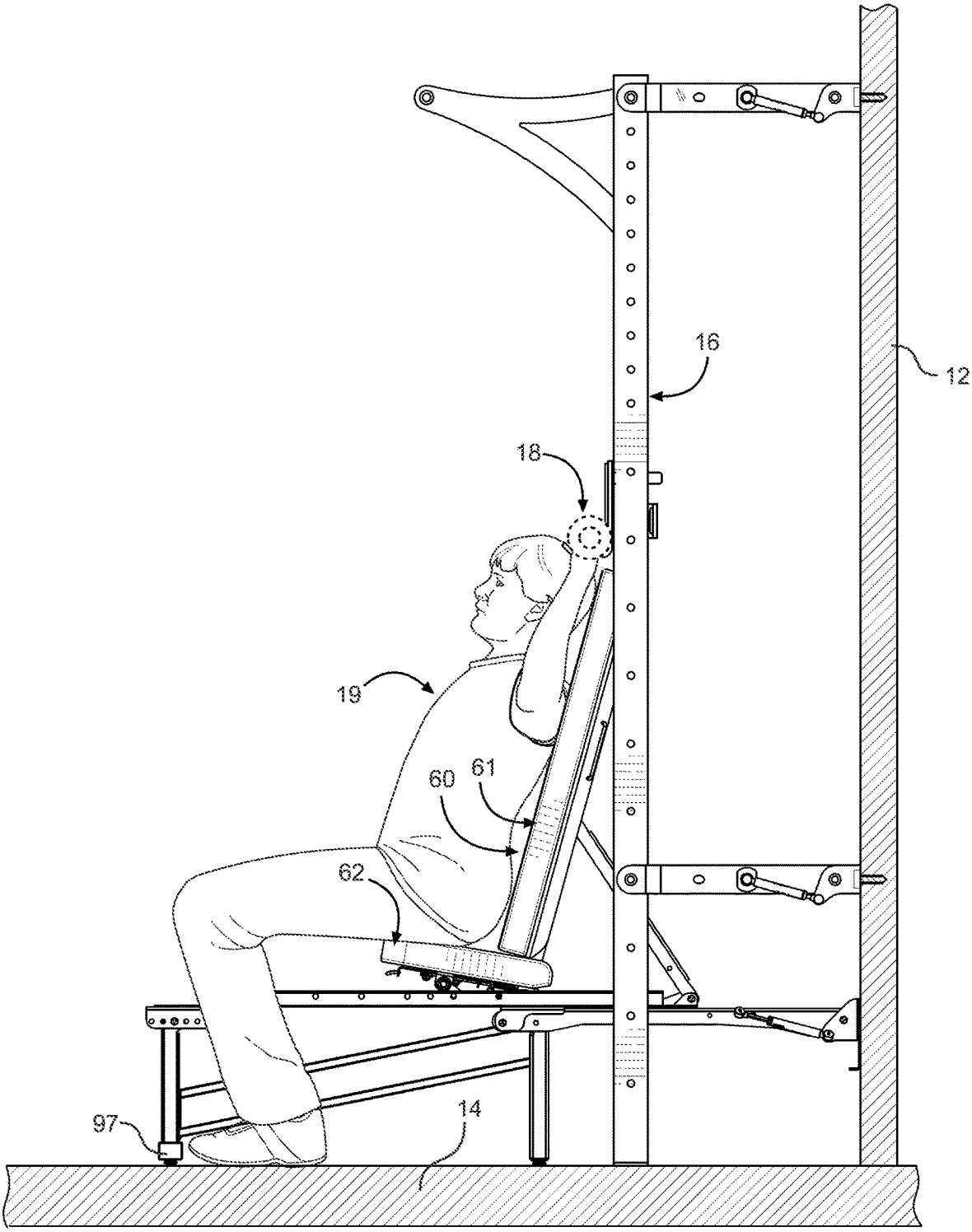
FIG. 45 is a side view of an example embodiment attached to a wall between support members of an exercise rack in a fully extended position with the bench in a fully inclined state with a weightlifter positioned on the bench grasping the barbell for an incline bench press exercise.

In one or more of the various embodiments disclosed herein, the seat portion 62 moves rearwardly toward the wall and the upper portion of the torso portion 61 moves away from the wall as the incline is increased to ensure that the exerciser 19 is properly positioned for lifting a barbell 18 supported on the vertical support members of the rack 16 as shown for example in FIGS. 44 and 45 of the drawings. The exerciser 19 therefore doesn't have to lift the barbell 18 from the rack 16 in an uncomfortable or undesirable body position which could result in injury. In the various embodiments, the exerciser 19 also doesn't have to adjust the bench 60 since the bench 60 automatically positions the horizontal locations of the torso portion 61 and the seat portion 62 of the bench 60 so the body of the exerciser 19 positioned on the bench 60 is in a proper location and position with respect to the rack 16 and barbell 18 supported on the front vertical support members of the rack 16. When the bench 60 receives and supports the exerciser 19 in the desired position, the exerciser 19 is able to comfortable lift the barbell 18 with or without weights attached to the barbell 18 with a reduction in discomfort and a reduction for the potential of injury. The exerciser 19 therefore does not have to relocate the bench 60 with respect to the rack or an exercise machine when the angle of the bench 60 is changed.

Figure 43:
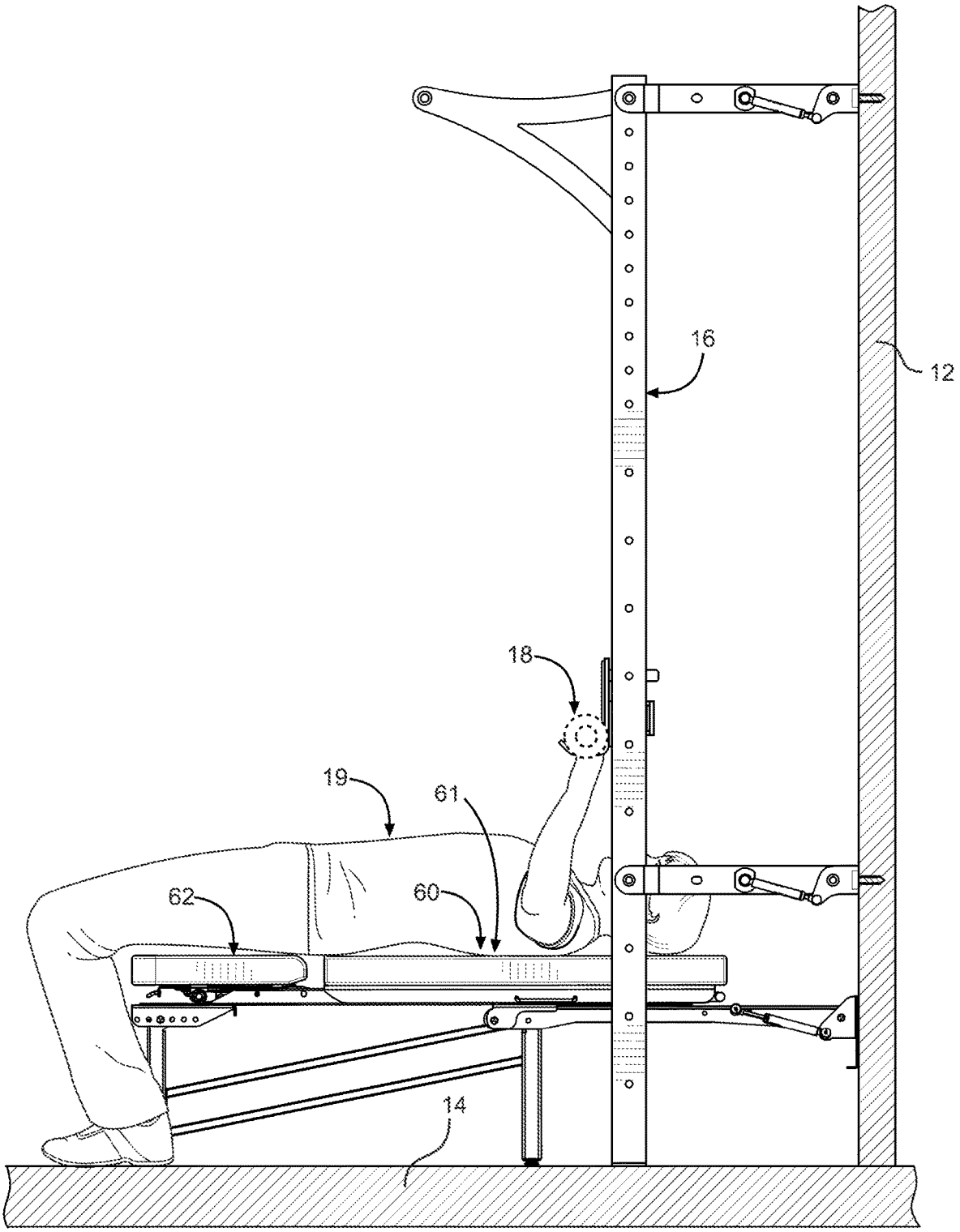
FIG. 43 is a side view of an example embodiment attached to a wall between support members of an exercise rack in a fully extended position with the bench in a flat-state with a weightlifter positioned on the bench grasping the barbell for a bench press exercise.

For example, when the bench 60 is in the flat-state shown in FIG. 43, the exerciser 19 is able to position their body in a position suitable for performing a bench press exercise to lift the barbell 18 in a substantially vertical manner in the proper exercise position. As another example, when the bench 60 is in the partially inclined state as shown in FIG. 44, the exerciser 19 is able to position their body in a position suitable for performing an incline bench press exercise at a desired angle to lift the barbell 18 in a substantially vertical manner in the proper exercise position. As another example, when the bench 60 is in the fully inclined state as shown in FIG. 44, the exerciser 19 is able to position their body in a position suitable for performing an incline bench press exercise at a desired angle to lift the barbell 18 in a substantially vertical manner in the proper exercise position.

The exerciser may move the bench 60 back to the substantially flat horizontal position or to other selected inclined positions at various times in the same manner described above to perform different exercises as desired. When finished exercising, the exerciser moves the bench 60 back into the substantially flat horizontal position. In that position, the first latch 65 automatically latches the bench 60 to the second segment 40. The exerciser then moves the bench 60 to the retracted state near the wall 12 to reduce the amount of space taken up by the bench 60 by lifting upwardly on the bench 60 so the bench 60 enters an intermediate position (see FIGS. 1B and 2B) then continues to move the bench 60 toward the wall 12 until the bench 60 is substantially parallel with the wall 12 (see FIGS. 1A and 2C).

G. Alternative Example Latch System Embodiment

An alternative example embodiment of a latch system for the bench system 10 is illustrated in FIGS. 28-35. In the alternative embodiment, the latch system comprises separate and independently operable first and second latches 102, 106 for latching and unlatching the torso and seat portions 61, 62 respectively of the bench 60 to the second segment 40.

The first latch 102 comprises a first latch operator 104 connected or attached to the torso portion 61 of the bench 60. A corresponding first latch receiver 105 is connected or attached to the second segment 40 of the bench 60. The second latch 106 comprises a second latch operator 112 connected or attached to the seat portion 62 of the bench 60. A plurality of selectable spaced second latch receivers 107 are connected, attached, or formed in the second segment 40 of the bench 60. The first latch operator 104 can be manipulated by an exerciser to separately and independently operate the first latch 102 to selectively latch and unlatch the torso portion 61 of the bench 60 from the second segment 40. The second latch operator 112 can be manipulated by an exerciser to separately and independently operate the second latch 106 to selectively latch and unlatch the seat portion 62 of the bench from the second segment 40.

Figure 30B:
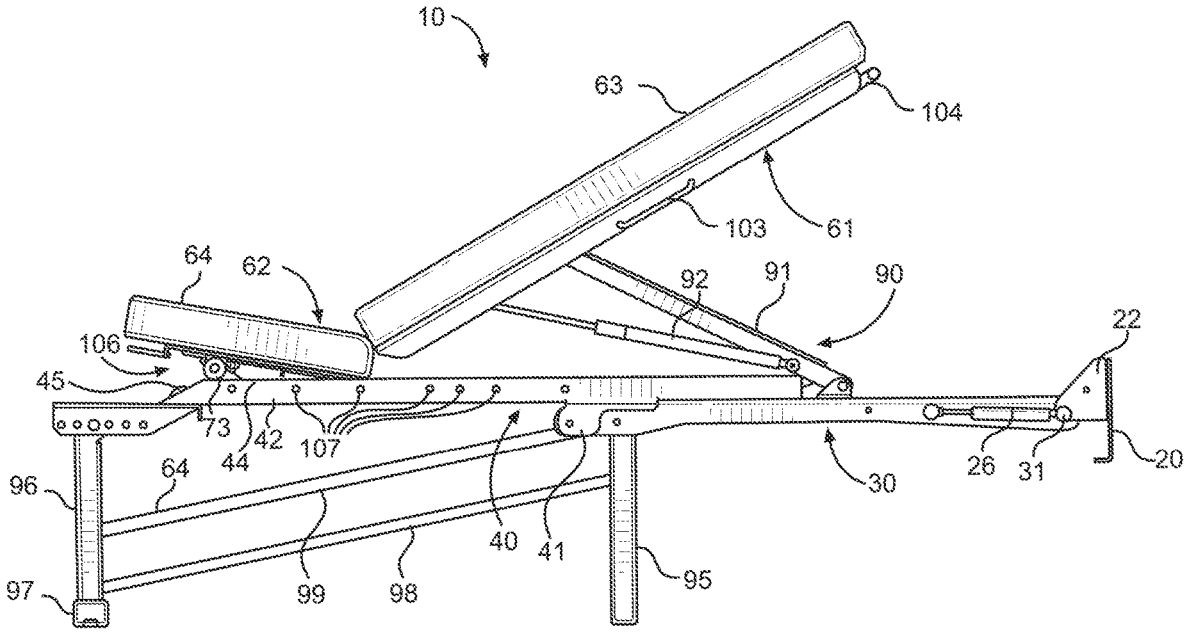
FIG. 30B is a side view of a retractable wall mountable inclinable bench in an extended state in a selected inclined position in accordance with an alternative example embodiment.
Figure 30C:
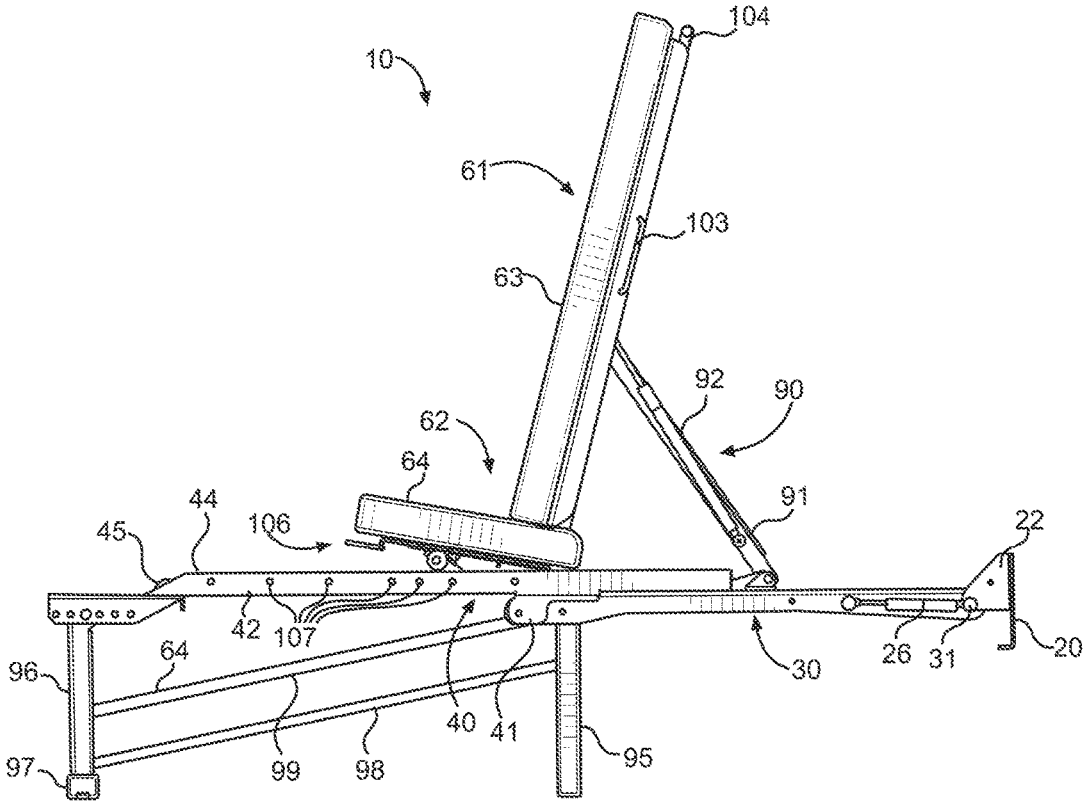
FIG. 30C is a side view of a retractable wall mountable inclinable bench in an extended state in another selected inclined position in accordance with an alternative example embodiment.

With the torso portion 61 latched to the second segment 40, the bench 60 is readily movable between a retracted compact position for storage as illustrated in FIG. 29 and an extended substantially horizontal position suitable for exercise as shown in FIG. 30A without the torso portion 61 inadvertently inclining or otherwise moving away from the second segment 40. With the bench 60 in the extended substantially horizontal position and the torso and seat portions 61, 62 unlatched from the second segment 40, the bench 60 is readily movable between the extended substantially horizontal position and a plurality of selectable inclined positions suitable for exercises. Examples of two possible different inclined positions are illustrated in FIGS. 30B and 30C. The number of second inclined positions and the degree of incline of the torso portion 61 in each such position correspond with the number and longitudinally spaced locations of the plurality of second latch receivers 107 on the second segment 40. The second latch operator 112 can also be manipulated when the bench 60 is latched to the second segment 40 in a selected second inclined position to selectively unlatch the bench 60 from the second segment 40 and move it to another selected inclined position or to return it to the first substantially flat horizontal position. It will be appreciated that in this example embodiment, the first and second latch operators 104, 112 and the corresponding first and second latches 102, 106 are separately and independently operable.

Figure 31A:
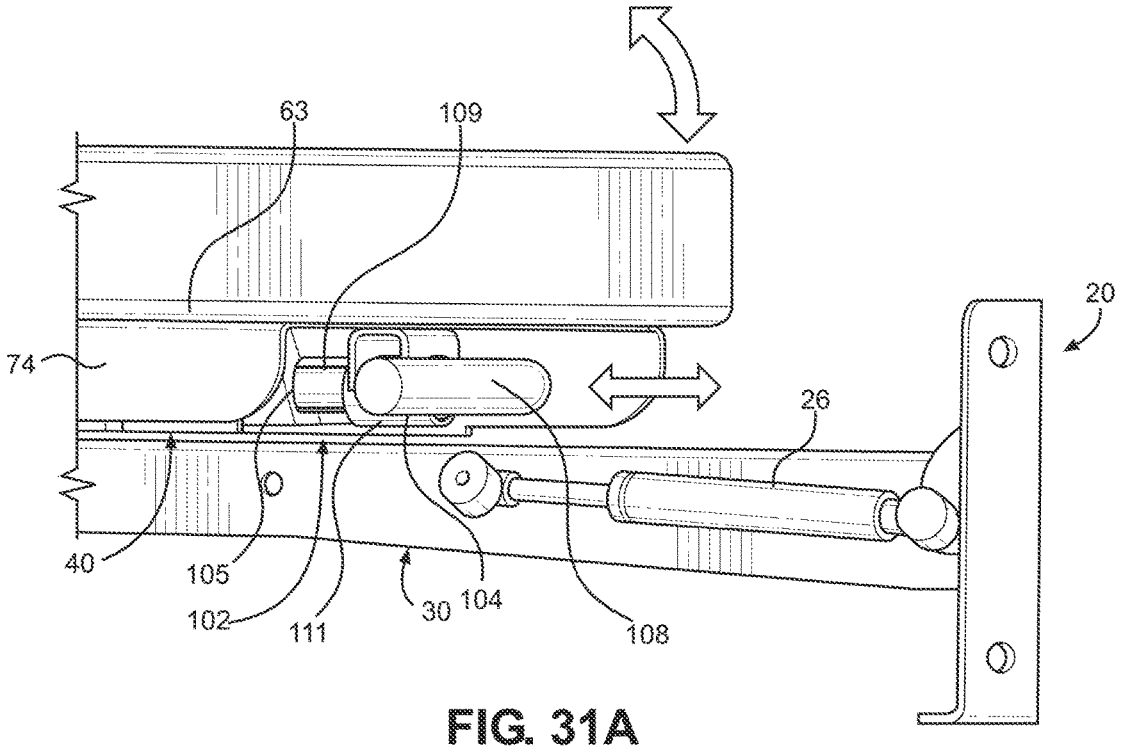
FIG. 31A is a partial enlarged view of a retractable wall mountable inclinable bench showing a first latch in an engaged position relative to a first latch receiver in accordance with an alternative example embodiment.
Figure 31B:
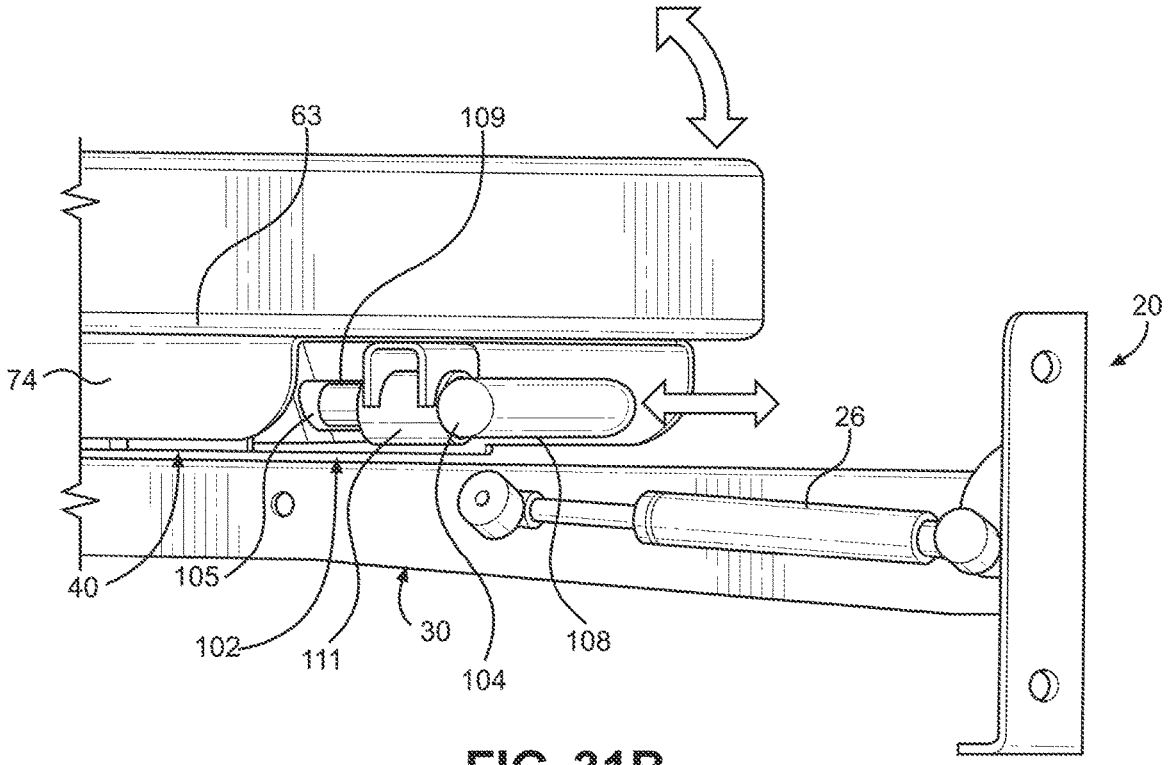
FIG. 31B is a partial enlarged view of a retractable wall mountable inclinable bench showing a first latch in an intermediate position relative to a first latch receiver in accordance with an alternative example embodiment.
Figure 31C:
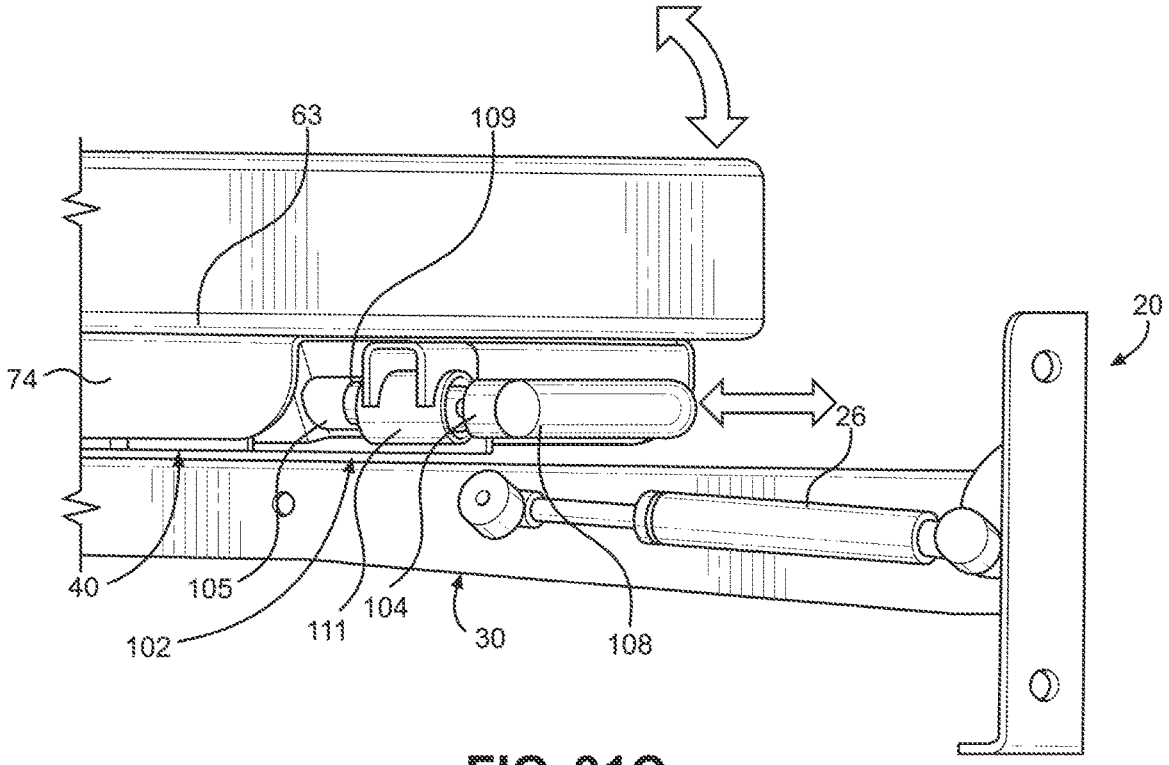
FIG. 31C is a partial enlarged view of a retractable wall mountable inclinable bench showing a first latch in a disengaged position relative to a first latch receiver in accordance with an alternative example embodiment.
Figure 32:
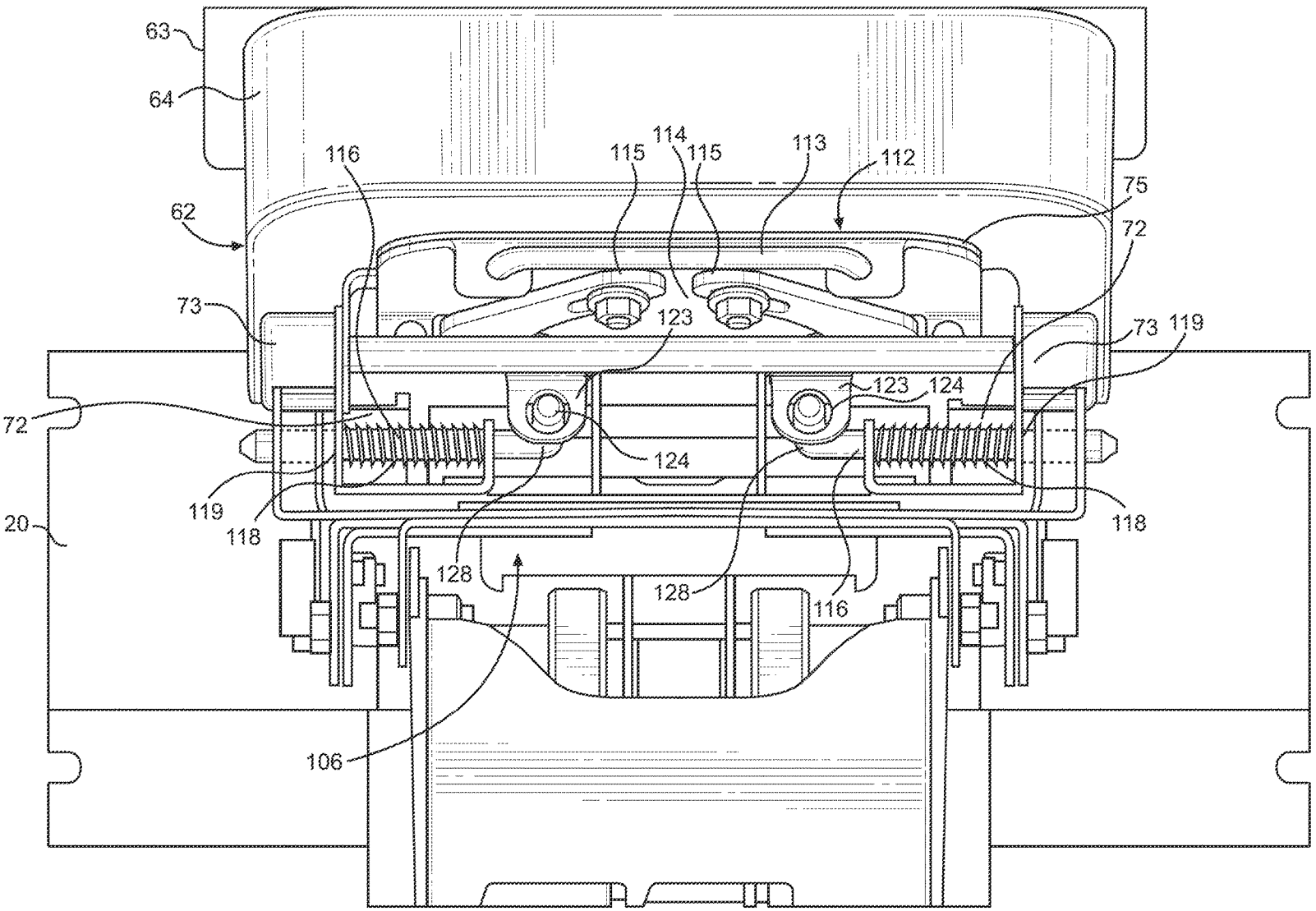
FIG. 32 is a partial front bottom perspective view of a retractable wall mountable inclinable bench showing components of a second latch in an engaged position relative to a second latch receiver in accordance with an alternative example embodiment.

The first latch 102 comprises a first latch operator 104. The first latch operator 104 is connected or attached to the torso portion 61 of the bench and more specifically to the backing or mounting plate 74 of the torso portion as best illustrated in FIGS. 31A-31C. The first latch operator 104 may be connected or attached to the mounting plate 74 in any suitable fashion, for example via a bracket or the like. Preferably the first latch operator 104 is connected or attached to the torso portion 61 in a location that is accessible to an exerciser to selectively manipulate the first latch operator 104 and hence selectively operate the first latch 102. For example, as illustrated in FIGS. 31A-31C, the first latch operator 104 may be connected to a surface of the mounting plate 74 beneath the torso portion 61 and at or near the rear end of the torso portion 61. The first latch operator 104 may extend partially rearward of the torso cushion 63 on the mounting plate 74 and/or may be partially recessed beneath the torso cushion 63. The first latch operator 104 should be located and positioned so as to be readily accessible to an exerciser for manipulation and so as to not interfere with movement of the bench 60 between the retracted and extended positions.

The first latch operator 104 comprises a protrusion 108, an elongated linear latch pin 109, and a body portion 111. The protrusion 108 preferably comprises a handle, knob, or similar structure that is readily graspable and manipulable by a hand of an exerciser. In a preferred embodiment, the protrusion 108 comprises a substantially t-shaped handle as best illustrated in FIGS. 31A-31C. The latch pin 109 has a first rearward end that is connected to the protrusion 108 and a second forward end that is free. The latch pin 109 extends longitudinally, preferably substantially parallel with the longitudinal axis of the bench 60, from the protrusion 108 through the body portion 111. The latch pin 109 is movable longitudinally in and through the body portion 111 via manipulation of the protrusion 108.

A source of bias force is preferably present to bias or urge the first latch 102 and more specifically the latch pin 109 in an engaged or latched position. The latch pin 109 is preferably movable longitudinally between the engaged or latched position and a disengaged or unlatched position against the bias force, e.g., by an exerciser manipulating and pulling the protrusion 108 in a rearward direction. The magnitude of the bias force is preferably sufficient to avoid the bench 60 inadvertently or accidentally becoming unlatched from the second segment 40 during exercise or movement of the bench 60 between the extended and retracted states. However, the magnitude is preferably such that an exerciser can relatively easily manipulate the first latch operator 104 to move the latch pin 109 to the disengaged or unlatched position in order to unlatch the bench 60 from the second segment 40. The source of the bias force may comprise a compressed spring or any other suitable source of bias force. For example, a substantially cylindrical spring can be located within the body portion 111 and the latch pin 109 can extend longitudinally through the spring. The spring can be compressed between a stop structure on an interior surface of the body portion 111 and a stop structure on an exterior surface of the latch pin 109 to provide the bias force to urge the latch pin 109 in the engaged or latched position.

The first latch receiver 105 is preferably fixedly connected or attached to the second segment 40 of the bench 60 in alignment with the first latch operator 104 and latch pin 109. For example, with the first latch operator 104 located on a lower surface of the mounting plate 74 of the torso portion 61 as described above, the first latch receiver 105 can be connected or attached to an upper surface of the second segment 40 adjacent to, forwardly of, and in longitudinal alignment with the first latch operator 104 and latch pin 109 when the torso portion 61 is positioned proximal and parallel to the second segment 40 as illustrated in FIGS. 31A-31C. The first latch receiver 105 may be connected or attached to the second segment 40 in any suitable manner.

The first latch receiver 105 can comprise a rigid plate or similar structure with a surface and an opening in the surface. The plate can extend upwardly from the second segment 40 and the opening is preferably arranged to be aligned with the latch pin 109 when the torso portion 61 is in a position proximal and parallel with the second segment 40. The first latch receiver 105 and more specifically the opening is adapted to receive and retain the forward free end of the latch pin 109 when the latch pin 109 is in the engaged or latched position in order to latch the torso portion 61 of the bench 60 to the second segment 40. When the latch pin 109 is retracted against the bias force to the disengaged or unlatched position, the forward free end of the latch pin 109 is clear of the first latch receiver 105 and more specifically the opening, and the torso portion 61 is unlatched from the second segment 40 and free to be pivoted to an upwardly inclined position relative to the second segment 40.

As best illustrated in FIG. 31A, with the torso portion 61 of the bench 60 proximal and parallel to the second segment 40, the latch pin 109 of the first latch operator 104 is biased in the engaged or latch position and the forward free end of the latch pin 109 is retained in the first latch receiver 105. The torso portion 61 of the bench 60 is latched to the second segment 40 and is prevented by the first latch 102 from pivoting upwardly from the second segment 40 (in the direction of the arcuate arrow) to an inclined position. In this configuration, the bench 60 is readily moved between a substantially vertical compact retracted position for storage as illustrated in FIG. 29 and an extended substantially horizontal position suitable for exercise as illustrated in FIG. 30A.

An exerciser can manipulate the protrusion 108 of the first latch operator 104, for example by grasping it and pulling it rearward against the bias force, to selectively unlatch the torso portion 61 from the second segment 40. As the exerciser pulls the protrusion rearward in the direction of the horizontal arrow in FIGS. 31A-31C, the latch pin 109 begins to longitudinally retract rearwardly from the first latch receiver 105 as illustrated in FIG. 31B and continues until it is clear of the first latch receiver as illustrated in FIG. 31C. The torso portion 61 of the bench 60 is then unlatched and may be readily pivoted by the exerciser upwardly in the direction of the arcuate arrow relative to the second segment 40 to an inclined position that is suitable for exercise.

When the exerciser releases the protrusion 108, the bias force urges the latch pin 109 back into the engaged or latched position. If the first latch operator 104 and latch pin 109 are in alignment with the first latch receiver 105 when that occurs, then the torso portion 61 becomes latched to the second segment 40 again. If not, for example when the torso portion 61 is in an upwardly inclined position, then the torso portion 61 remains unlatched and is free to be pivoted upwardly and downwardly relative to the second segment 40 in the direction of the arcuate arrows. Accordingly, the torso portion 61 can be selectively pivoted to a plurality of selected inclined positions as described further below and illustrated in FIGS. 30B-30C, and can also be pivoted back to the extended horizontal position proximal and parallel to the second segment 40 as illustrated in FIG. 30A.

The first latch 102 is preferably adapted and configured to automatically relatch the torso portion 61 to the second segment 40 without any manual manipulation of the first latch operator 104 when the torso portion 61 is pivoted downwardly from a selected upwardly inclined position back to the extended horizontal position proximal and parallel to the second segment 40. The surface of the rigid plate or another surface of the first latch receiver 105 is preferably configured to be angled upwardly with respect to the second segment 40. The upwardly angled surface is adapted to engage the forward free end of the latch pin 109 of the first latch operator 104 as it descends toward the second segment 40 and to guide it to the opening of the first latch receiver 105. As the forward free end of the latch pin 109 engages the angled surface, the angled surface functions as a strike plate and causes the latch pin 109 to automatically retract rearwardly against the bias force. This continues until the latch pin 109 has descended into alignment with the opening of the first latch receiver 105. Once the forward free end of the latch pin 109 is no longer in engagement with the angled surface, the bias force automatically forces the forward free end into the opening and automatically relatches the torso portion 61 to the second segment 40.

It will be appreciated that while in this alternative embodiment, the first latch 102 comprises a single latch operator 104 and a single corresponding latch receiver 105, the first latch 102 may comprise one or any number of latch operators 104 and corresponding latch receivers 105. Further, the one or more latch operators 104 and corresponding latch receivers 105 may be positioned in any desired locations on the torso portion 61 of the bench 60 and the second segment 40 so long as consistent with providing the functionality described herein. Still further, multiple latch operators 104 may be configured to be operable together or separately and independently of each other to cause the first latch 102 to be in the latched or unlatched position. It will also be appreciated that while in this embodiment the first latch operator 104 is directly manipulated by an exerciser to latch and unlatch the first latch 102, the first latch operator 104 may be configured to be operated by a motor, solenoid or similar means and may be configured to be remotely actuated by hardwired or wireless means, e.g., wireless transceiver, to latch and unlatch the first latch 102. All of the foregoing modifications can be made without departing from the spirit and scope of the present disclosure.

As best illustrated in FIGS. 32, 33A-33C, 34A-34C, and 35, the second latch 106 comprises a second latch operator 112, latch pins 116, and a plurality of corresponding spaced second latch receivers 107. The second latch 106 and the second latch operator 112 are movably connected or attached to the seat portion 62 of the bench 60. As described previously, the seat portion 62 includes a mounting plate 75 with substantially planar upper and opposite lower surfaces. The seat cushion 64 is fixedly connected or attached to the upper surface and the lower surface is beneath and faces an upper surface of the second segment 40. The second latch 106 and second latch operator 112 are connected or attached to the lower surface of the mounting plate 75 beneath the seat cushion 64 and between the mounting plate 75 and an upper surface of the second segment 40 of the bench 60.

The second latch 106 and second latch operator 112 are movable relative to the seat portion 62 and the second segment 40. As described further below, the second latch operator 112 is accessible to and manipulable by an exerciser to be selectively moved relative to the seat portion 62 of the bench 60 and the second segment 40 to cause the second latch 106 to move between an engaged or latched position and a disengaged or unlatched position. When the second latch 106 is in the engaged or latched position, the seat portion 62 of the bench 60 can be latched to the second segment 40 with the bench 60 proximal and parallel with the second segment 40. In this position, the bench 60 can be readily moved between a retracted compact position for storage as illustrated in FIG. 29 and an extended substantially horizontal position suitable for exercise as illustrated in FIG. 30A without the seat portion 62 of the bench 60 moving along the track 42 and becoming upwardly inclined relative to the second segment 40 as described previously herein.

Figure 28:
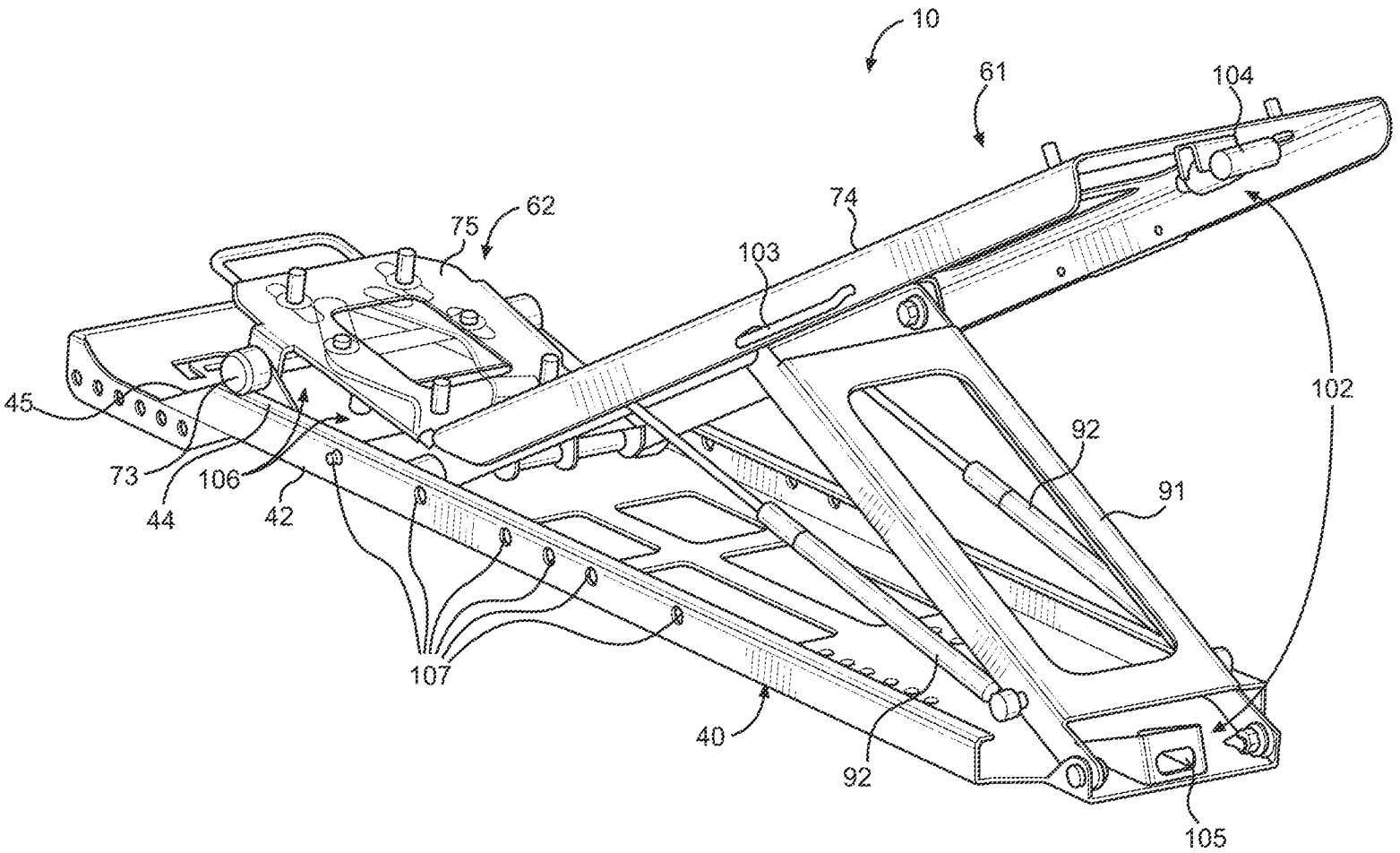
FIG. 28 is a rear perspective view of a retractable wall mountable inclinable bench in an extended state in a selected inclined position illustrated without pads to reveal various components in accordance with an alternative example embodiment.

Also when the second latch 106 is in the engaged or latched position, the seat portion 62 of the bench 60 can be latched to the second segment 40 with the bench 60 in one of a plurality of selected upwardly inclined positions in relation to the second segment 40 as illustrated in FIGS. 28, 30B, and 30C. In these positions, the bench 60 can be used for various exercises without concern that the seat portion 62 of the bench 60 may move out of the selected position along the track 42.

The second latch operator 112 comprises a protrusion 113, a movable connector 114, and a pair of movable operators 115. The protrusion 113 is fixedly connected to the movable connector 114. The movable connector 114 is movably connected to the lower surface of the mounting plate 75 and to the pair of movable operators 115. The movable operators 115 in turn movably engage a pair of latch pins 116 that are adapted and configured to be received and retained in the plurality of second latch receivers 107 to latch the seat portion 62 to the second segment 40.

The protrusion 113 is adapted to be grasped and manipulated by an exerciser to impart movement to the movable connector 114. The protrusion 113 may comprise a handle, knob, or other structure suitable for that purpose. The protrusion 113 may also comprise a single structure or multiple structures consistent with providing the described functionality. The protrusion 113 may be fixedly connected or attached to the movable connector 114 in any suitable manner and may be integrally formed with the movable connector 114. The protrusion 113 may be located to be partially or wholly recessed beneath the seat cushion 64 and/or to partially extend and be exposed forwardly from the front end portion of the seat cushion 64 so long as it is accessible and manipulable by an exerciser.

The movable connector 114 may comprise a substantially planar plate having an upper surface, a lower surface, a front end portion, a rear end portion, a first side portion between the front and rear end portions, and a second side portion between the front and rear end portions. The protrusion 113 is preferably connected or attached to the movable connector 114 at or near the front end portion. The movable connector 114 is movably connected to the mounting plate 75 with the upper surface of the movable connector 114 abutting or adjacent to the lower surface of the mounting plate 75. The second latch operator 112 and more specifically the movable connector 114 is preferably movable in relation to the mounting plate 75 and the second segment 40 in a first direction toward the front end portion of the seat portion 62 and in a second opposite direction toward the rear end portion of the seat portion 62. When moved toward the front end portion, the second latch operator 112 causes the second latch 106 to move to the disengaged or unlatched position and when moved toward the rear end portion the second latch operator 112 causes the second latch 106 to move the engaged or latched position.

The motion of the second latch operator 112 and more specifically the movable connector 114 in the first and second directions is preferably linear and preferably parallel to the longitudinal axis of the bench 60. The second latch operator 112 and more specifically the movable connector 114 may have a longitudinal axis between its first and second end portions that is substantially coaxial with the longitudinal axis of the bench 60.

In order to provide the linear motion of the second latch operator 112 relative to the mounting plate 75 and the second segment 40, the movable connector 114 is provided with a first linear sliding connection 120 with the mounting plate 75. The first linear sliding connection 120 may comprise a pair of linear slots formed in the movable connector 114 and a corresponding pair of fixed pins, studs, or bolts that protrude downwardly from the lower surface of the mounting plate 75, extend through the linear slots and are movably retained therein. For example, the pins, studs, or bolts may be movably retained in the linear slots by nuts, washers, caps, or the like. As the movable connector 114 moves toward the front end portion and the rear end portion of the seat portion 62 of the bench 60, the pins, studs, or bolts guide it along a linear path defined by the linear slots. It will be appreciated that different paths of motion may be used and need not be linear and that the paths of motion are defined by the shapes of the slots. It will also be appreciated that the longitudinal length or range of travel of the second latch operator 112 is determined by the length of the slots.

At the same time the second latch operator 112 and more specifically the movable connector 114 moves linearly in the direction of the longitudinal axis of the bench 60, the second latch operator 112 also automatically rotates or pivots relative to the mounting plate 75 and the second segment 40. The pivoting motion of the second latch operator 112 causes latch pins 116 to move between a disengaged or unlatched position and an engaged or latched position in relation to second latch receivers 107 in a manner described further below.

In order to provide the rotational or pivoting motion of the second latch operator 112, the second latch operator 112 comprises a pair of movable operators 115 that are movably connected to the movable connector 114. Each movable operator 115 may be shaped as a substantially flat elongated curved arm with an upper surface, a lower surface, a first end and a second end opposite the first end. Each movable operator 115 is connected to the movable connector 114 with its upper surface abutting or adjacent to the lower surface of the movable connector 114. Each movable operator 115 may be connected to the movable connector 114 by a second linear sliding connection 121 and by a rotational or pivoting connection 122. One movable operator 115 is connected to the movable connector 114 nearer the first side portion of the movable connector 114 and the other movable operator is connected to the movable connector 114 nearer the second side portion. The movable operators 115 are connected to the movable connector 114 with their respective first ends closer to the front end portion of the movable connector 114 and their second ends closer to the rear end portion of the movable connector 114.

The second linear sliding connection 121 is located at or near the first end of each movable operator 115 and the rotational or pivoting connection 122 is located between the first and second ends of each movable operator 115. The second linear sliding connection 121 may comprise a slot formed in the movable operator 115 and a fixed pin, stud, or bolt that protrudes downwardly from the lower surface of the movable connector 114, extends through the slot and is movably retained therein. The pin, stud or bolt of the second linear sliding connection 121 may be movably retained in the slot in the same manner described above with respect to the first linear sliding connection. The slot of the second linear sliding connection 121 is preferably arranged at an angle with respect to the longitudinal axis of the movable connector 114 and the bench 60 for reasons which will become clear from the further description below.

The rotational or pivoting connection 122 is located between the first and second end of each movable operator 115. Depending on the shape of the movable operator 115, the rotational or pivoting connection 122 may be located at or near a mid-point between the first and second end. The rotational or pivoting connection 122 may comprise an opening in the movable operator 115 and a fixed pin, stud, or bolt that protrudes downwardly from the lower surface of the movable connector 114, extends through the opening and is rotatably retained therein. The pin, stud or bolt of the rotational or pivoting connection 122 may be rotatably retained in the opening in the same or a similar manner as described above with respect to the first and second linear sliding connections 120, 121.

As best illustrated in FIGS. 33A-33C and 34A-34C, as the second latch operator 112 and more specifically the movable connector 114 moves away from the rear end portion seat portion 62 of the bench 60 and the toward the front end portion, the fixed pin, bolt, or stud of the second linear sliding connection 121 of each movable operator 115 moves linearly toward the front end portion as well. As the fixed pin, bolt, or stud moves linearly toward the front end portion, it engages a side of the angled slot at or near the first end of the movable operator 115. This causes the respective first ends of the movable operators 115 to move outwardly away from each other and toward the respective first and second side portions of the movable connector 114 as the movable operators 115 rotate or pivot about their respective rotational or pivoting connections 122 in a first direction. The rotational or pivoting movement simultaneously causes the second ends of the movable operators 115 to move inwardly toward each other.

Similarly, as the second latch operator 112 and more specifically the movable connector 114 moves away from the front end portion of the seat portion 62 and toward the rear end portion, the fixed pin, bolt, or stud of the second linear sliding connection 121 moves linearly toward the rear end portion and engages a second opposite side of the angled slot. This causes the respective first ends of the movable operators 115 to move inwardly toward each other and the respective second ends of the movable operators 115 to simultaneously move outwardly away from each other as the movable operators 115 rotate or pivot about their respective rotational or pivoting connections 122 in a second direction opposite of the first direction.

Each movable operator 115 comprises a connection at or near its second end to a latch pin 116. The latch pins 116 are described in further detail below. As the second ends of the movable operators 115 move toward each other as described above, they cause the latch pins 116 to retract inwardly away from the corresponding second latch receivers 107 of the second segment 40 toward and ultimately into a disengaged or unlatched position. Conversely, as the second ends of the movable operators 115 move away from each other, they cause the latch pins 116 to move outwardly toward the corresponding second latch receivers 107 of the second segment 40 and ultimately into an engaged or latched position wherein the latch pins 116 are received and retained in a selected second latch receiver 107.

The connection at or near the second end of the movable operator 115 may comprise a flange 123 that extends downwardly below the lower surface of the movable operator 115. The flange 123 may have an opening 124 that is adapted and configured to receive and retain an end of a latch pin 116. Thus, as the second end of the movable operator 115 moves inwardly and outwardly relative to the mounting plate 75 and the second segment 40, the connected pin 116 is caused to also move inwardly and outwardly relative to the second latch receivers 107 on the second segment 40.

Figure 33A:
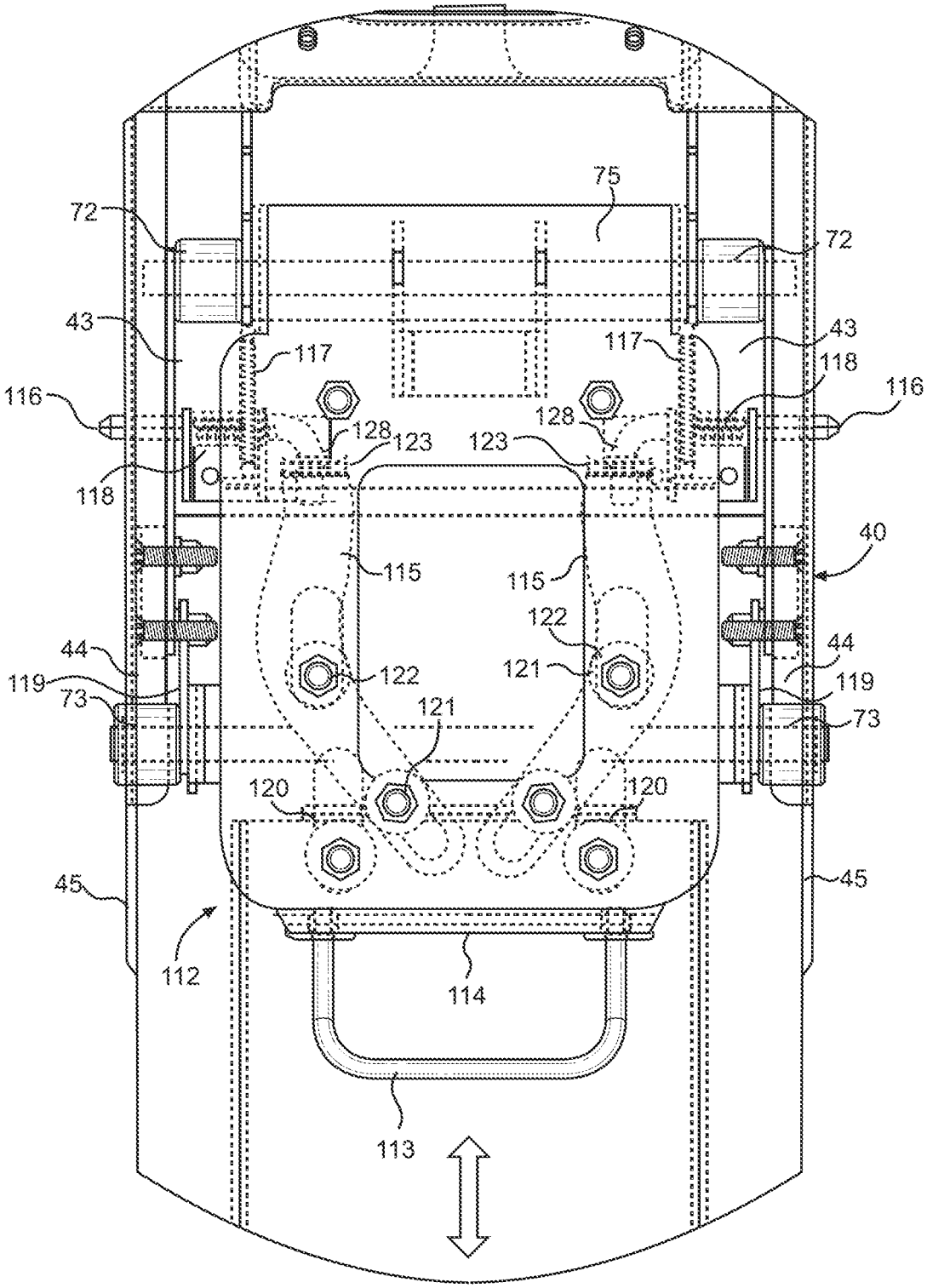
FIG. 33A is a partial top view of a retractable wall mountable inclinable bench illustrated without pads and partially transparent to reveal various components of a second latch in an engaged position relative to a second latch receiver in accordance with an alternative example embodiment.
Figure 34A:
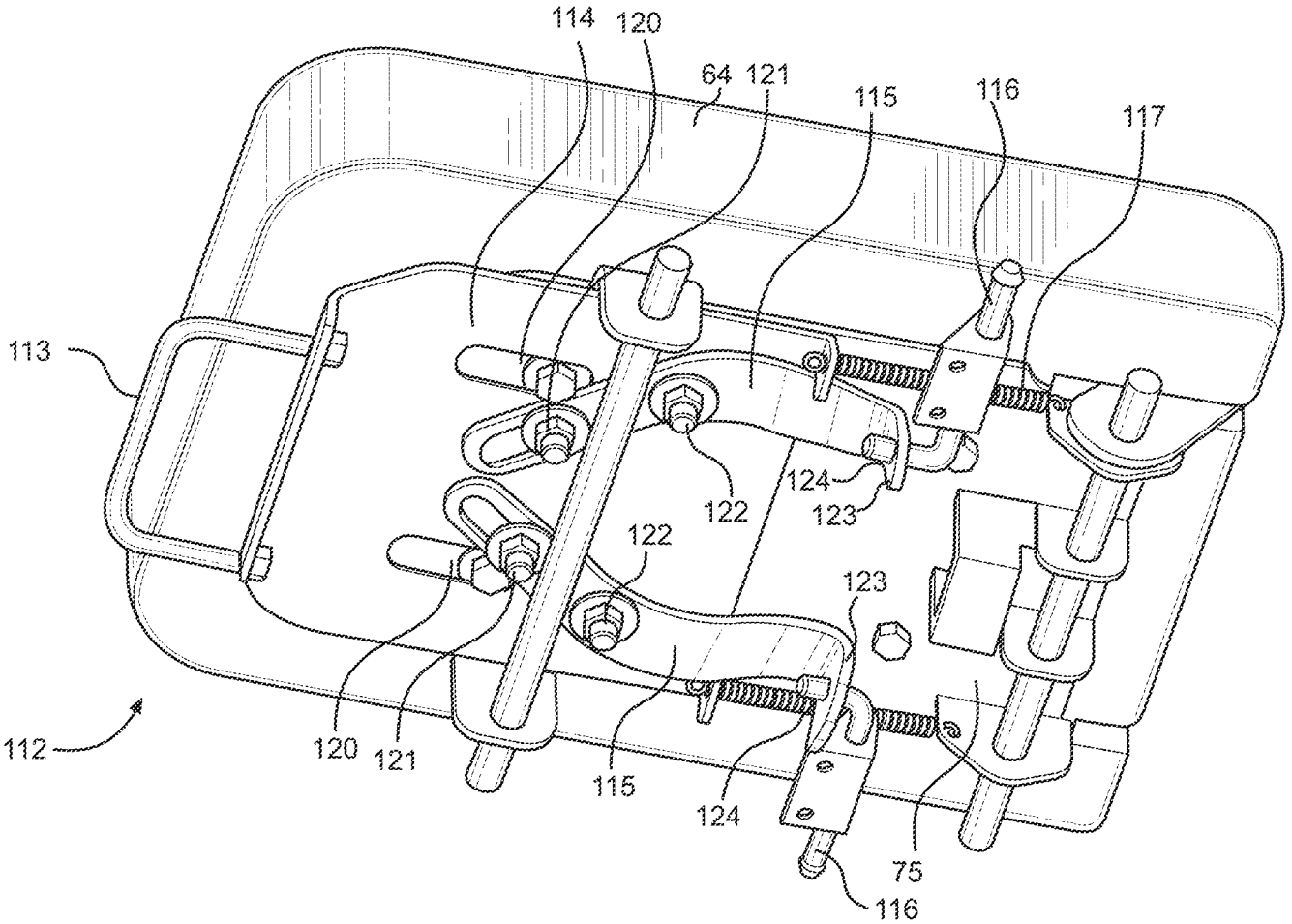
FIG. 34A is a partial bottom side perspective view of a retractable wall mountable inclinable bench showing various components of a second latch in an engaged position relative to a second latch receiver in accordance with an alternative example embodiment.
Figure 34B:
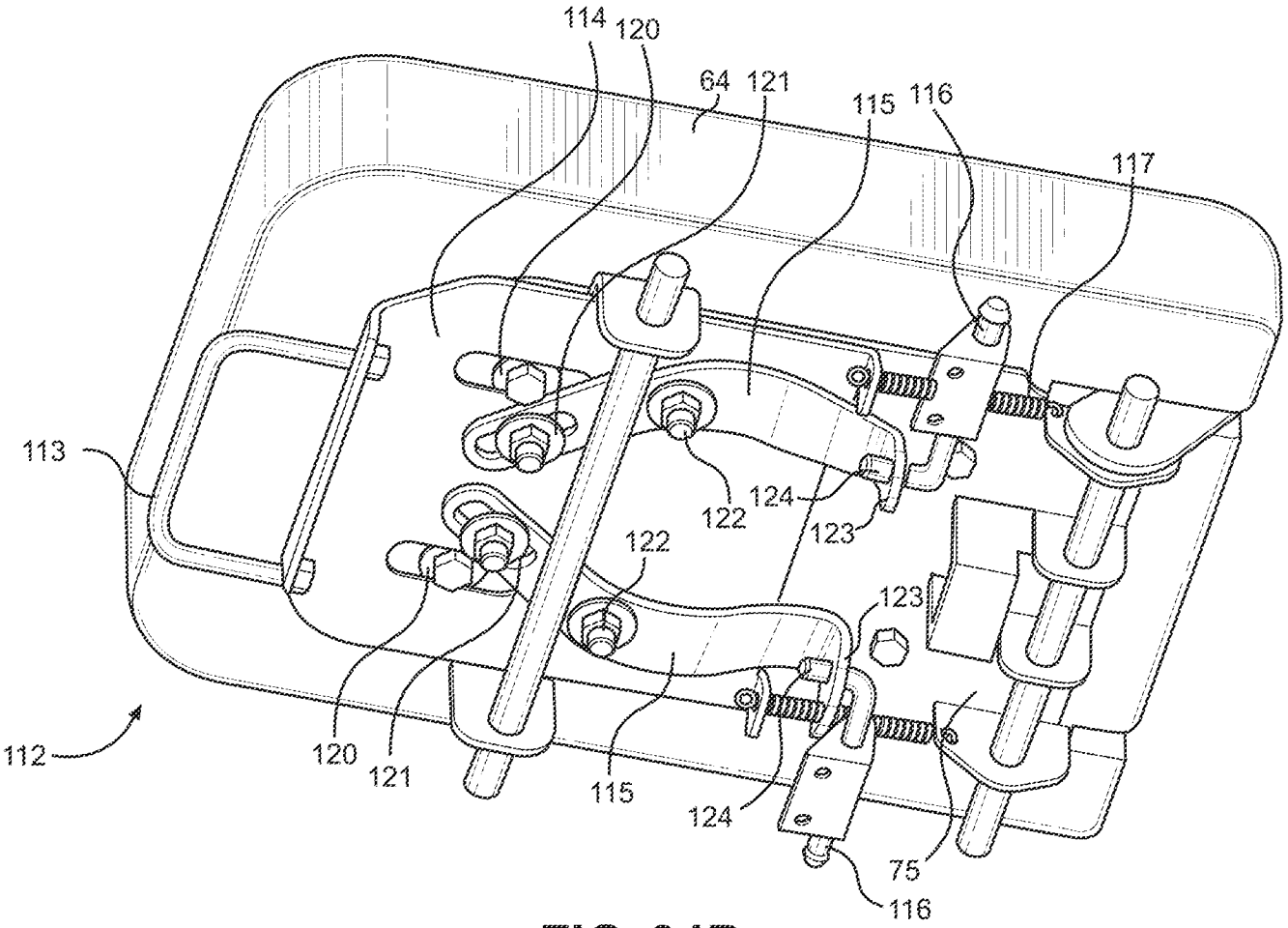
FIG. 34B is a partial bottom side perspective view of a retractable wall mountable inclinable bench showing various components of a second latch in an intermediate position relative to a second latch receiver in accordance with an alternative example embodiment.
Figure 34C:
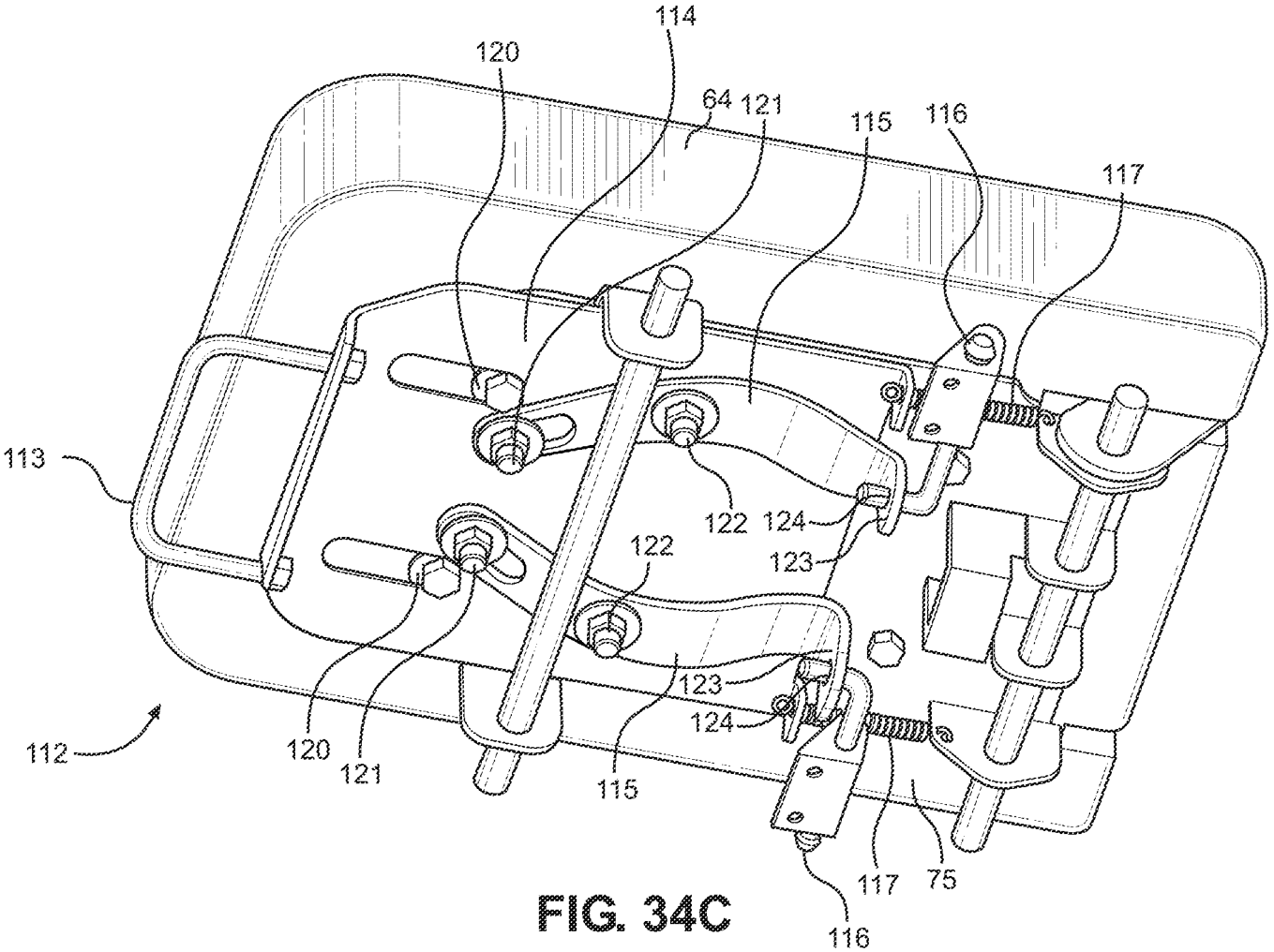
FIG. 34C is a partial bottom side perspective view of a retractable wall mountable inclinable bench showing various components of a second latch in a disengaged position relative to a second latch receiver in accordance with an alternative example embodiment.

The second latch operator 112 may and preferably does comprise a source of a bias force to urge the second latch operator 112 in the position illustrated in FIGS. 33A and 34A wherein the second latch operator 112 is nearest the rear end portion of the seat portion 62 of the bench 60 and the second latch 106 is in the engaged or latched position. The source may comprise one or more first bias springs 117 or any other suitable source of a bias force. The one or more first bias springs 117 may be connected between the movable connector 114 and the fixed mounting plate 75 of the seat portion 62 or a structure connected or attached thereto. In an example embodiment, the movable connector 114 may be provided with one or more flanges that extend downwardly from its lower surface. One or more first bias springs 117 may be connected between the one or more flanges and one or more locations on or connected to the mounting plate 75, such as the rear axle mounts as illustrated in FIGS. 34A-34C and described previously herein.

Figure 33B:
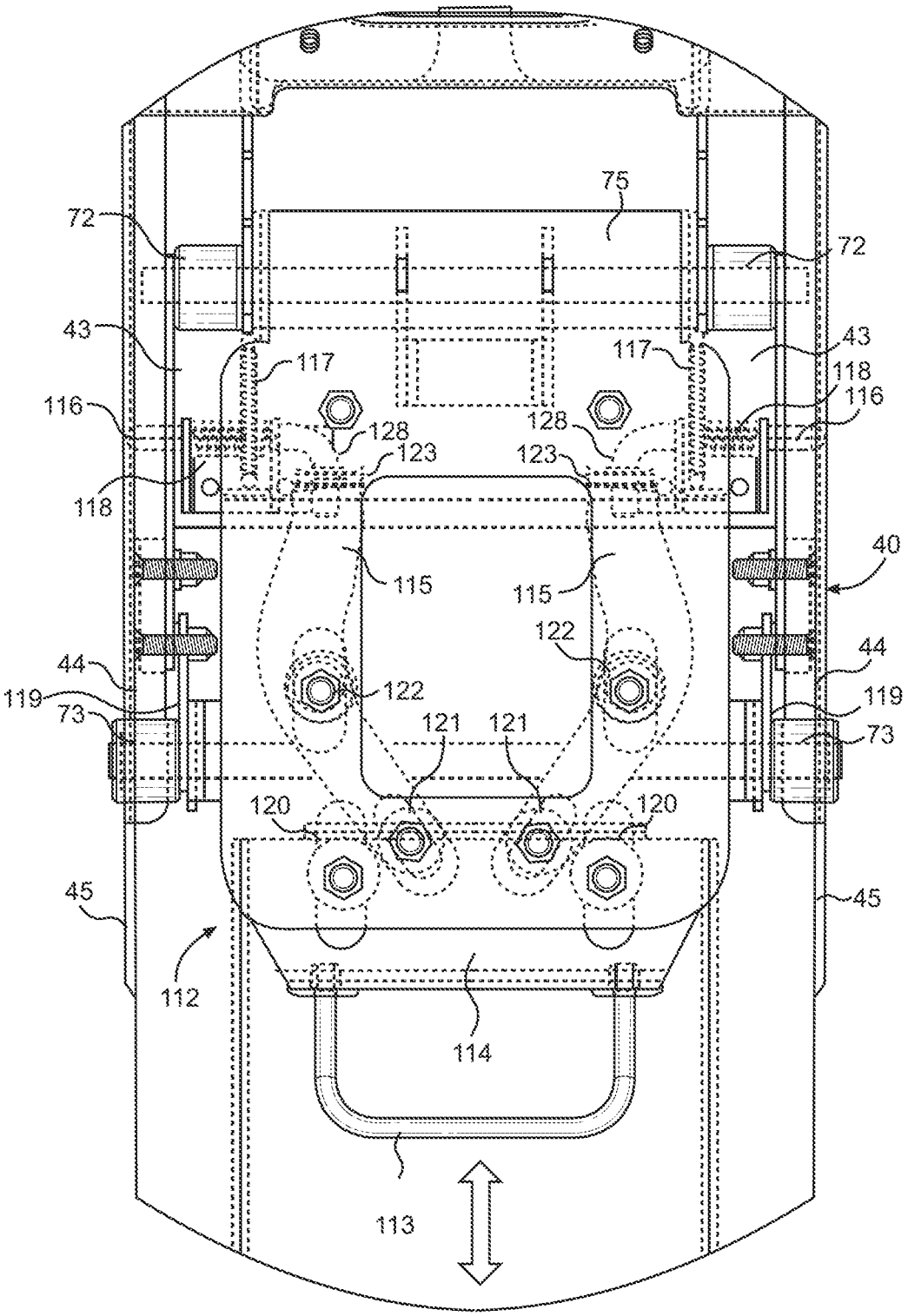
FIG. 33B is a partial top view of a retractable wall mountable inclinable bench illustrated without pads and partially transparent to reveal various components of a second latch in an intermediate position relative to a second latch receiver in accordance with an alternative example embodiment.
Figure 33C:
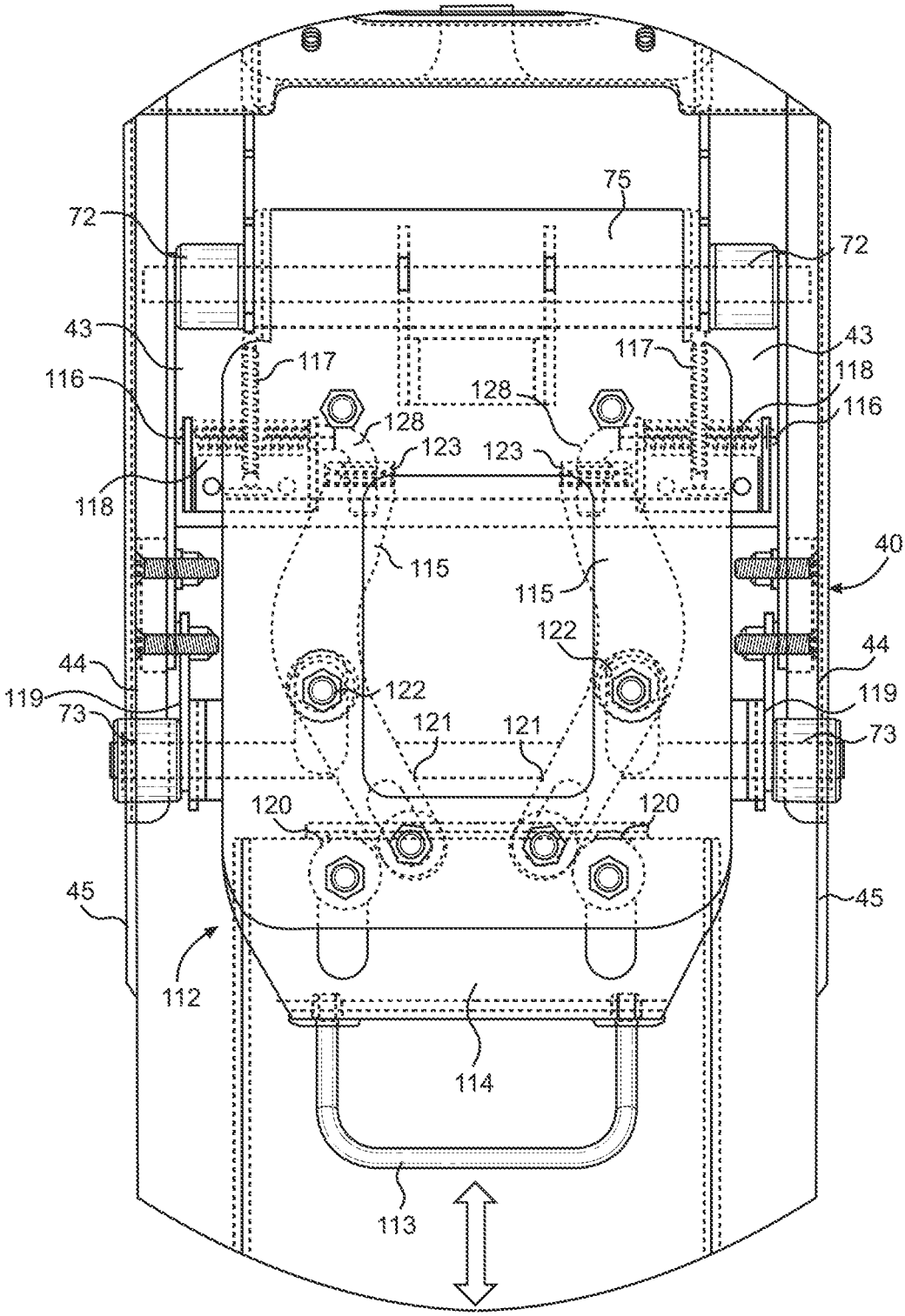
FIG. 33C is a partial top view of a retractable wall mountable inclinable bench illustrated without pads and partially transparent to reveal various components of a second latch in a disengaged position relative to a second latch receiver in accordance with an alternative example embodiment.

The bias force provided by the one or more first bias springs 117 is preferably sufficiently great to maintain the second latch operator 112 in the position illustrated in FIGS. 33A and 34A with the second latch 106 in the engaged or latched position unless and until a sufficient force is imparted by an exerciser to the protrusion 113 of the second latch operator 112 to overcome the bias force. When an exerciser applies sufficient pulling force to the protrusion 113 in the direction of the front end portion of the seat portion 62, the second latch operator 112 begins to move toward the front end portion of the seat portion 62 against the bias force as illustrated in FIGS. 33B and 34B. As the exerciser continues to apply the pulling force, the second latch operator 112 continues to move toward the front end portion and ultimately reaches a position nearest the front end portion where the second latch 106 is in the disengaged or unlatched position as illustrated in FIGS. 33C and 34C.

The second latch 106 also comprises one or more latch pins 116, for example a pair of latch pins 116. Each latch pin 116 comprises an elongated pin or rod with a first end, a second end opposite of the first end, and a longitudinal axis between the first and second ends. In the alternative example embodiment, the latch pins 116 are located opposite each other at or near the opposite first and second sides of the seat portion 62 of the bench 60 with their respective longitudinal axes approximately perpendicular to the longitudinal axis of the seat portion 62 and the second latch operator 112. Their respective first ends extend outwardly from opposite sides of the second latch operator 112 toward the opposite first and second sides of the second segment 40, and their respective second ends extend inwardly toward the second ends of the corresponding movable operators 115. The first ends of the latch pins 116 are adapted and configured to be received and retained in the plurality of second latch receivers 107 on the second segment 40 to latch the seat portion 62 to the second segment 40. The second ends are adapted and configured to be connected to the second ends of the corresponding movable operators 115.

For connection to the second end of the corresponding movable operator 115, the second end of each latch pin 116 comprises a bent portion 128. The bent portion 128 is adapted and configured to extend into and to be retained within the opening 124 in the flange 123 at or near the second end of the corresponding movable operator 115 as described above. Accordingly, as the second ends of the movable operators 115 move inwardly and outwardly, the corresponding latch pins 116 are caused to move inwardly and outwardly relative to the second latch receivers 107 on the second segment 40 between unlatched and latched positions.

Figure 35:
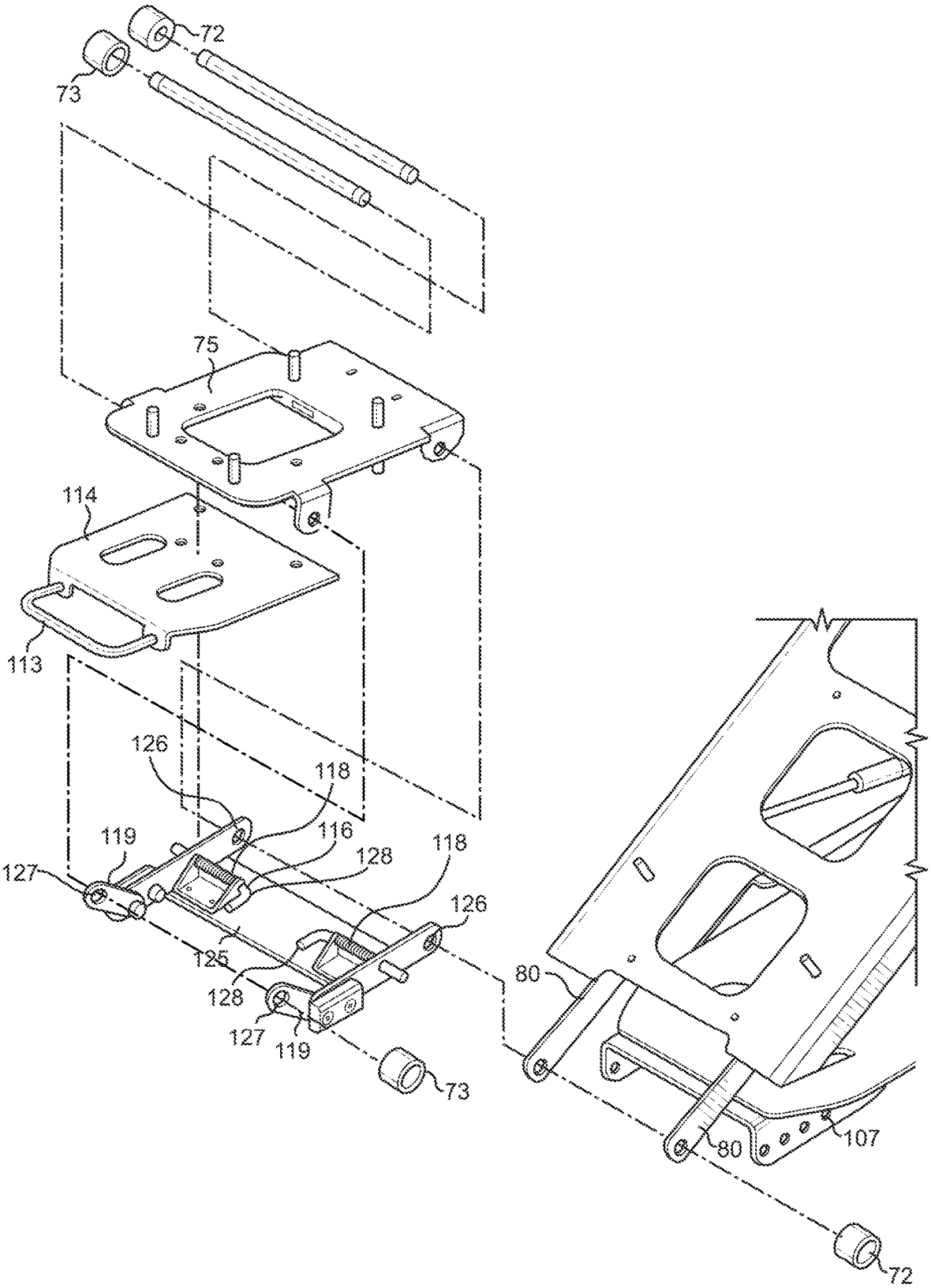
FIG. 35 is a partial exploded perspective view of a retractable wall mountable inclinable bench showing various components of a second latch and second latch receiver in accordance with an alternative example embodiment.

As best illustrated in FIG. 35, the latch pins 116 can be mounted to a latch pin base 125 using mounting brackets or other suitable connectors. The latch pin base 125 can have a rear end portion, a front end portion and opposite first and second side surfaces between the rear end and front end portions. The latch pins 116 can extend outwardly from the latch pin base 125 through suitable aligned openings in the mounting brackets and the first and second side surfaces. The latch pin base 125 with the latch pins 116 can be connected to the fixed mounting plate 75 of the seat portion 62 of the bench 60 and thereby move with the seat portion 62 as it moves along the track 42 and pivots upwardly as described herein previously. The latch pin base 125 can be connected to the mounting plate 75 via the same front and rear end axles that extend through the front and rear end axle mounts on the lower surface of the mounting plate 75 and that support the seat portion 62 on the rotatable first and second movable elements 72, 73 as described previously herein.

For that purpose, rear axle openings 126 can be formed in alignment in the first and second opposite side surfaces at or near the rear end portion of the latch pin base 125 through which the rear end axle can rotatably pass. At or near the front end portion of the latch pin base 125, elongated seat retainer 119 structures can be arranged to extend forwardly and upwardly at an angle from each of the opposite first and second side surfaces. Each seat retainer 119 has an aligned first end with an opening for the front end axle to pass through, and a second end opposite of the first end that is pivotably connected to one of the first and second opposite side surfaces. The seat retainers 119 accommodate the upward pivoting and inclination of the seat portion 62 as it moves on the track 42 as described herein previously while maintaining the connection of the latch pins 116 to the mounting plate 75, and preventing the seat portion 62 from becoming disconnected as it inclines.

As best illustrated in FIGS. 33A-33C and 35, the second latch 106 also preferably comprises a source of a bias force to urge a latch pin 116 in the engaged or latched position illustrated in FIGS. 33A and 34A wherein the first end of the latch pin 116 is extended outwardly sufficiently to be received and retained in a latch receiver 107 on a side surface of the second segment 40. Assuming the latch pin 116 is aligned with a latch receiver 107 on the side of the second segment 40, the second latch 106 is then urged to remain in the latched position with the seat portion 62 of the bench 60 latched to the second segment 40. It will be appreciated that a source of bias force can be provided for one, some, or all of the latch pins 116. In the alternative example embodiment, a source of bias force is provided for each of the pair of latch pins 116.

The source of the bias force may comprise one or more second bias springs 118 or any other suitable source of a bias force. The second bias springs 118 may be elongated and substantially cylindrical with opposite first and second ends. A second bias spring 118 may be positioned under compression within a mounting bracket that connects the latch pin 116 to the latch pin base 125 and the latch pin 116 may pass through the second bias spring 118. The first end of the second bias spring 118 can be in engagement with a stop on an exterior surface of the latch pin 116 and the second end of the second bias spring 118 can be in engagement with a stop on the mounting bracket. With this arrangement, the second bias spring 118 urges the latch pin 116 outwardly toward a side of the second segment 40 and into an extended engaged or latched position as described above.

The bias force provided by the second bias springs 118 is preferably sufficiently great to maintain the latch pins 116 in the extended position in engagement with corresponding second latch receivers 107 as illustrated in FIG. 33A. In this position, the second latch 106 is in the engaged or latched position and the seat portion 62 is latched to the second segment 40. This state remains unless and until a sufficient force is imparted by an exerciser to the protrusion 113 of the second latch operator 112 to overcome the bias force. When an exerciser applies sufficient pulling force to the protrusion 113 in the direction of the front end portion of the seat portion 62 to overcome the bias force, the movable operators 115 cause the latch pins 116 to begin to retract inwardly from the sides of the second segment 40 as illustrated in FIG. 33B and as described above. As the exerciser continues to apply pulling force to the protrusion 113, the movable operators 115 continue to cause the latch pins 116 to retract further inwardly until ultimately they reach the disengaged or unlatched position wherein the first ends of the latch pins 116 are no longer extended outwardly a sufficient distance to engage with a corresponding second latch receiver 107 as illustrated in FIG. 33C. At this point, the second latch 106 is in the disengaged or unlatched position and the seat portion 62 of the bench 60 is freely movable longitudinally relative to the second segment 40 on the track 42.

The second latch receivers 107 of the second latch 106 comprise a plurality of selectable longitudinally spaced-apart second latch receivers 107 that are connected, attached, or formed in the second segment 40 of the bench 60. In the alternative example embodiment, an identical plurality of second latch receivers 107 are formed directly facing each other on the opposite sides of the second segment 40 with the second latch receivers 107 of each plurality being longitudinally spaced along a side of the second segment 40 and each individual second latch receiver 107 being adapted to receive and retain a second end of one of the pair of latch pins 116 described above.

Each second latch receiver 107 may comprise an opening in a side of the second segment 40 between the first and second levels 43, 44 of the track 42 as best illustrated in FIGS. 28, and 30A-30C. However, it will be appreciated that the second latch receivers 107 may also comprise other structures attached to or incorporated with the second segment 40 that are similarly adapted and configured to receive and retain the first ends of the latch pins 116.

It will be appreciated that the longitudinal locations of the second latch receivers 107 on the second segment 40 correspond to a plurality of different upwardly inclined positions in which an exerciser may select to place the bench 60 for exercising, such as the several example inclined positions illustrated in FIGS. 28 and 30A-30C. As previously described herein, at each upwardly inclined position the torso and seat portions 61, 62 of the bench 60 will have a different opposing angle of incline. It will also be appreciated that as the locations of the second latch receivers 107 get closer to the rear end portion of the second segment 40 the position of the seat portion 62 moves progressively toward the rear end portion of the second segment 40 and the angle of inclination of the torso portion 61 becomes progressively steeper because the seat portion 62 and the torso portion 61 are pivotally linked as previously described herein.

Turning to operation of the alternative example latch embodiment, an exerciser may move the bench 60 from the substantially vertical retracted compact storage position illustrated in FIG. 29 to the extended substantially horizontal position illustrated in FIG. 30A in the manner previously described herein. During this movement, the torso portion 61 remains latched to the second segment 40 by the first latch 102 and the seat portion 62 remains latched to the second segment 40 by the second latch 106. Accordingly, with the bench 60 in the extended substantially horizontal position, the exerciser may use the bench 60 to perform exercises and the torso and seat portions 61, 62 of the bench 60 are prevented from moving longitudinally and/or from pivoting upwardly relative to the second segment 40.

When the exerciser desires to move the bench 60 to a selected upwardly inclined position, the exerciser pulls the protrusion 108 of the first latch operator 104 of the first latch 102 rearward against the bias force urging the latch pin 109 into the latched position. This causes the latch pin 109 to retract from the first latch receiver 105 to the unlatched position and unlatch the torso portion 61 from the second segment 40. The torso portion 61 is then free to be pivoted upwardly and inclined in relation to the second segment 40 and the exerciser may release the protrusion 108.

When the protrusion 108 is released, the latch pin 109 of the first latch operator 104 will return to the latched position under the bias force of the first bias spring 117. However, the torso portion 61 of the bench 60 will not be relatched to the second segment 40 so long as the torso portion 61 is not lowered into position proximal and parallel to the second segment 40 with the latch pin 109 aligned with the first latch receiver 105.

Separately, the exerciser pulls the protrusion 113 of the second latch operator 112 of the second latch 106 toward the front end portion of the seat portion 62 of the bench 60 against the bias force provided by the first bias springs 117 urging the second latch operator 112, movable connector 114, movable operators 115, and second latch pins 116 in the latched position. This causes the movable operator 114 of the second latch operator 112 to move toward the front end portion of the seat portion 62, the movable operators 115 to pivot about their pivot connections 122, and the second latch pins 116 to be retracted inwardly against the bias forces of the second bias springs 118 until the second latch pins 116 are out of engagement with their corresponding second latch receivers 107 and the seat portion 62 is unlatched from the second segment 40. The exerciser may then freely move the seat portion 62 longitudinally in relation to the second segment 40 on the track 42 as previously described herein.

The exerciser can move the seat portion 61 longitudinally to a selected location on the second segment 40 that corresponds to a location of one of the plurality of second latch receivers 107, then release the protrusion 113. If the second latch pins 116 are in alignment with corresponding second latch receivers 107 on the sides of the second segment 40, the bias forces provided by the second bias springs 118 will urge the second latch pins 116 into engagement with the aligned second latch receivers 107 and the seat portion 62 of the bench 60 will be latched to the second segment 40 at that position. However, if the second latch pins 116 are not in alignment with corresponding latch receivers 107, the bias forces will urge the first ends of the second latch pins 116 into contact with the sides of the second segment 40. The exerciser may move the seat portion 62 longitudinally either rearwardly or forwardly to align the second latch pins 116 with the next available second latch receivers 107 and the bias forces will automatically cause the first ends of the second latch pins to 116 to extend outwardly into the aligned second latch receivers 107 and the seat portion 62 to become latched to the second segment 40 with the bench 60 in the selected upwardly inclined position.

If the exerciser desires to move the bench 60 to another selected inclined position, the exerciser pulls the protrusion 113 of the second latch operator 112 toward the front end portion of the seat portion 62 to unlatch the seat portion 62 from the second segment 40 and moves the seat portion 62 longitudinally on the second segment 40 to the desired position. The seat portion 62 is then latched to the second segment 40 at the new selected position in the manner described above. Similarly, if the exerciser desires to return the bench 60 to the extended substantially horizontal position, the exerciser pulls the protrusion 113 as described to unlatch the seat portion 62 from the second segment 40 and then moves the seat portion 62 toward the front end portion of the second segment 40 and pivots the torso portion 61 downwardly until it is proximal and parallel to the second segment 40.

As the exerciser returns the bench 60 to the substantially horizontal position and releases the protrusion 113, the second latch 106 automatically latches the seat portion 62 to the second segment 40. This is because as the seat portion 62 reaches the horizontal position the bias forces provided by the first and second bias springs 117, 118 automatically urge the second latch operator 112 into its latched position and the second latch pins 116 into their latched positions in engagement with the second latch receivers 107 corresponding to the horizontal position of the seat portion 62.

Similarly, the first latch 102 automatically latches the torso portion 61 to the second segment 40 as the torso portion 61 descends to the substantially horizontal position. This is because as the torso portion 61 descends, the latch pin 109 connected to the mounting plate 74 beneath the torso portion 61 engages a surface of the first latch receiver 105 connected to the upper surface of the second segment 40. The engagement causes the latch pin 109 to retract against the bias force urging it into the latched position until it comes into alignment with the opening in the first latch receiver 105. The bias force then automatically forces the latch pin 109 to extend into the opening automatically latching the torso portion 61 to the second segment 40. Once the torso and seat portions 61, 62 are relatched to the second segment 40 in the horizontal position, the exerciser can move the bench 10 to the retracted compact position for storage as previously described herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the retractable wall mountable inclinable bench system, suitable methods and materials are described above. All publications, patent applications, patents, and other references mentioned herein are incorporated by reference in their entirety to the extent allowed by applicable law and regulations. The retractable wall mountable inclinable bench system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An inclinable bench, comprising:

a support segment having a front end portion and a rear end portion;

a track on the support segment, wherein the track has a first level, a ramp and a second level, wherein the second level is elevated in relation to the first level, and wherein the ramp connects the first level and the second level;

a torso portion supported on the support segment, wherein the torso portion has a front end portion, a rear end portion, and a first surface; and a seat portion, wherein the seat portion has a front end portion, a rear end portion, and a second surface;

wherein the torso portion and the seat portion are connected and are movable together between a first position and a second position;

wherein in the first position the first surface and the second surface are both substantially horizontal and co-planar;

wherein in the second position the first surface of the torso portion is inclined with the rear end portion of the torso portion higher than the front end portion of the torso portion;

wherein in the second position the second surface of the seat portion is inclined with the front end portion of the seat portion higher than the rear end portion of the seat portion;

wherein the front end portion of the seat portion is movably positioned upon the track, wherein the front end portion of the seat portion is positioned on the first level of the track when in the first position, and wherein the front end portion of the seat portion is positioned on the second level of the track when in the second position.

2. The inclinable bench of claim 1, further comprising a mounting bracket adapted to be attached to a wall, wherein the support segment is connected to the mounting bracket.

3. The inclinable bench of claim 1, comprising a latch adapted to selectively latch the torso portion to the support segment in the first position.

4. The inclinable bench of claim 1, comprising a retainer adapted to maintain the seat portion parallel with respect to the torso portion when in the first position.

5. The inclinable bench of claim 1, comprising a latch adapted to latch the seat portion to the support segment in the second position.

6. The inclinable bench of claim 1, comprising an elongated rigid support member pivotally connected between the torso portion and the support segment for supporting the torso portion in the second position.

7. The inclinable bench of claim 1, comprising an elongated actuator pivotally connected between the torso portion and the support segment, wherein the elongated actuator is adapted to provide a bias force to the torso portion to urge the torso portion into the second position.

8. The inclinable bench of claim 1, further comprising a movable element attached to or near the front end portion of the seat portion, wherein the movable element is movable along the first level, the ramp and the second level of the track.

9. The inclinable bench of claim 8, wherein the movable element is comprised of a roller.

10. The inclinable bench of claim 1, comprising:

a first movable element attached to the seat portion at or near the rear end portion of the seat portion; and a second movable element attached to the seat portion at or near the front end portion of the seat portion;

wherein the first movable element is movable along the first level of the track, and wherein the second movable element is movable along the ramp and the second level of the track.

11. The inclinable bench of claim 1, wherein the front end portion of the torso portion is pivotally connected to the rear end portion of the seat portion.

12. The inclinable bench of claim 1, wherein the first level and the second level of the track are substantially parallel to one another.

13. The inclinable bench of claim 1, wherein the first level of the track, the second level of the track and an upper surface of the support segment are substantially parallel to one another.

14. The inclinable bench of claim 1, wherein the first level of the track is substantially at the same level as an upper surface of the support segment.

15. The inclinable bench of claim 1, wherein the seat portion is moved longitudinally along the support segment toward the rear end portion of the support segment to move the seat portion from the first position to the second position.

16. The inclinable bench of claim 1, wherein the seat portion is moved longitudinally along the support segment toward the front end portion of the support segment to move the seat portion from the second position to the first position.

17. An inclinable bench, comprising:

a mounting bracket adapted to be attached to a wall;

a support segment having a front end portion and a rear end portion, wherein the rear end portion of the support segment is connected to the mounting bracket;

a track on the support segment, wherein the track has a first level, a ramp and a second level, wherein the second level is elevated in relation to the first level, and wherein the ramp connects the first level and the second level;

wherein the first level of the track, the second level of the track and an upper surface of the support segment are substantially parallel to one another;

a torso portion supported on the support segment, wherein the torso portion has a front end portion, a rear end portion, and a first surface; and a seat portion, wherein the seat portion has a front end portion, a rear end portion, and a second surface;

wherein the torso portion and the seat portion are connected and are movable together between a first position and a second position;

wherein in the first position the first surface and the second surface are both substantially horizontal and co-planar;

wherein in the second position the first surface of the torso portion is inclined with the rear end portion of the torso portion higher than the front end portion of the torso portion;

wherein in the second position the second surface of the seat portion is inclined with the front end portion of the seat portion higher than the rear end portion of the seat portion;

wherein the front end portion of the seat portion is movably positioned upon the track, wherein the front end portion of the seat portion is positioned on the first level of the track when in the first position, and wherein the front end portion of the seat portion is positioned on the second level of the track when in the second position.

18. The inclinable bench of claim 17, further comprising a movable element attached to or near the front end portion of the seat portion, wherein the movable element is movable along the first level, the ramp and the second level of the track.

19. An inclinable bench, comprising:

a mounting bracket adapted to be attached to a wall;

a support segment having a front end portion and a rear end portion, wherein the rear end portion of the support segment is connected to the mounting bracket;

a track on the support segment, wherein the track has a first level, a ramp and a second level, wherein the second level is elevated in relation to the first level, and wherein the ramp connects the first level and the second level;

wherein the first level of the track, the second level of the track and an upper surface of the support segment are substantially parallel to one another;

a torso portion supported on the support segment, wherein the torso portion has a front end portion, a rear end portion, and a first surface; and a seat portion, wherein the seat portion has a front end portion, a rear end portion, and a second surface;

a movable element attached to or near the front end portion of the seat portion, wherein the movable element is movable along the first level, the ramp and the second level of the track;

wherein the torso portion and the seat portion are connected and are movable together between a first position and a second position;

wherein the front end portion of the torso portion is pivotally connected to the rear end portion of the seat portion;

wherein in the first position the first surface and the second surface are both substantially horizontal and co-planar;

wherein in the second position the first surface of the torso portion is inclined with the rear end portion of the torso portion higher than the front end portion of the torso portion;

wherein in the second position the second surface of the seat portion is inclined with the front end portion of the seat portion higher than the rear end portion of the seat portion;

wherein the front end portion of the seat portion is movably positioned upon the track, wherein the front end portion of the seat portion is positioned on the first level of the track when in the first position, and wherein the front end portion of the seat portion is positioned on the second level of the track when in the second position.

20. The inclinable bench of claim 19, wherein the seat portion is moved longitudinally along the support segment toward the rear end portion of the support segment to move the seat portion from the first position to the second position, and wherein the seat portion is moved longitudinally along the support segment toward the front end portion of the support segment to move the seat portion from the second position to the first position.

* * * * *